US007757318B2

(12) United States Patent
Poulos et al.

(10) Patent No.: US 7,757,318 B2
(45) Date of Patent: Jul. 20, 2010

(54) MATTRESS FOR A HOSPITAL BED

(75) Inventors: Craig Poulos, Wilmette, IL (US); Patrick Harris, Downers Grove, IL (US); Sohrab Soltani, Charleston, SC (US)

(73) Assignee: Kreg Therapeutics, Inc., Chicago, IL (US)

( * ) Notice: Subject to any disclaimer, the term of this patent is extended or adjusted under 35 U.S.C. 154(b) by 468 days.

(21) Appl. No.: 11/224,691

(22) Filed: Sep. 12, 2005

(65) Prior Publication Data

US 2006/0053562 A1 Mar. 16, 2006

Related U.S. Application Data

(60) Provisional application No. 60/609,390, filed on Sep. 13, 2004.

(51) Int. Cl.
*A61G 7/053* (2006.01)

(52) U.S. Cl. ..... 5/624; 5/722; 5/613

(58) Field of Classification Search ..... 5/613, 5/618, 624, 661, 722, 727
See application file for complete search history.

(56) References Cited

U.S. PATENT DOCUMENTS

| | | | | |
|---|---|---|---|---|
| 358,466 | A | 3/1887 | Lueders | |
| 375,448 | A | 12/1887 | Hayward | |
| 628,700 | A | 7/1899 | Dann | |
| 1,398,203 | A | 11/1921 | Schmidt | |
| 1,525,864 | A | 2/1925 | Hueseman | |
| 2,034,985 | A | 3/1936 | Lilley | |
| 2,171,251 | A | 8/1939 | Capron | |
| 2,308,592 | A | 1/1943 | Drexler et al. | |
| 2,472,675 | A * | 6/1949 | Mueller | 5/618 |
| 2,514,655 | A | 7/1950 | Luketa | |
| 2,562,339 | A | 7/1951 | Socol | |
| 2,656,876 | A | 10/1953 | Larrick | |
| 2,658,211 | A | 11/1953 | Bendersky | |
| 2,766,463 | A | 10/1956 | Bendersky | |

(Continued)

FOREIGN PATENT DOCUMENTS

| | | | |
|---|---|---|---|
| GB | 183181 | A | 7/1922 |

(Continued)

OTHER PUBLICATIONS

Djacent. Dictionary.com. Dictionary.com Unabridged (v 1.1). Random House, Inc. http://dictionary.reference.com/browse/adjacent (accessed: Dec. 11, 2008).*

*Primary Examiner*—Thomas B Will
*Assistant Examiner*—Gilbert Y Lee
(74) *Attorney, Agent, or Firm*—McDermott Will & Emery LLP

(57) ABSTRACT

A mattress for a hospital bed is provided. The mattress includes an encasing enclosing a compressible mattress portion and a rigid mattress portion. The compressible mattress portion has an integral construction extending from a head end of the bed to a foot end of the bed. The rigid mattress portion contracts from a first elongated position to a second retracted position, and the rigid portion contracting the compressible mattress portion therewith. The rigid mattress portion may be provided at any side or end section of the mattress. Accordingly, the width or length of the mattress can be modified.

9 Claims, 40 Drawing Sheets

U.S. PATENT DOCUMENTS

| | | | | | |
|---|---|---|---|---|---|
| 2,817,855 | A | | 12/1957 | Pratt | |
| 3,045,259 | A | | 7/1962 | Mayer | |
| 3,064,278 | A | | 11/1962 | Broyles | |
| 3,081,463 | A | | 3/1963 | Williams et al. | |
| 3,090,971 | A | | 5/1963 | MacDonald | |
| 3,093,839 | A | | 6/1963 | Higgins | |
| 3,094,713 | A | | 6/1963 | Wise | |
| 3,112,500 | A | | 12/1963 | MacDonald | |
| 3,149,349 | A | | 9/1964 | Nelson | |
| 3,210,779 | A | | 10/1965 | Herbold | |
| 3,220,022 | A | | 11/1965 | Nelson | |
| 3,234,570 | A | | 2/1966 | Hutt | |
| 3,237,212 | A | | 3/1966 | Hillenbrand et al. | |
| 3,239,853 | A | | 3/1966 | MacDonald | |
| 3,262,133 | A | | 7/1966 | Beitzel | |
| 3,281,141 | A | | 10/1966 | Smiley et al. | |
| 3,327,328 | A | | 6/1967 | Slivoski | |
| 3,477,071 | A | | 11/1969 | Emerson | |
| 3,485,240 | A | | 12/1969 | Fountain | |
| 3,486,176 | A | | 12/1969 | Murcott | |
| 3,495,869 | A | | 2/1970 | Ingemansson | |
| 3,506,989 | A | | 4/1970 | Ross et al. | |
| 3,585,660 | A | | 6/1971 | Gottfried et al. | |
| 3,593,350 | A | | 7/1971 | Knight et al. | |
| 3,695,701 | A | | 10/1972 | Knabusch et al. | |
| 3,717,885 | A | | 2/1973 | DeMare | |
| 3,781,060 | A | | 12/1973 | Pentzien | |
| 3,930,273 | A | | 1/1976 | Stern | |
| 3,932,903 | A | | 1/1976 | Adams et al. | |
| 3,971,083 | A | | 7/1976 | Peterson | |
| 3,974,530 | A | | 8/1976 | Lusch et al. | |
| 4,084,274 | A | | 4/1978 | Willis et al. | |
| 4,103,376 | A | | 8/1978 | Benoit et al. | |
| 4,139,917 | A | | 2/1979 | Fenwick | |
| 4,152,795 | A | | 5/1979 | Rodosta et al. | |
| 4,175,550 | A | | 11/1979 | Leininger et al. | |
| 4,183,109 | A | | 1/1980 | Howell | |
| 4,188,677 | A | | 2/1980 | Zur | |
| 4,225,988 | A | | 10/1980 | Cary et al. | |
| 4,227,269 | A | | 10/1980 | Johnston | |
| 4,258,445 | A | * | 3/1981 | Zur | 5/614 |
| 4,271,547 | A | | 6/1981 | Grossutti | |
| 4,277,858 | A | | 7/1981 | Bohme | |
| 4,375,706 | A | | 3/1983 | Finnhult | |
| 4,376,317 | A | | 3/1983 | Johnston | |
| 4,409,695 | A | | 10/1983 | Johnston et al. | |
| 4,432,359 | A | | 2/1984 | James | |
| 4,485,505 | A | * | 12/1984 | Paul | 5/714 |
| 4,494,259 | A | | 1/1985 | Miller et al. | |
| 4,509,217 | A | | 4/1985 | Therrien | |
| 4,612,679 | A | | 9/1986 | Mitchell | |
| 4,632,450 | A | | 12/1986 | Holdt | |
| 4,639,954 | A | | 2/1987 | Speed | |
| 4,653,129 | A | | 3/1987 | Kuck et al. | |
| 4,654,903 | A | | 4/1987 | Chubb et al. | |
| 4,658,450 | A | | 4/1987 | Thompson | |
| 4,669,136 | A | | 6/1987 | Waters et al. | |
| 4,686,725 | A | | 8/1987 | Mitchell | |
| 4,700,417 | A | | 10/1987 | McGovern | |
| 4,724,555 | A | | 2/1988 | Poehner et al. | |
| 4,787,104 | A | | 11/1988 | Grantham | |
| 4,821,351 | A | | 4/1989 | Bergenwall | |
| 4,847,929 | A | | 7/1989 | Pupovic | |
| 4,862,529 | A | | 9/1989 | Peck | |
| 4,862,530 | A | | 9/1989 | Chen | |
| 4,862,538 | A | | 9/1989 | Spann et al. | |
| 4,901,387 | A | | 2/1990 | Luke | |
| 4,941,221 | A | | 7/1990 | Kanzler | |
| 4,944,054 | A | | 7/1990 | Bossert | |
| 4,947,496 | A | | 8/1990 | Connolly | |
| 4,985,946 | A | | 1/1991 | Foster et al. | |
| 4,993,089 | A | | 2/1991 | Solomon et al. | |
| 4,997,200 | A | | 3/1991 | Earls | |
| 5,023,967 | A | | 6/1991 | Ferrand | |
| 5,025,519 | A | | 6/1991 | Spann et al. | |
| 5,039,158 | A | | 8/1991 | Maier | |
| 5,040,253 | A | | 8/1991 | Cheng | |
| 5,050,899 | A | | 9/1991 | Stensby | |
| 5,070,560 | A | | 12/1991 | Wilkinson | |
| 5,072,463 | A | | 12/1991 | Willis | |
| 5,077,843 | A | | 1/1992 | Dale et al. | |
| 5,083,332 | A | | 1/1992 | Foster et al. | |
| 5,083,334 | A | | 1/1992 | Huck et al. | |
| 5,095,561 | A | | 3/1992 | Green et al. | |
| 5,117,521 | A | | 6/1992 | Foster et al. | |
| 5,129,117 | A | | 7/1992 | Celestina et al. | |
| 5,157,787 | A | | 10/1992 | Donnellan et al. | |
| 5,169,208 | A | | 12/1992 | Re et al. | |
| 5,179,744 | A | | 1/1993 | Foster et al. | |
| 5,187,824 | A | | 2/1993 | Stryker | |
| 5,224,228 | A | | 7/1993 | Larrimore | |
| 5,230,113 | A | | 7/1993 | Foster et al. | |
| 5,252,278 | A | | 10/1993 | Spann et al. | |
| 5,279,010 | A | | 1/1994 | Ferrand et al. | |
| 5,337,845 | A | | 8/1994 | Foster et al. | |
| 5,342,114 | A | * | 8/1994 | Burke et al. | 297/344.2 |
| 5,377,370 | A | | 1/1995 | Foster et al. | |
| D355,322 | S | | 2/1995 | Ackley et al. | |
| 5,394,581 | A | | 3/1995 | Leoutsakos | |
| 5,398,357 | A | | 3/1995 | Foster | |
| 5,402,544 | A | | 4/1995 | Crawford et al. | |
| 5,412,821 | A | | 5/1995 | Wilkinson | |
| 5,425,148 | A | | 6/1995 | Ashcraft et al. | |
| 5,444,883 | A | | 8/1995 | Iura | |
| 5,454,126 | A | | 10/1995 | Foster et al. | |
| 5,479,665 | A | | 1/1996 | Cassidy et al. | |
| 5,479,666 | A | | 1/1996 | Foster et al. | |
| 5,483,709 | A | | 1/1996 | Foster et al. | |
| 5,485,699 | A | | 1/1996 | Gabhart | |
| 5,487,196 | A | | 1/1996 | Wilkinson et al. | |
| 5,502,853 | A | | 4/1996 | Singleton et al. | |
| 5,507,562 | A | | 4/1996 | Wieland | |
| 5,513,406 | A | | 5/1996 | Foster et al. | |
| 5,577,279 | A | | 11/1996 | Foster et al. | |
| 5,580,504 | A | | 12/1996 | Spann et al. | |
| 5,586,346 | A | | 12/1996 | Stacy et al. | |
| 5,603,133 | A | | 2/1997 | Vrzalik | |
| 5,604,942 | A | | 2/1997 | Allevato et al. | |
| 5,613,252 | A | | 3/1997 | Yu et al. | |
| 5,613,255 | A | | 3/1997 | Bish et al. | |
| 5,628,078 | A | | 5/1997 | Pennington et al. | |
| 5,630,238 | A | | 5/1997 | Weismiller et al. | |
| 5,638,563 | A | | 6/1997 | Iura | |
| 5,649,331 | A | | 7/1997 | Wilkinson et al. | |
| 5,659,910 | A | | 8/1997 | Weiss | |
| 5,666,681 | A | | 9/1997 | Meyer et al. | |
| 5,672,849 | A | | 9/1997 | Foster et al. | |
| 5,680,661 | A | | 10/1997 | Foster et al. | |
| 5,682,631 | A | | 11/1997 | Weismiller et al. | |
| 5,692,256 | A | | 12/1997 | Kramer et al. | |
| 5,699,566 | A | | 12/1997 | Chuang | |
| 5,708,997 | A | | 1/1998 | Foster et al. | |
| 5,715,548 | A | | 2/1998 | Weismiller et al. | |
| 5,724,685 | A | | 3/1998 | Weismiller et al. | |
| 5,732,423 | A | | 3/1998 | Weismiller et al. | |
| 5,745,936 | A | | 5/1998 | Van McCutchen et al. | |
| 5,745,937 | A | | 5/1998 | Weismiller et al. | |
| 5,771,511 | A | * | 6/1998 | Kummer et al. | 5/600 |
| 5,781,949 | A | | 7/1998 | Weismiller et al. | |
| 5,790,997 | A | | 8/1998 | Ruehl | |
| 5,832,549 | A | | 11/1998 | Le Pallec et al. | |
| 5,845,352 | A | | 12/1998 | Matsler et al. | |
| 5,857,739 | A | | 1/1999 | Smith | |
| 5,860,899 | A | | 1/1999 | Rassman | |

5,878,452 A 3/1999 Brooke et al.
5,933,888 A 8/1999 Foster et al.
5,940,910 A 8/1999 Weismiller et al.
5,983,429 A 11/1999 Stacy et al.
5,987,668 A 11/1999 Ackley
5,996,150 A 12/1999 Blevins et al.
6,036,271 A 3/2000 Wilkinson et al.
6,038,717 A 3/2000 Persson
6,038,721 A 3/2000 Gordon
6,047,422 A 4/2000 Yousif
6,089,593 A 7/2000 Hanson et al.
6,095,610 A 8/2000 Okajima et al.
6,112,345 A 9/2000 Foster et al.
6,141,806 A 11/2000 Bobey et al.
6,151,739 A 11/2000 Meyer et al.
6,154,899 A 12/2000 Brooke et al.
6,163,903 A 12/2000 Weismiller et al.
6,182,310 B1 2/2001 Weismiller et al.
6,212,714 B1 4/2001 Allen et al.
6,223,369 B1 5/2001 Maier et al.
6,230,346 B1 5/2001 Branson et al.
6,240,583 B1 6/2001 Brooke et al.
6,253,397 B1 7/2001 Bartow et al.
6,256,812 B1 7/2001 Bartow et al.
6,256,822 B1 7/2001 Weston et al.
6,272,702 B1 8/2001 Uchida et al.
6,282,735 B1 9/2001 Stolpmann et al.
6,282,737 B1 9/2001 Vrzalik
6,315,319 B1 11/2001 Hanson et al.
6,320,510 B2 11/2001 Menkedick et al.
6,324,709 B1 12/2001 Ikeda et al.
6,336,235 B1 1/2002 Ruehl
6,351,863 B1 3/2002 Meyer et al.
6,357,065 B1 3/2002 Adams
6,360,385 B1 3/2002 Lewandowski
6,363,552 B1 4/2002 Hornbach et al.
6,374,436 B1 4/2002 Foster et al.
6,374,437 B1 4/2002 Voelker
6,397,416 B2 6/2002 Brooke et al.
6,415,814 B1 7/2002 Hand et al.
6,427,264 B1 8/2002 Metz et al.
6,427,270 B1 8/2002 Blevins et al.
6,446,283 B1 9/2002 Heimbrock et al.
6,460,930 B2 10/2002 Thornton
6,496,993 B2 12/2002 Allen et al.
6,499,163 B1 12/2002 Stensby
6,499,167 B1 12/2002 Ellis et al.
6,516,479 B1 2/2003 Barbour
6,526,609 B2 3/2003 Wong
6,536,056 B1 3/2003 Vrzalik et al.
6,547,330 B1 4/2003 Hester
6,564,409 B2 5/2003 Metz et al.
6,565,112 B2 5/2003 Hanson et al.
6,584,628 B1 7/2003 Kummer et al.
6,584,629 B2 7/2003 Tsuji et al.
6,601,251 B2 8/2003 Paul
6,611,979 B2 9/2003 Welling et al.
6,622,323 B2 9/2003 Zerhusen et al.
6,622,364 B2 9/2003 Hamilton et al.
6,640,360 B2 11/2003 Hornbach et al.
6,640,361 B2 11/2003 Heimbrock et al.
6,643,873 B2 11/2003 Heimbrock et al.
6,651,281 B1 11/2003 Figiel
6,654,974 B2 12/2003 Ruehl et al.
6,658,680 B2 12/2003 Osborne et al.
6,663,184 B2 12/2003 Hagiike
6,675,415 B2 1/2004 Wong
6,678,908 B2 1/2004 Borders et al.
6,684,427 B2 2/2004 Allen et al.
6,691,346 B2 2/2004 Osborne et al.
6,691,348 B2 2/2004 Plummer et al.
6,691,349 B2 2/2004 Blevins
6,691,350 B2 2/2004 Weismiller
6,694,549 B2 2/2004 Perez et al.
6,694,557 B1 2/2004 Bobey et al.
6,695,406 B2 2/2004 Plant
6,698,836 B1 3/2004 Veneruso
6,704,954 B2 3/2004 Metz et al.
6,704,956 B2 3/2004 Riley et al.
6,708,358 B2 3/2004 Hensley
6,715,169 B2 4/2004 Niederkrom
6,721,975 B1 4/2004 Lemire
6,725,474 B2 4/2004 Foster et al.
6,725,479 B1 4/2004 Stryker et al.
6,728,983 B2 5/2004 Bartlett
6,728,985 B2 5/2004 Brooke et al.
6,732,390 B2 5/2004 Krywiczanim
6,757,924 B2 7/2004 Goodwin et al.
6,779,209 B2 8/2004 Ganance
6,781,517 B2 8/2004 Moster et al.
6,782,574 B2 8/2004 Totton et al.
6,791,460 B2 9/2004 Dixon et al.
6,817,363 B2 11/2004 Biondo et al.
6,820,293 B2 11/2004 Alverson
6,820,294 B2 11/2004 Shiery et al.
6,822,571 B2 11/2004 Conway
6,826,793 B2 12/2004 Tekulve
6,829,793 B2 12/2004 Brooke et al.
6,829,796 B2 12/2004 Salvatini et al.
6,839,926 B2 1/2005 Heimbrock et al.
6,846,042 B2 1/2005 Hanson et al.
6,851,142 B2 2/2005 Stryker et al.
6,854,145 B2 2/2005 Ruehl et al.
6,862,759 B2 3/2005 Hand et al.
6,866,341 B2 3/2005 Behnert
6,874,179 B2 4/2005 Hensley et al.
6,874,185 B1 4/2005 Phillips et al.
6,874,800 B2 4/2005 George
6,880,186 B2 4/2005 Johansson
6,880,189 B2 4/2005 Welling et al.
6,892,405 B1 5/2005 Dimitriu et al.
6,897,780 B2 5/2005 Ulrich et al.
6,901,617 B2 6/2005 Sprouse, II et al.
6,904,631 B2 6/2005 Vrzalik et al.
6,910,236 B2 6/2005 Rene
6,922,863 B2 8/2005 Giori et al.
6,924,441 B1 8/2005 Mobley et al.
6,926,366 B2 8/2005 Wolters
6,928,673 B2 8/2005 Risk, Jr.
6,934,987 B2 8/2005 Newkirk et al.
6,938,289 B2 9/2005 Morin
6,951,036 B2 10/2005 Lemire
6,952,852 B2 10/2005 Reeder et al.
6,978,501 B2 12/2005 Vrzalik
6,993,799 B2 2/2006 Foster et al.
7,000,272 B2 2/2006 Allen et al.
7,007,323 B2 3/2006 Zerhusen et al.
7,017,208 B2 * 3/2006 Weismiller et al. ..... 5/600
7,237,287 B2 * 7/2007 Weismiller et al. ..... 5/616
7,296,314 B2 * 11/2007 Wyatt et al. ..... 5/713
2001/0048239 A1 12/2001 Kogure
2002/0174487 A1 11/2002 Kramer et al.
2003/0075966 A1 4/2003 Behnert
2003/0080597 A1 5/2003 Beroth et al.
2003/0167568 A1 9/2003 Brooke
2003/0221262 A1 * 12/2003 Torbet et al. ..... 5/713
2004/0010855 A1 * 1/2004 Piraino ..... 5/727
2004/0034931 A1 2/2004 Kummer et al.
2004/0143904 A1 7/2004 Borders et al.
2004/0154097 A1 8/2004 Blevins
2005/0012377 A1 1/2005 Ito
2005/0028289 A1 2/2005 Hakamiun
2005/0034764 A1 2/2005 Hanh et al.
2005/0076715 A1 4/2005 Kuklis et al.
2005/0160530 A1 7/2005 Taguchi et al.
2005/0166323 A1 8/2005 Kawakami et al.

2005/0166328 A1 8/2005 Ben-Levi
2005/0262635 A1 12/2005 Wing
2006/0006724 A1 1/2006 Shimizu
2006/0021142 A1 2/2006 Hornbach et al.
2006/0021144 A1 2/2006 Hornbach et al.
2006/0021145 A1 2/2006 Hornbach et al.
2006/0026762 A1 2/2006 Hornbach et al.
2006/0026765 A1 2/2006 Hornbach et al.
2006/0026767 A1 2/2006 Chambers et al.
2006/0026768 A1 2/2006 Chambers et al.
2006/0053555 A1* 3/2006 Poulos et al. ..... 5/618
2006/0059621 A1* 3/2006 Poulos et al. ..... 5/430
2006/0059624 A1* 3/2006 Poulos et al. ..... 5/618
2006/0162079 A1* 7/2006 Menkedick et al. ..... 5/624
2006/0168729 A1* 8/2006 Weismiller et al. ..... 5/618
2006/0168730 A1* 8/2006 Menkedick et al. ..... 5/618
2006/0168731 A1* 8/2006 Menkedick et al. ..... 5/618
2007/0113352 A1* 5/2007 Poulos ..... 5/727
2007/0266499 A1* 11/2007 O'Keefe et al. ..... 5/713

FOREIGN PATENT DOCUMENTS

GB 189572 A 12/1922
JP 11 221134 A 8/1999
WO WO 2007/005845 2/1997
WO WO 2004/060257 A 7/2004

* cited by examiner

MATTRESS FOR A HOSPITAL BED

CROSS-REFERENCE TO RELATED APPLICATIONS

This application is a continuation-in-part of U.S. Provisional Patent application Ser. No. 60/609,390, filed on Sep. 13, 2004, which is expressly incorporated herein by reference.

FEDERALLY SPONSORED RESEARCH OR DEVELOPMENT

Not Applicable.

TECHNICAL FIELD

The present invention relates generally to a mattress for a hospital bed, and more specifically to an expandable mattress that extends beyond the deck section of the bed.

BACKGROUND OF THE INVENTION

Mattresses for hospital beds are well known in the art. While such mattresses according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a bed having a varying size patient support surface. In one embodiment, the patient support surface is a mattress comprising an encasing enclosing a compressible mattress portion and a rigid mattress portion.

According to one embodiment, the compressible mattress portion has an integral construction extending from a head end of the bed to a foot end of the bed, and the rigid mattress portion contracts from a first elongated position to a second retracted position. The rigid portion contracts the compressible mattress portion therewith.

According to another embodiment, the rigid mattress portion is positioned adjacent one or more sections of the mattress. For example, the rigid mattress portion may be positioned adjacent a foot end of the patient support to decrease the length of the patient support in the retracted position, the rigid mattress portion may be positioned in a portion of the mattress at a head section of a deck for the bed to decrease the length of the compressible mattress portion at the head section of the deck, and/or the rigid mattress portion may be positioned adjacent a side of the patient support to change the width of at least one side of the patient support.

According to another embodiment, an actuator is provided to assist in manipulating the rigid mattress portion between the extended position and the retracted position. In one embodiment the actuator is powered.

According to another embodiment, a portion of the compressible mattress portion is positioned above the rigid mattress portion. The compressible mattress portion is connected to the rigid mattress portion adjacent an end of the rigid mattress portion, but there is an absence of a connection between the rigid mattress portion and the compressible mattress portion adjacent an opposing end of the rigid mattress portion. The compressible mattress portion may be comprised of a foam material, and in another embodiment the compressible mattress portion is non-inflatable.

According to another embodiment, the rigid mattress portion comprises a plurality of hollow structures slidingly connected to adjacent hollow structures. According to one embodiment, the rigid mattress portion has a first rigid member fixed in position with respect to the deck, and a second rigid member having operable sliding engagement with the first rigid member, the second rigid member being fixed to the compressible mattress portion. Additionally, a third rigid member slidingly connected to the first rigid member and the second rigid member, and between the first ands second rigid members. The first and third rigid members do not have direct connection with the compressible mattress portion.

According to another embodiment, a patient support for a bed is provided. The patient support comprises a deck supported on a frame, and a mattress supported on the deck. The deck has a head end and a foot end. The deck further has a first deck section, a second deck section and a third deck section. The first deck section is located adjacent the head end, the third deck section is located adjacent the foot end, and the second deck section is located between the first deck section and the third deck section. The first deck section is moveable from a generally horizontal position to a more vertical back-support position, and the second deck section is pivotable upwards. A portion of the mattress extends a distance beyond an edge of the foot deck by a length, $L_1$, when the mattress is in a first position, such that the mattress is cantilevered and overhangs the foot end of the deck.

According to another embodiment, the mattress retracts to a second position. In the second position a portion of the mattress extends a distance beyond the edge of the foot deck by a length $L_2$, wherein $L_2$ is less than $L_1$.

According to another embodiment, the mattress extends a distance beyond at least one of the head end, first side and second side of the deck such that the mattress is cantilevered from the deck and overhangs the deck thereat a length, $L_1$, when the mattress is in a first position. In one embodiment, a portion of the mattress extends a distance beyond an edge of the side of the deck by a length, $L_1$, when the mattress is in a first position, such that the mattress is cantilevered and overhangs the side of the deck.

According to another embodiment, the mattress comprises a non-actuated extendable and retractable portion that contracts from a first elongated position to a second contracted position. The non-actuated extendable and retractable portion is non-inflatable.

According to yet another embodiment, the encasing has a first pocket for retaining at least a portion of the compressible mattress portion, and an adjacent second pocket for retaining at least a portion of the rigid mattress portion.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
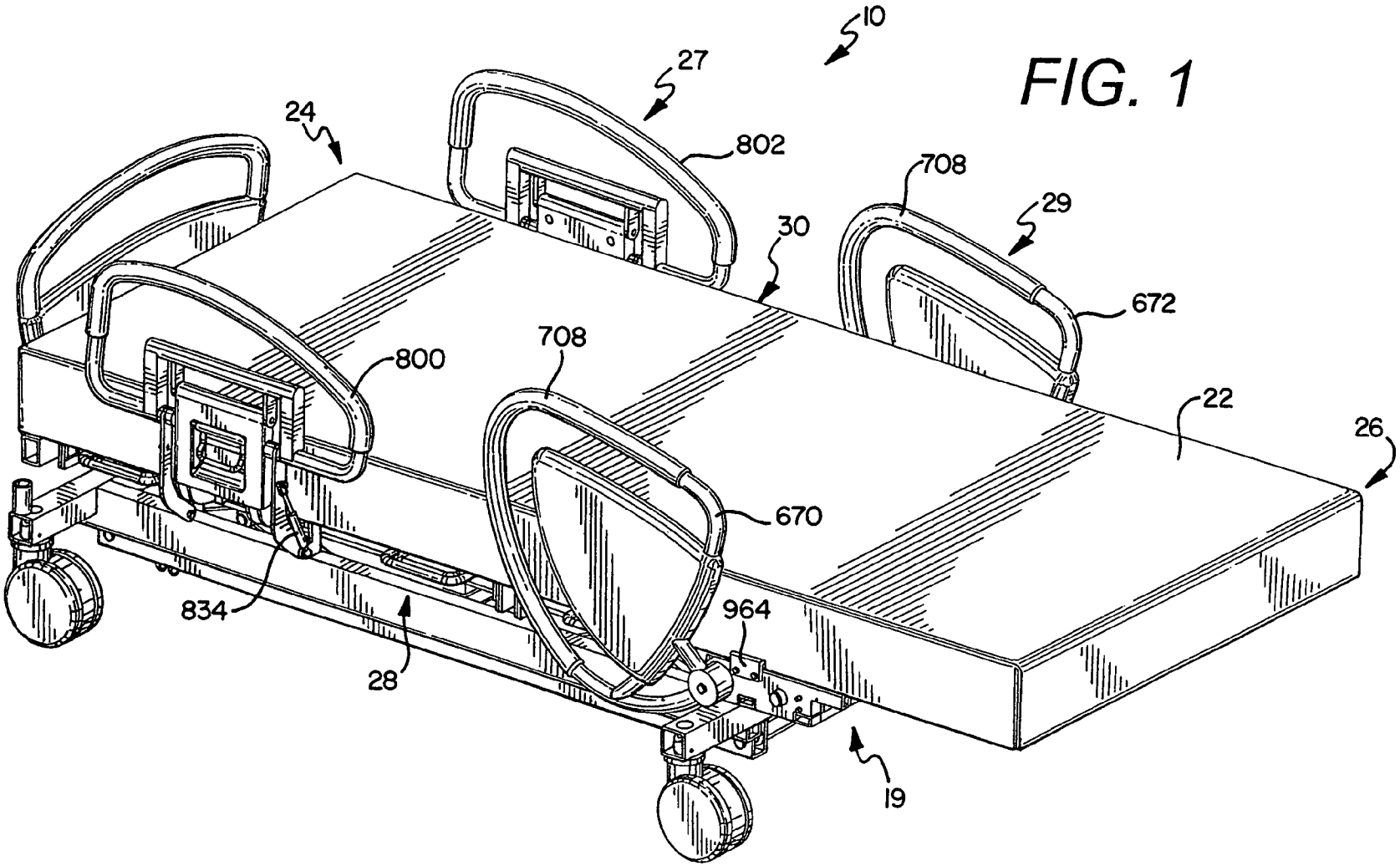
FIG. 1 is a perspective view of one embodiment of a hospital bed in a lower horizontal position and with side rails in the raised position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 38:
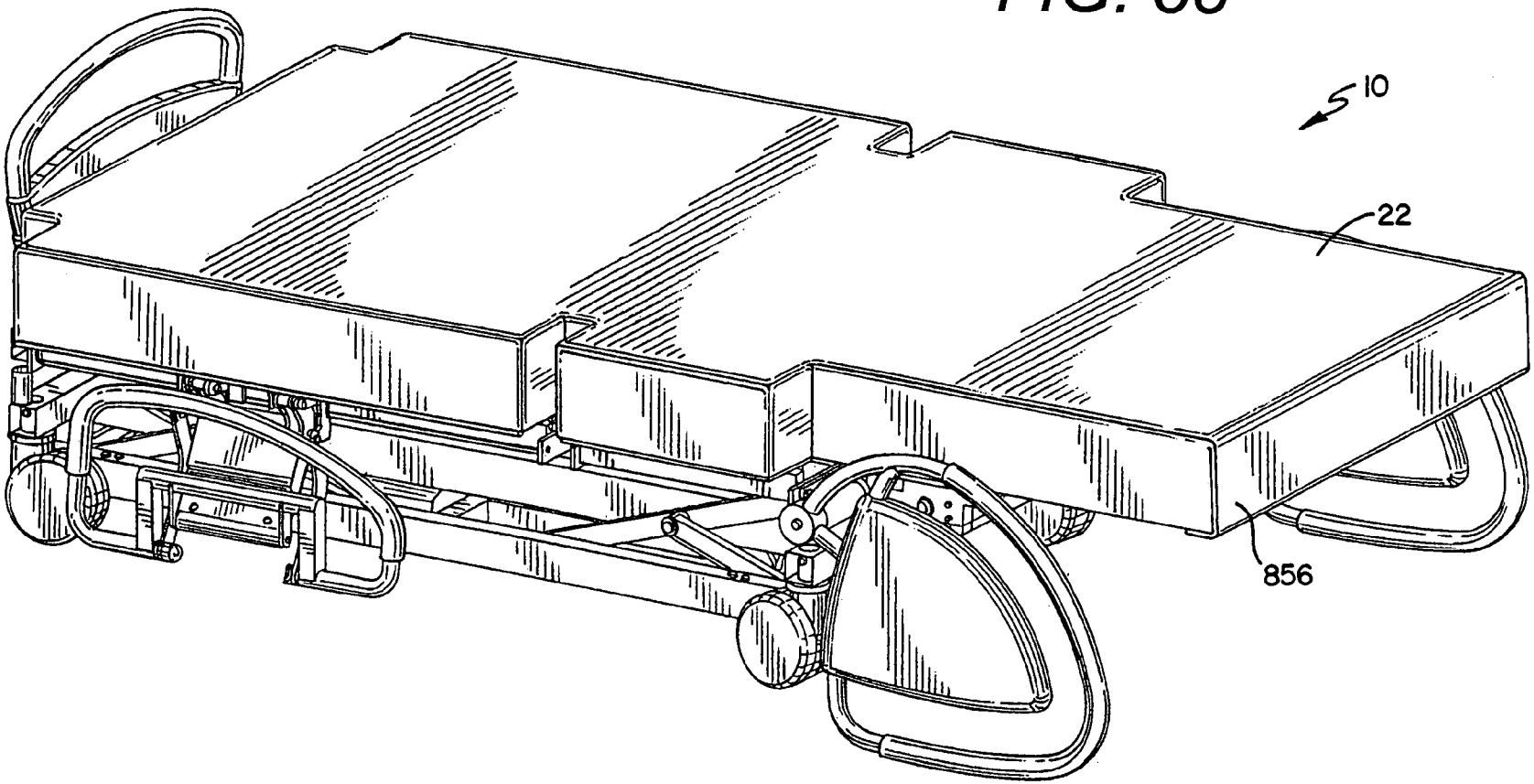
FIG. 38 is a perspective view of a hospital bed having an alternative expandable mattress.

Referring now to the Figures, there are shown various embodiments of a hospital bed 10. The term "bed" herein is used to denote any embodiment of a support for a patient As such, in different embodiments the "bed" is provided as a chair bed 10 as shown for example in FIG. 34, and an expandable width bed 10 as shown for example in FIGS. 2, 34 and 38, a stretcher or gurney (not shown), etc. In the chair bed configuration the bed is manipulated to achieve both a conventional bed position having a substantially horizontal patient support or sleeping surface upon which a user lies in a supine position, and a sitting position wherein the user's feet are on or adjacent the floor and the back of the user is supported by a raised back support. In the expanding width bed configuration the bed is manipulated to convert to a wider patient support surface at various portions of the bed. The width of the expanding width bed 10 may be narrowed, however, to that of a conventional hospital bed to provide for ease of mobility of the bed 10. Additionally, in one embodiment the bed 10 is a bariatric bed, meaning it is provided to support morbidly obese patients.

The bed 10 generally comprises a base assembly 16, an intermediate frame assembly 18, and a patient support assembly 19. The patient support assembly 19 preferably comprises a support deck assembly 20 and a mattress 22, however, either component may be identified as the patient support. The patient support assembly 19 may also include a patient support extension assembly, also referred to as a deck extension assembly. The mattress 22 may be a foam mattress, inflatable mattress, fluidized mattress, percussion mattress, rotation mattress or any other type of mattress known in the art. In a preferred embodiment the bed 10 will be capable of transitioning to a chair orientation and to an expanded width orientation. The bed 10 has a head end 24, a foot end 26 opposing the head end 24, a first side 28 and a second side 30 opposing the first side 26. The term "head end" is used to denote the end of any referred to object that is positioned to lie nearest the head end 24 of the bed 10, and the term "foot end" is used to denote the end of any referred to object that is positioned to lie nearest the foot end 26 of the bed 10.

Figure 2:
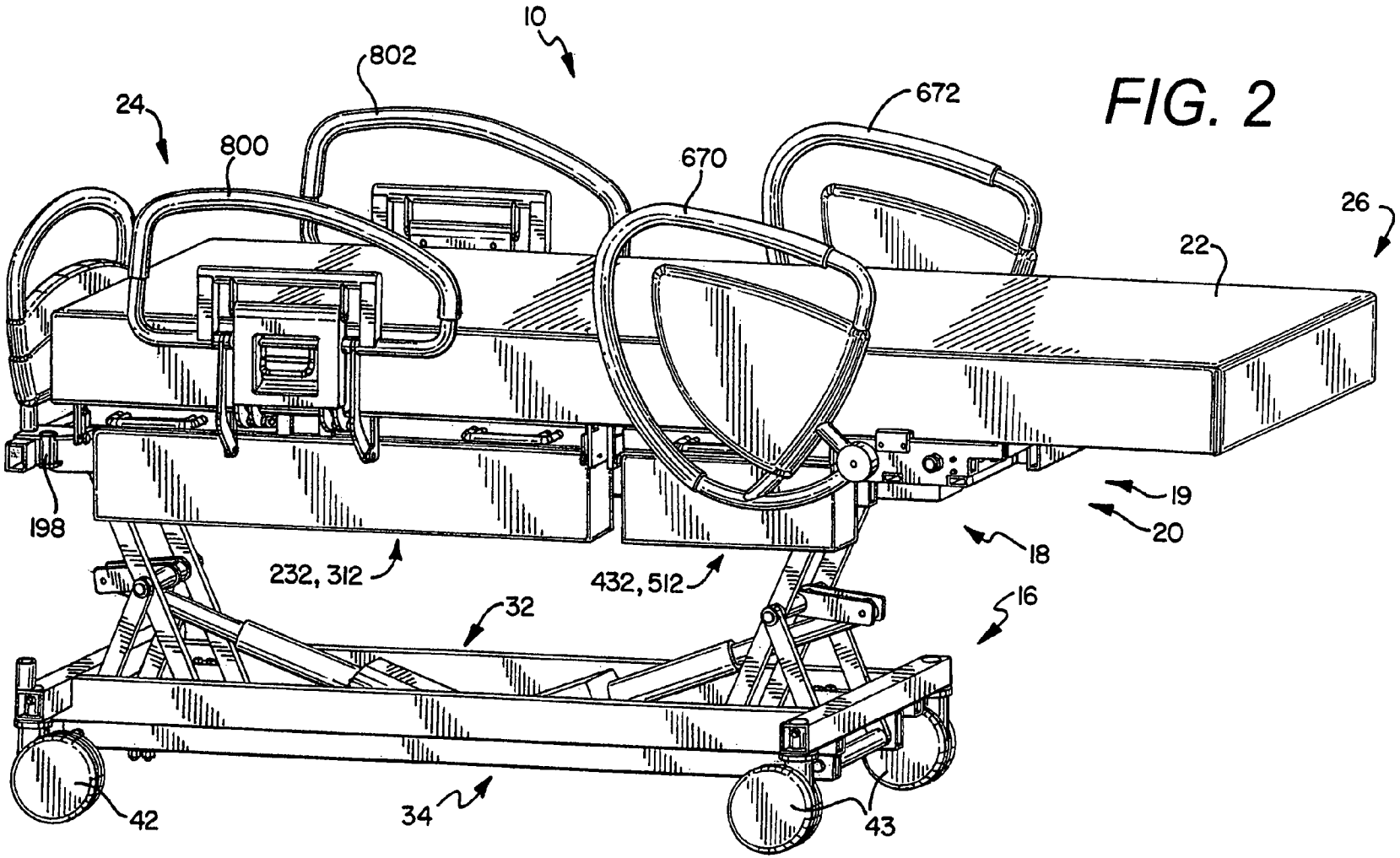
FIG. 2 is a perspective view of the hospital bed having side extenders and configured in a raised horizontal position with the side rails in the raised position.
Figure 3:
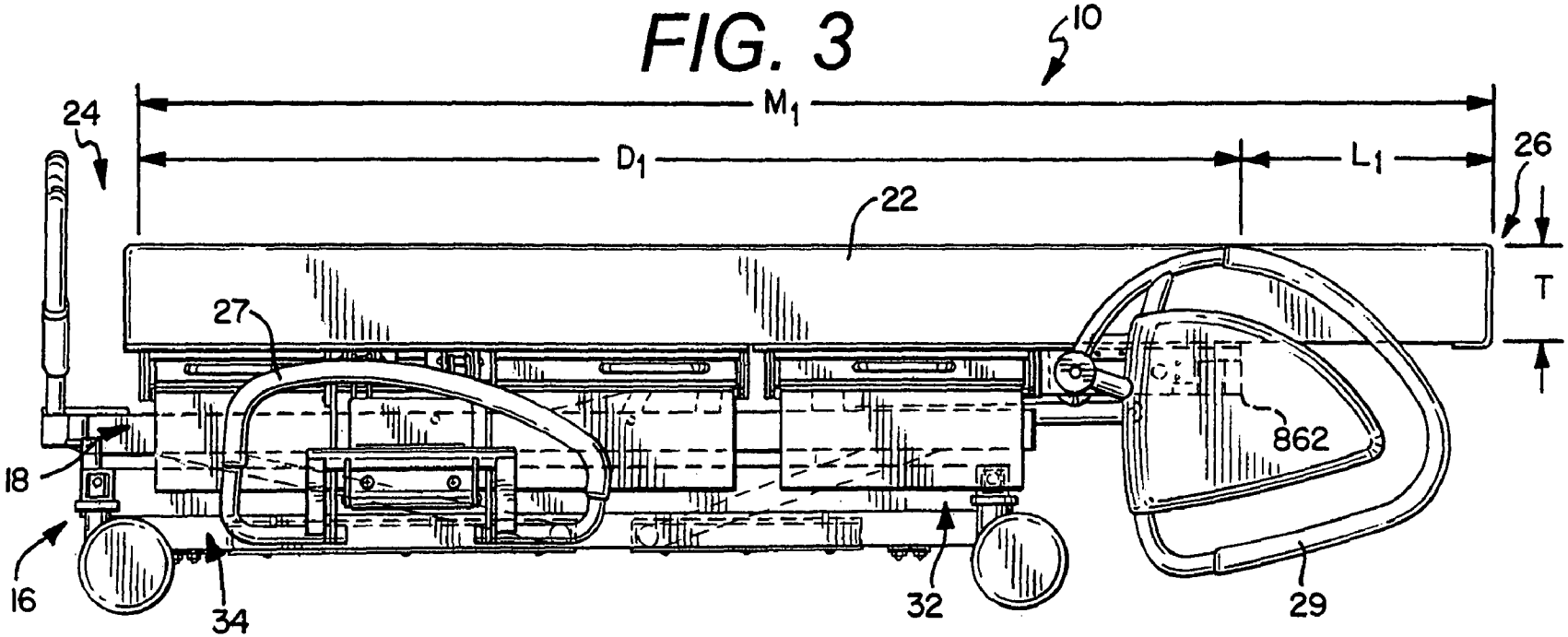
FIG. 3 is a side view of one embodiment of a hospital bed in a lower horizontal position, with the side rails are in the lowered position.
Figure 42:
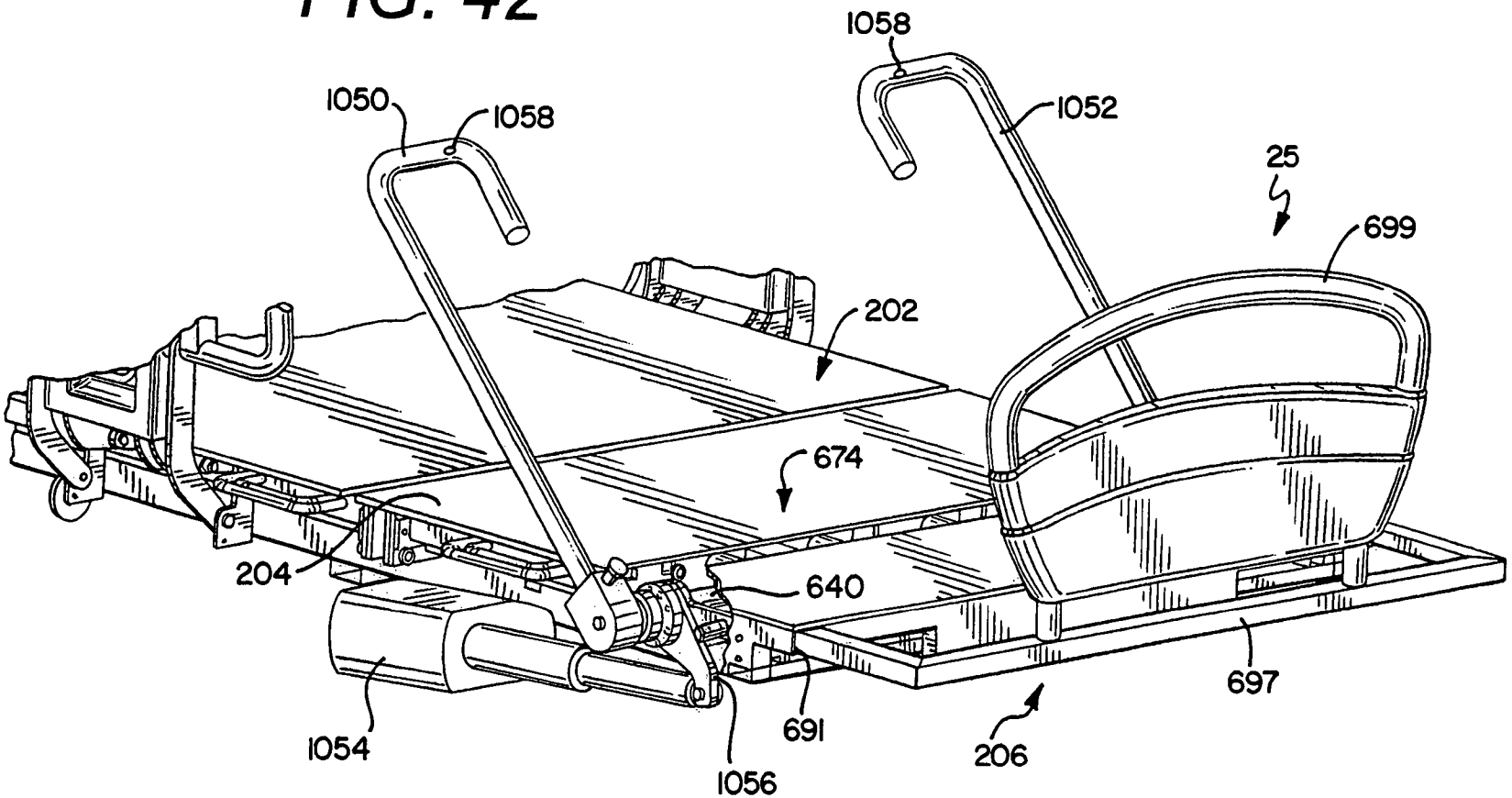
FIG. 42 is a perspective view of support assembly for an another embodiment of a bed having an actuated handle assembly.

The bed 10 also has a headboard 23 and a footboard 25. The headboard 23, as shown in FIGS. 1-3 is generally connected to the intermediate frame 180 of the intermediate frame assembly 18. The headboard 23 is generally provided at the very head end 24 of the bed 10. The footboard 25, as shown in FIG. 42, is generally connected to the support deck assembly 20, and preferably the foot deck section 206 of the support deck assembly 20. The footboard 25 is generally provided at the very foot end 26 of the bed 10. Both the headboard 23 and the footboard 25 are removable from the bed 10.

Figure 3A:
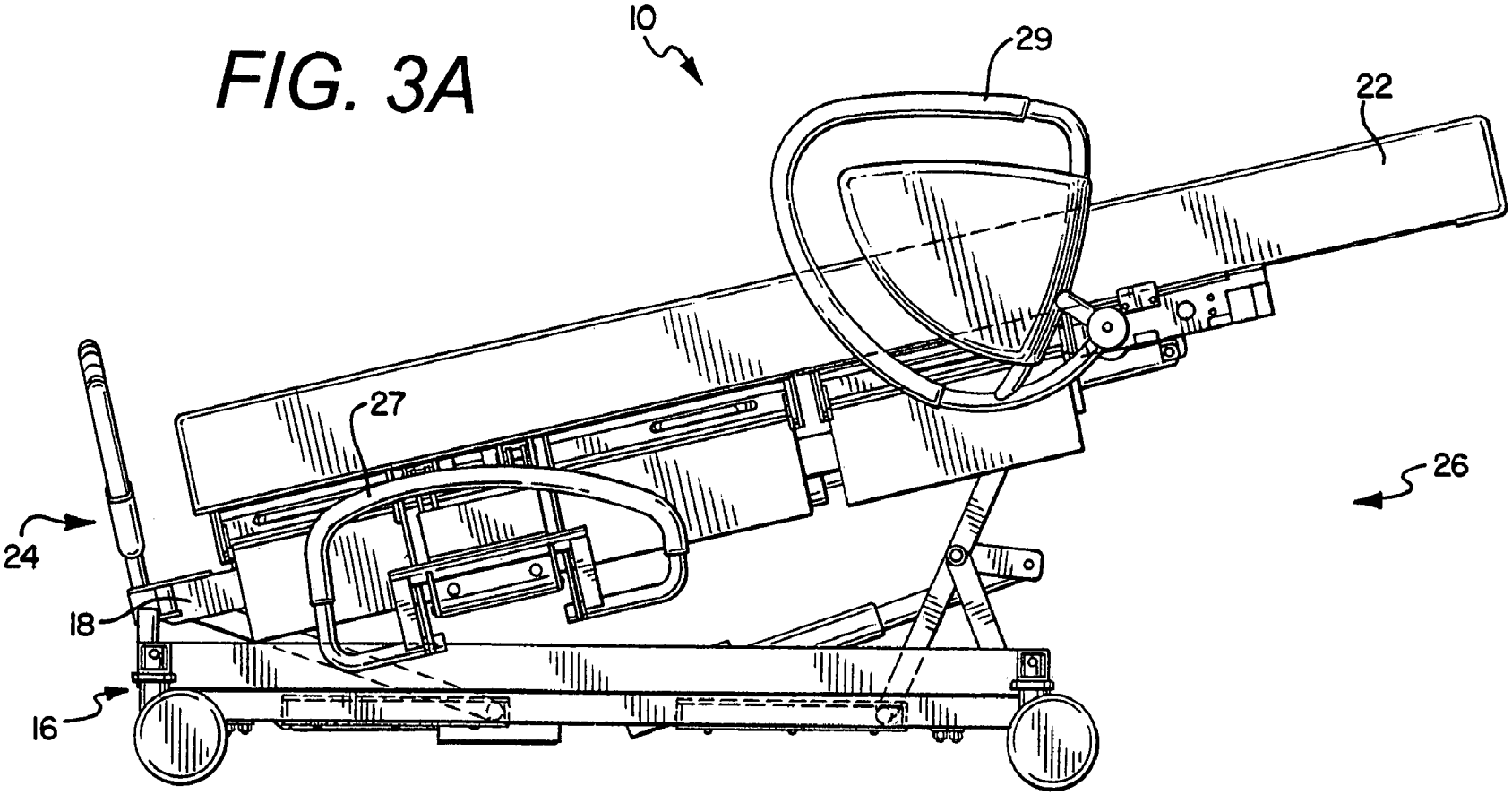
FIG. 3A is a side view of the hospital bed of FIG. 3 in the Trendelenburg orientation.
Figure 3B:
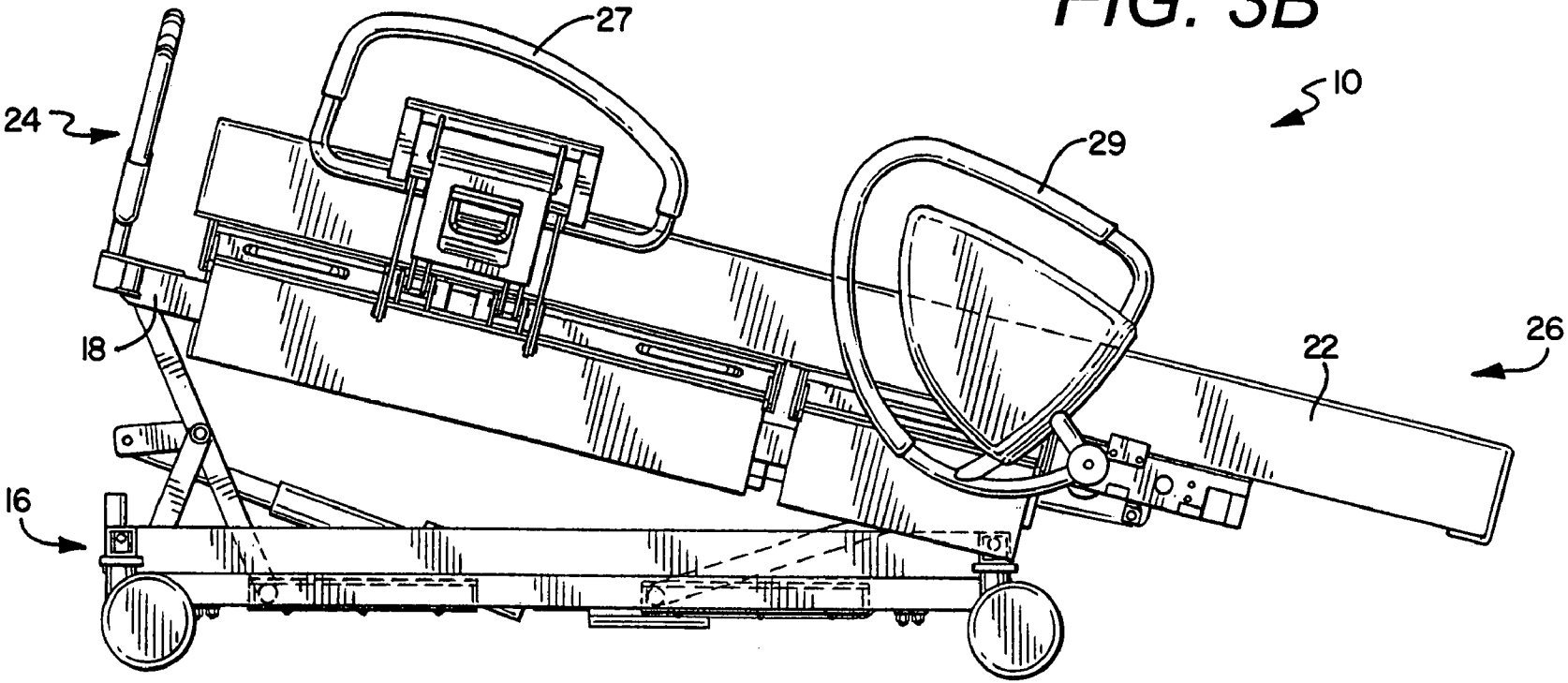
FIG. 3B is a side view of the hospital bed of FIG. 3 in the reverse Trendelenburg orientation.
Figure 34:
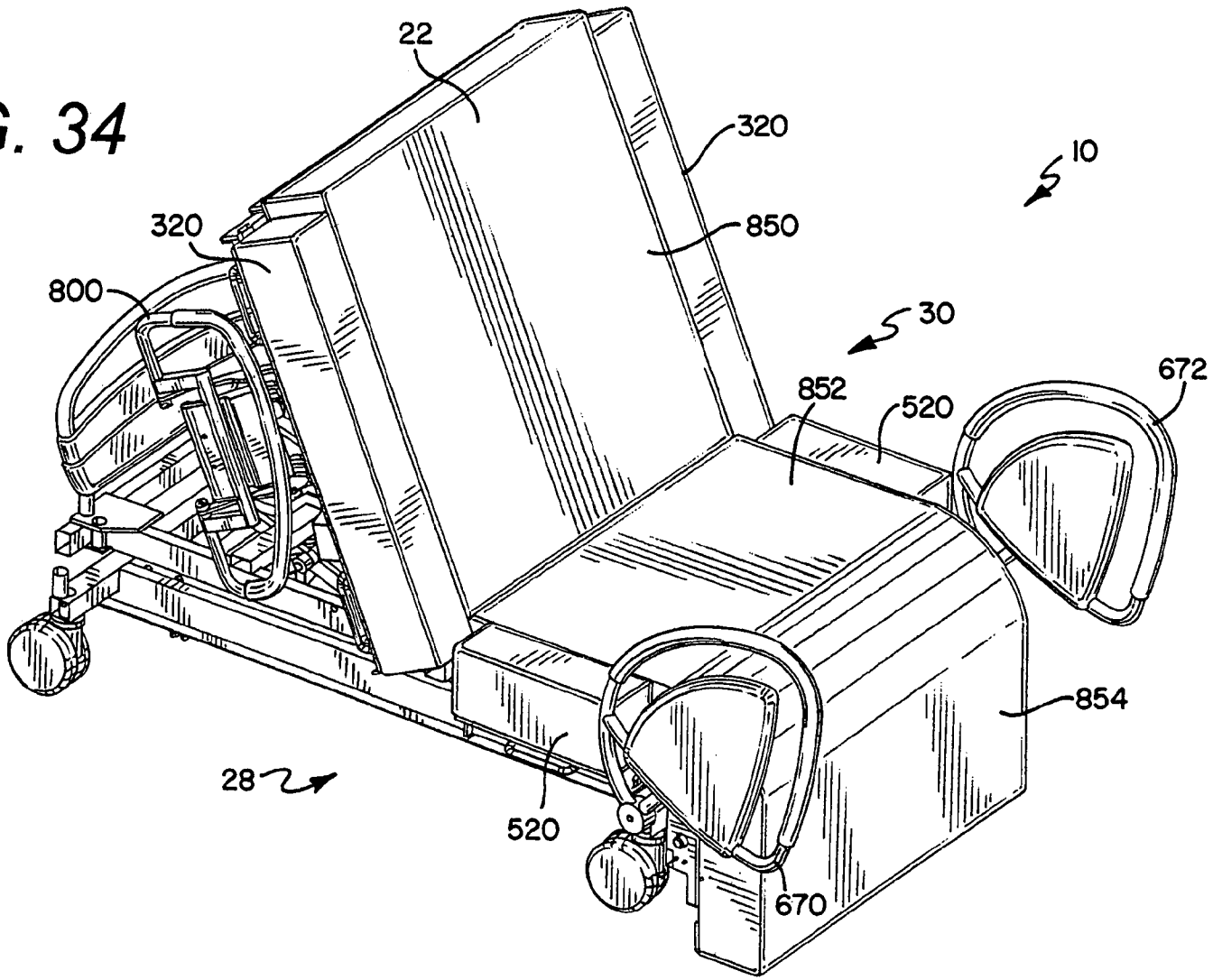
FIG. 34 is a perspective view of one embodiment of a chair bed having width expanders in the extended position.
Figure 35:
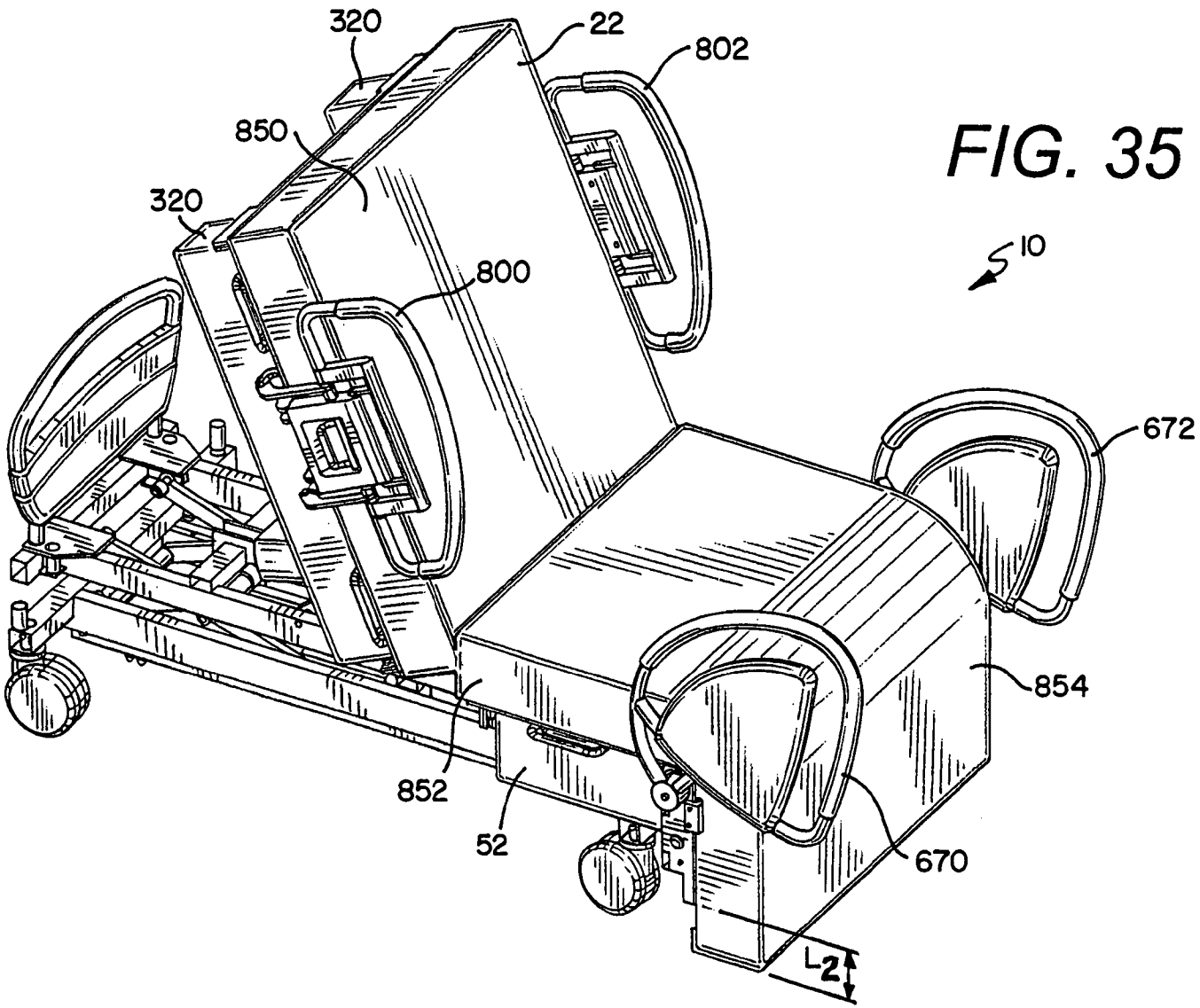
FIG. 35 is a perspective view of the chair bed of FIG. 34 with the width expanders in the stowed or retracted position.
Figure 36:
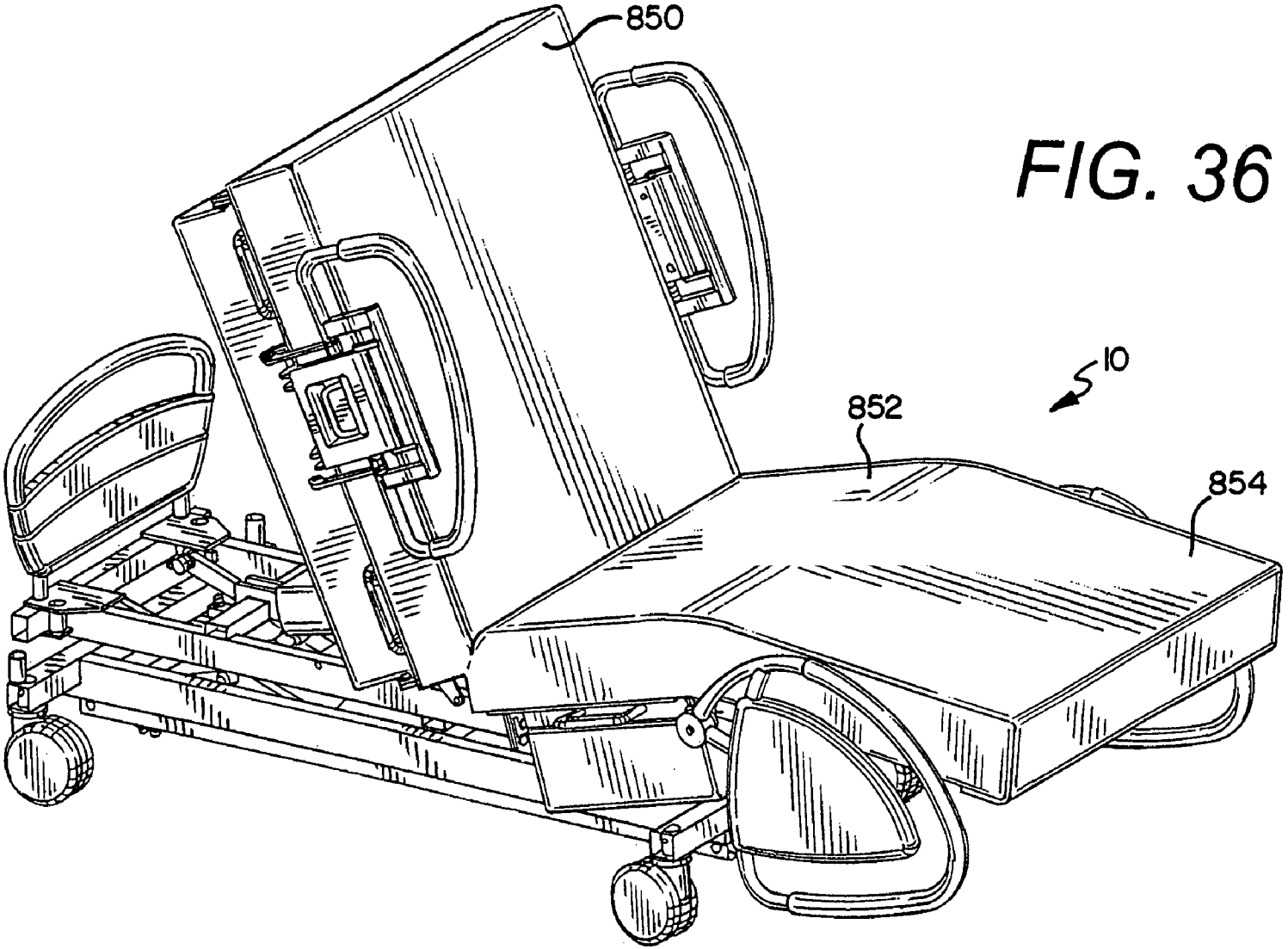
FIG. 36 is a perspective view of an expandable width hospital bed in a knee-gatch position.

The bed 10 can assume a plurality of positions/orientations via manipulation of the intermediate frame assembly 18 and the various deck sections (head deck section 202, seat deck section 204 and foot deck section 206) of the support deck assembly 20. Further, as detailed herein, in different embodiments the mattress 22 can also attain a variety of positions/orientations. For example, the bed 10 can assume a standard bed position such that the support deck assembly 20 is in the horizontal position as shown in FIGS. 1 and 3, the bed 10 can assume a chair orientation such as shown in FIG. 35, the bed 10 can assume a knee-gatch position such as shown in FIG. 36, and the bed 10 can assume a variety of positions therebetween. Additionally, the intermediate frame assembly 18 can be independently raised and lowered at the head end 24 and foot end 26 of the bed. As such, when the foot end 26 of the intermediate frame assembly 18 is raised and the head end 24 is maintained in a lowered position the bed 10 can assume the Trendelenburg position as shown in FIG. 3A, and conversely when the head end 24 of the intermediate frame assembly 18 is raised and the foot end 26 is maintained in a lowered position the bed 10 can assume the reverse Trendelenburg position as shown in FIG. 3B. Further, the entire intermediate frame assembly 18 can be raised simultaneously as shown in FIG. 2 to assume a raised bed orientation, and the entire intermediate frame assembly 18 can be lowered simultaneously to assume a lowered bed orientation as shown in FIG. 3, and a lowered chair bed orientation as shown in FIGS. 34-35. In a preferred positioning, when the bed 10 is placed in the chair orientation the intermediate frame assembly 18 is in the lowermost position, thereby allowing the patient to easily exit the foot end 26 of the chair bed 12. In the lowermost chair bed position the deck plate of the seat deck section 204 is less than 20" from the floor, is preferably approximately 17.5" from the floor, and is most preferably approximately 17" from the floor. This can be accomplished in the present invention because the foot deck section 206 has a fixed short length, and because the mattress 22 retracts. Accordingly, the seat of the present chair bed is closer to the floor than many prior art chair beds, making it easier for the patient to exit out of the chair bed from the foot end 26 of the chair bed 10. In one embodiment, the length of the foot deck section 206 is fixed at approximately 12", and the retractable mattress extends approximately 15" over the foot end 26 of the foot deck section 206 in the horizontal position prior to retracting.

The bed also has a plurality of siderail assemblies. The siderail assemblies generally provide a barrier that is moveable from a first position to a second position. In the first position the siderails assist in generally precluding a patient on the bed from rolling or falling off the bed, or exiting from the side thereof (see FIG. 1). The siderails are moveable to the second position, however, to provide unfettered access to the patient on the bed for a caregiver or other individual to perform any procedures on the patient (see FIG. 3). In one embodiment two siderail assemblies are provided, a first pair of siderail assemblies 27 provided toward the head end 24 of the bed, and a second pair of siderail assemblies 29 provided toward the foot end 26 of the bed. Pairs of siderails are provided to impart barriers at both the first side 28 and second side 30 of the bed.

Figure 4:
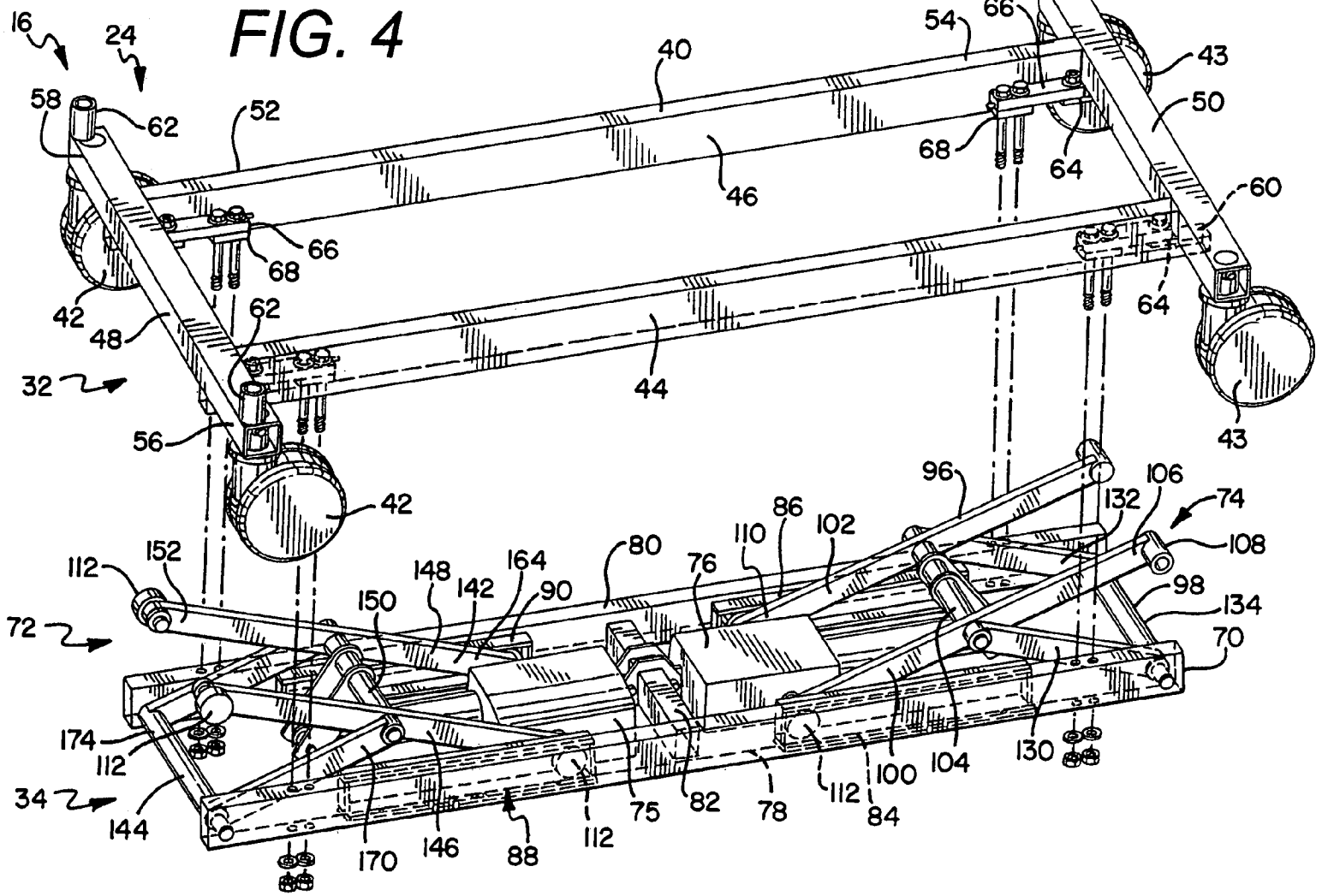
FIG. 4 is an exploded perspective view of one embodiment of a base frame assembly for a hospital bed.
Figure 5:
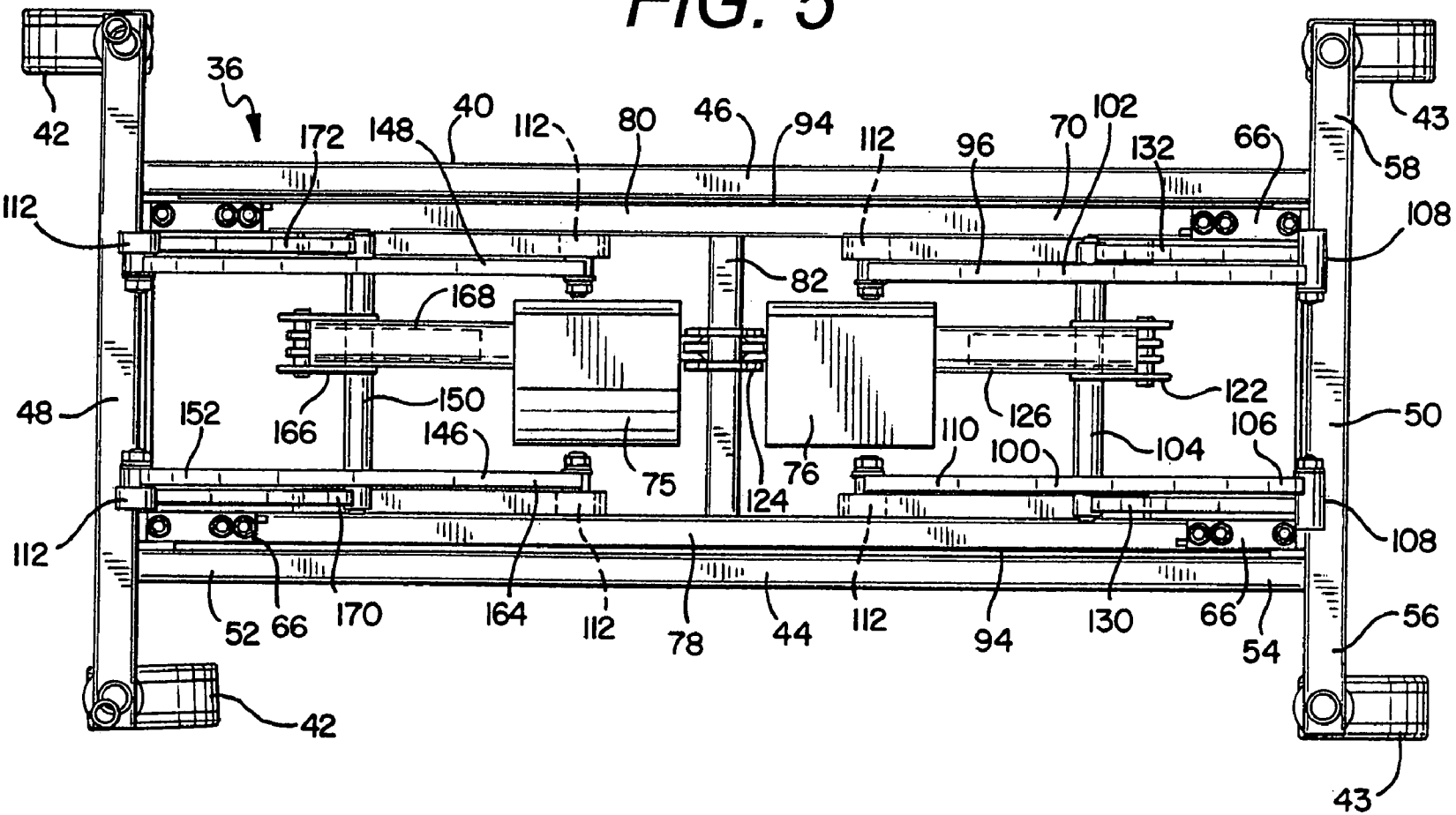
FIG. 5 is a top view of the base frame assembly of FIG. 4.

The base assembly 16 of the bed 10 includes a base frame assembly 32, a weigh frame assembly 34, and a load cell assembly 36. The weigh frame assembly 34 is coupled to the base frame assembly 32 with a plurality of load beams 66. The base frame assembly 32 generally comprises a base frame 40 and a plurality of casters 42, 43. The casters include a pair of casters 42 at the head end of the base frame assembly 32, and a pair of casters 43 at the foot end of the base frame assembly 32. As best shown in FIGS. 4 and 5, in one embodiment the base frame 40 is a metal weldment component having first and second opposing side frame members 44, 46 and first and second opposing cross members 48, 50. In the embodiment illustrated, the side frame members 44, 46 are made of rectangular tubing, and the cross members 48, 50 are made of square tubing, however, one of ordinary skill in the art would readily understand that any size or shape tubing, bar stock, round stock, bent flat stock, etc. is acceptable and would perform adequately without departing from the scope and spirit of the present invention.

Each of the side frame members 44, 46 has first end 52 and a second end 54, and each of the cross members 48, 50 has a first end 56 and a second end 58. The first end 52 of the side frame members 44, 46 is generally adjacent the head end 24 of the bed 10, and the second end 54 of the side frame members 44, 46 is generally situated more toward the foot end 26 of the bed. Further, the first and second ends 52, 54 of each of the first and second side frame members 44, 46 have a notch 60 cut-away (shown in phantom at the second end 54 of the first side frame member 44) therefrom. The notch 60 is utilized to provide a location for engaging the cross members 48, 50.

Specifically, in the embodiment illustrated in FIG. 4, the first end 52 of the first side frame member 44 is connected to the first cross member 48 generally a distance from the first end 56 thereof, the first end 52 of the second side frame member 46 is connected to the first cross member 48 generally a distance from the second end 58 thereof, the second end 54 of the first side frame member 44 is connected to the second cross member 50 generally a distance from the first end 56 thereof, and the second end 54 of the second side frame member 46 is connected to the second cross member 50 generally a distance from the second end 58 thereof.

The cross members 48, 50 of the base frame 40 also have openings therein to connect the casters 42 to the base frame assembly 32. Preferably, the casters 42 are connected to the cross members 48, 50 adjacent the ends thereof 56, 58, to adequately support the bed 10. In one embodiment, the casters 42 have a diameter of approximately 6" to provide for a smooth transport and the ability to traverse small objects on the floor. The casters 42, 43 may have brake/steer mechanisms which provide for transitioning the casters 42, 43 between a braking position such that the casters 42, 43 do not rotate, a neutral position that allows the casters 42, 43 to rotate freely, and a steering position wherein the casters 43 at the foot end 26 of the bed 10 are locked in position and the casters 42 at the head end 24 of the bed 10 are free to swivel for steering purposes. Further, the cross members 48, 50 of the base frame 40 have post holders 62 to retain IV-posts or other medical device posts (not shown).

Figure 10:
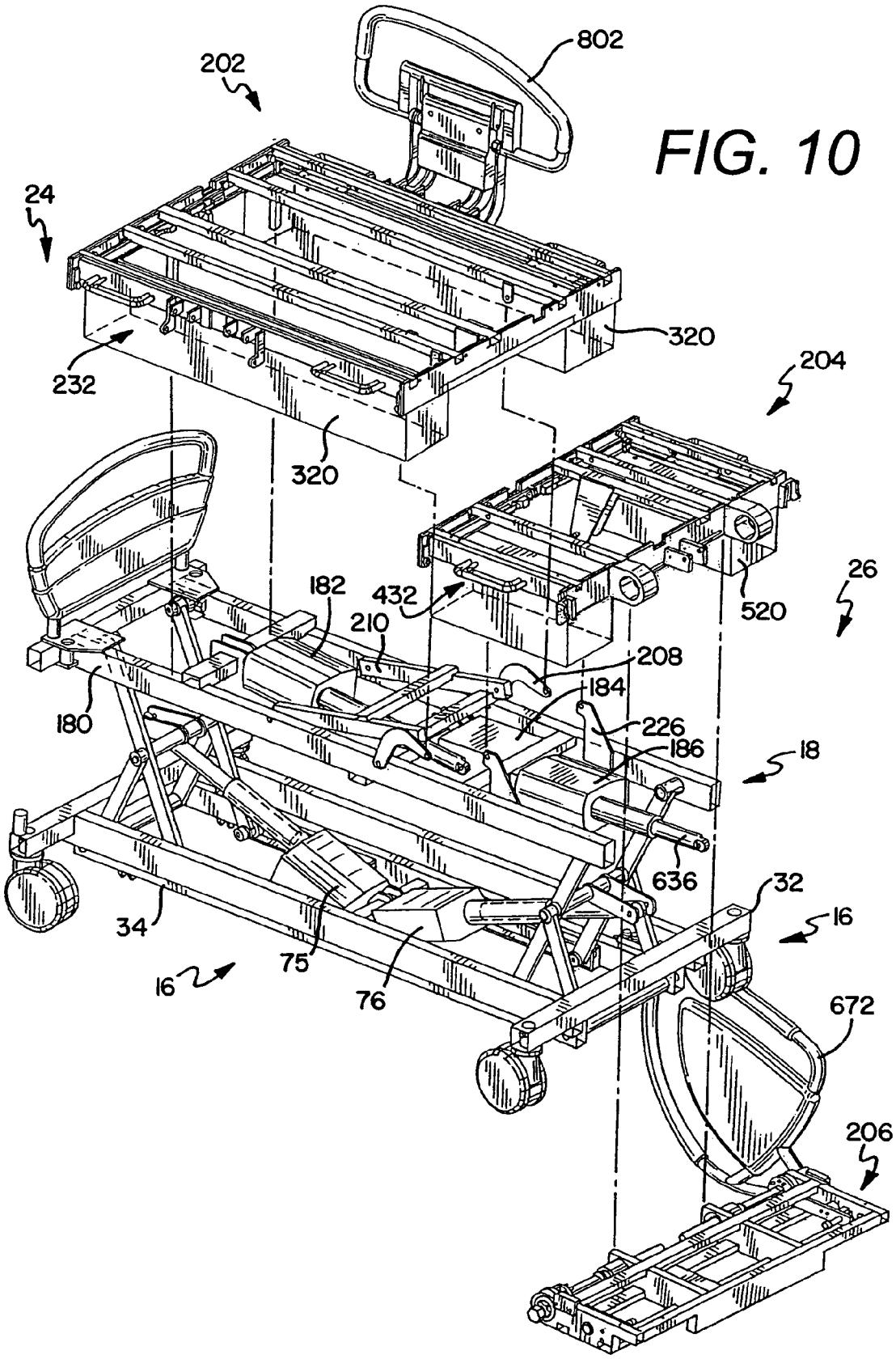
FIG. 10 is an exploded perspective view of various deck sections for a hospital bed.

As best shown in FIGS. 3 and 10, the base assembly 16, including the base frame assembly 32 and the weigh frame assembly 34, and intermediate frame assembly 18 extend from the head end 24 of the bed 10 toward the foot end 26 of the bed 10. In one embodiment, these frame assemblies generally do not extend fully to the foot end 26 of the bed 10. Conversely, as is explained in detail herein, these assemblies 16, 18 generally end at approximately the joint between the seat deck section 204 and the foot deck section 206 of the patient support deck 20. However, the foot deck section 206 does extend beyond the foot end 26 of the base frame assembly 32, weigh frame assembly 34 and intermediate frame assembly 18, but the foot deck section 206 still does not extend fully to the foot end 26 of the bed 10. Instead, when the patient support assembly 19 of bed 10 is in the horizontal position (i.e., the standard bed position), the mattress 22 generally extends fully from the head end 24 to the foot end 26 of the bed 10, and as such the mattress 22 extends a distance beyond an edge of the foot end 26 of the foot deck section 206 such that the mattress 22 is cantilevered from and overhangs the foot end 26 of the support deck assembly 20. Because the base assembly 16 does not extend to the endmost foot end 26 of the bed 10, the foot end casters 43 are spaced apart from the foot end 26 of the bed 10, at least when the bed 10 is in the horizontal position. The inward positioning of the foot end casters 43 closer to the center of gravity of the bed 10 also attempts to maximize the maneuverability of the bed 10 in the steering condition.

Figure 6:
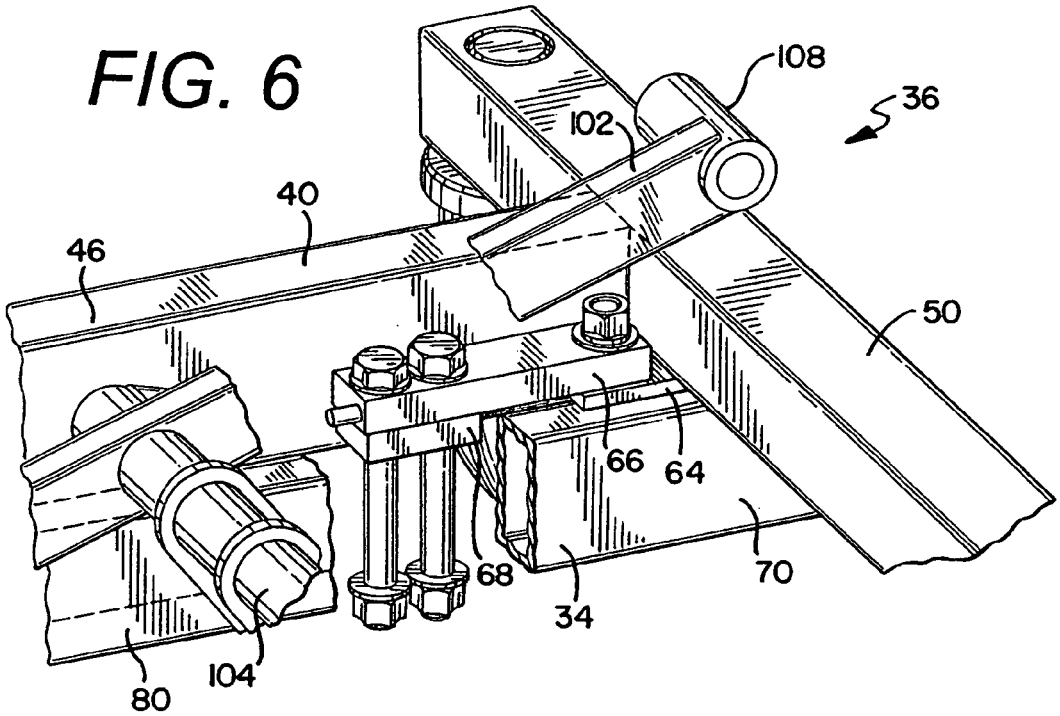
FIG. 6 is a enlarged broken-away partial perspective view of a load cell mounting for a hospital bed.

Separate load cell plates 64 extend from the base frame 40 at generally the four interior corners of the base frame 40. Each load cell plate 64 supports a load cell assembly 36, which in turn supports the weigh frame assembly 34. In a preferred embodiment, the weigh frame assembly 34, the intermediate frame assembly 18, the support deck assembly 20 and the mattress 22 are all supported from the load cell assembly 36. Further, in a most preferred embodiment, as shown in FIGS. 5 and 6, the weigh frame assembly 34, the intermediate frame assembly 18, the support deck assembly 20 and the mattress 22 are all cantilevered from the base frame assembly 32, and more particularly are cantilevered from the load cell assembly 36. The load cell assemblies 36 include load cells 66 that movably couple the weigh frame assembly 34 to the base assembly 16. Each load cell 66 includes a fixed portion and a sensing portion that is movable relative to the fixed portion. Each load cell 66 also comprises a transducer (not shown) connected to the sensing portion that provides an electrical signal in response to movement of the sensing portion relative to the fixed portion. The extent of the movement of the sensing portion depends upon the amount of weight supported by the load cells 66, and accordingly the electrical signal provided by the load cells 66 varies in response to the weight supported by the weigh frame assembly 34.

As best shown in FIGS. 4-6, in one embodiment first and second load cell plates 64 extend from the bottom of the first cross member 48 interior of and adjacent the first and second side frame members 44, 46, respectively, and third and fourth load cell plates 64 extend from the bottom of the second cross member 50 interior of and adjacent the first and second side frame members 44, 46, respectively. Separate load cell assemblies 36 are connected to each of the load cell plates 64. As shown in FIG. 6, in one embodiment a separate load cell 66 is connected in a cantilevered manner to each of the load cell plates 64. Preferably, the load cell 66 is fixed to the load cell plate 64 with a bolt. Subsequently, the weigh frame assembly 34 is connected and/or supported in a cantilevered manner to a lower portion of an opposing end of the load cell 66. Additionally, a spacer 68 is provided between the load cell 66 and the weigh frame assembly 34 to properly space the weigh frame assembly 34 relative to the base frame 40. As shown in FIGS. 4 and 5, a pair of bolts are utilized at each load cell 66 to secure each respective load cell 66 to the weigh frame assembly 34. The bolts generally pass through the load cells 66, through the spacer 68 and through the side frame members 78, 80 of the weigh frame 70, and are secured with nuts at the bottom of the side frame members 78, 80. In an alternate embodiment, the load cell assemblies 36 may be orientated 180° as illustrated in the figures without departing from the scope of the invention.

It is understood that the load cell assemblies 36 can be replaced by fixed members (not shown) that support the weigh frame assembly 34 on the base frame assembly 16, but that do not provide for any movement of the weigh frame assembly 34 relative to the base frame assembly 16, and which do not provide an electrical signals. When the bed 10 has a fixed member instead of the load cell assemblies 36, the weigh frame assembly 34 is fixed to the base frame assembly 16 and cooperates therewith to provide a common frame assembly (not shown). The common frame assembly is used with beds that do not include weigh scales, but that include other features of the various beds described herein.

Figure 7:
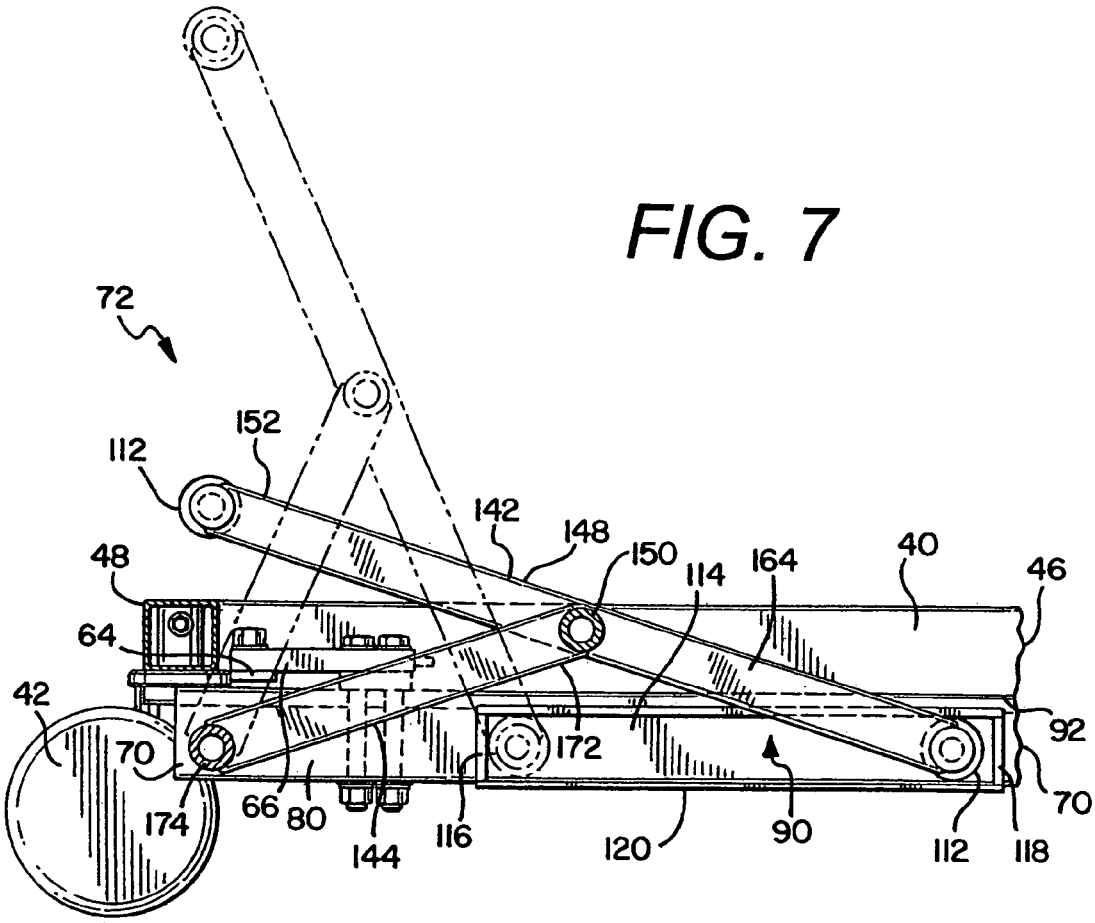
FIG. 7 is an enlarged broken-away partial side elevation view of the lifting assembly for a hospital bed.

The weigh frame assembly 34 is generally positioned between the first and second side frame members 44, 46 of the base frame assembly 32. As best shown in FIGS. 4 and 5, the weigh frame assembly 34 generally comprises a weigh frame 70, a head end raise/lower linkage assembly 72, a foot end raise/lower linkage assembly 74, a head end raise/lower actuator 75 and a foot end raise/lower actuator 76. In one embodiment the weigh frame 70 is a metal weldment component having first and second opposing side frames 78, 80, a cross member 82, and a plurality of cam follower supports 84, 86, 88, 90. In the embodiment illustrated, the side frames 78, 80 and the cross member 82 are made of rectangular tubing, however, one of ordinary skill in the art would readily understand that any size or shape tubing, bar stock, round stock, bent flat stock, etc. is acceptable and would perform adequately without departing from the scope and spirit of the present invention. Referring to FIGS. 5-7, the top surface 92 of the weigh frame is spaced a distance from the bottom of the load cell plates 64, and the outer surface 94 of the weigh frame 70 is spaced a distance from the inner surface of the side frame members 44, 46 of the base frame 40. Accordingly, the weigh frame 70 is free to move unencumbered by any constraints of adjacent frame members such that the weight of the patient on the bed may be freely and accurately measured.

In the embodiment illustrated in FIGS. 4-6, the head end raise/lower actuator 75 and the foot end raise/lower actuator 76 are actuated to manipulate the head end raise/lower linkage assembly 72 and foot end raise/lower linkage assembly 74, respectively, to simultaneously and/or independently raise and lower the head end 24 and foot end 26 of the bed 10. More particularly, the intermediate frame assembly 18 is raised and lowered, thereby raising and lowering the patient support assembly 19 made up of the support deck assembly 20 and the mattress 22. In a preferred embodiment, the actuators exert a pushing force on the appropriate linkage assembly to raise or lift the intermediate frame assembly, and correspondingly exert a pulling force on the appropriate linkage assembly to lower the intermediate frame assembly. One of ordinary skill in the art would readily understand, however, that the actuators may operate in a reverse manner to raise and lower the intermediate frame assembly without departing from the scope of the present invention. The actuators disclosed herein may be linear actuators, rotary actuators, fixed length linkage elements, flexible cable elements, and the like. Alternatively, electrical, hydraulic, pneumatic, spring or other power sources may be used to manipulate movement of the components of the bed.

Figure 8:
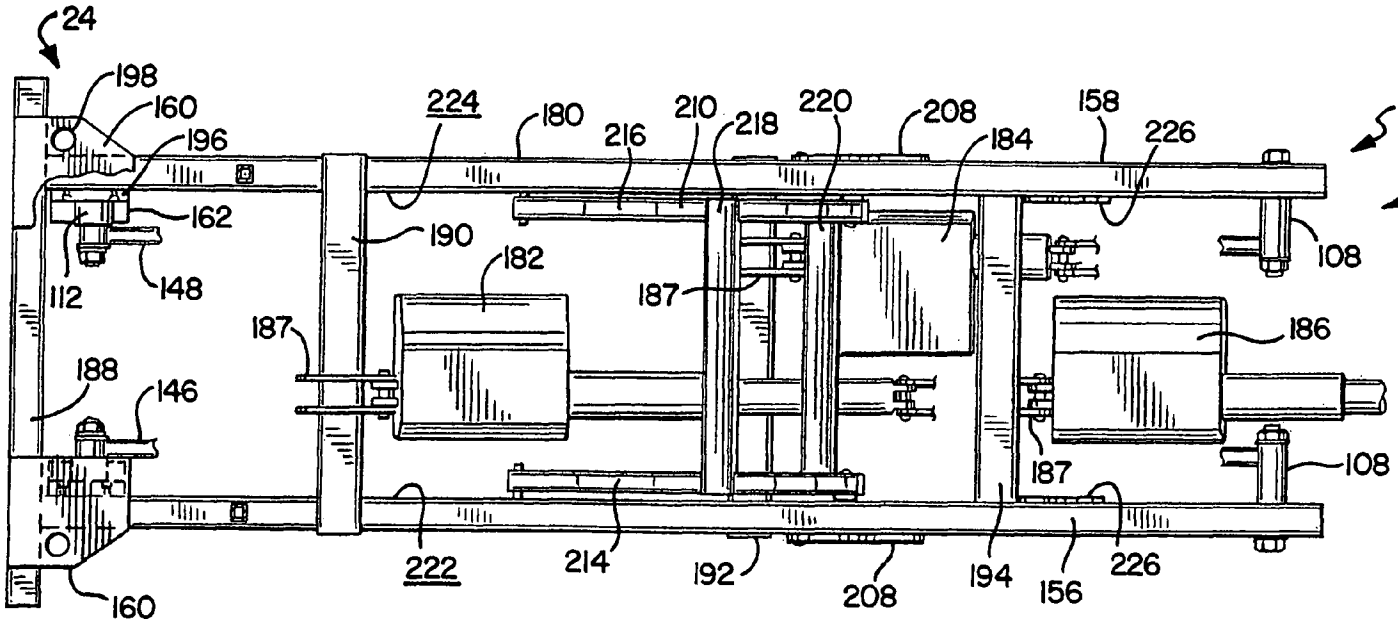
FIG. 8 is a top plan view of one embodiment of an intermediate frame assembly for a hospital bed.
Figure 9:
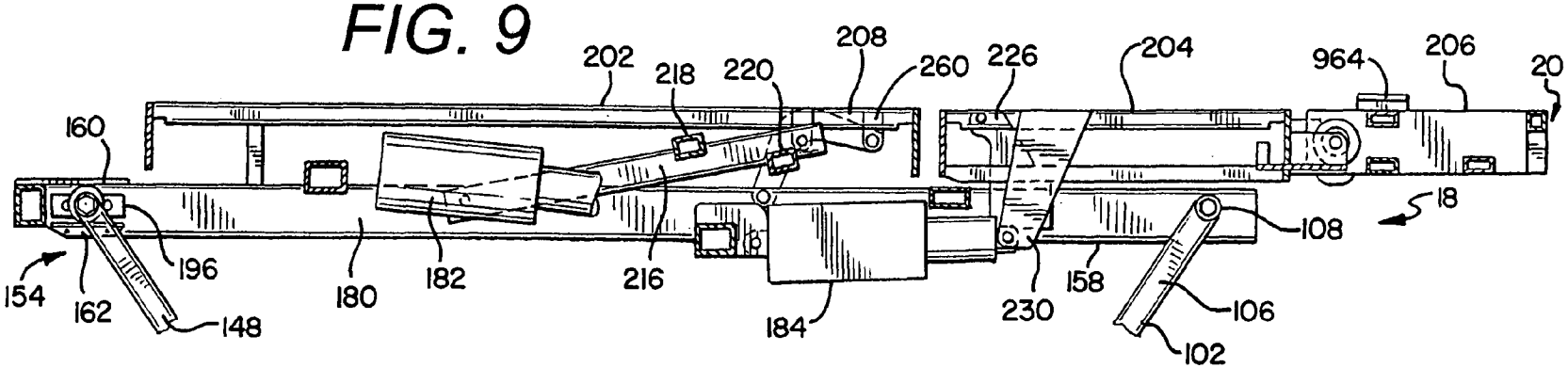
FIG. 9 is a cross-sectional view of the intermediate frame assembly of FIG. 8, including portions of a deck assembly for the hospital bed.

The foot end raise/lower actuator 76 is actuated to manipulate the foot end raise/lower linkage assembly 74 to raise and lower the foot end 26 of the bed 10. The foot end raise/lower linkage assembly 74 comprises a lift arm assembly 96 and a pivot assembly 98. The lift arm assembly 96 includes a metal weldment component having first and second lift arms 100, 102 connected by a strut 104. As shown in FIGS. 4, 8 and 9, the first end 106 of the first lift arm 100 has a tubular component 108 that is fixedly connected at a pivot point to the first side frame member 156 of the intermediate frame assembly 18 with a bolt that extends through the tubular component 108 and first side frame member 156 of the intermediate frame assembly 18 at the foot end 26 of the intermediate frame assembly 18. Similarly, the first end 106 of the second lift arm 102 has a tubular component 108 that is fixedly connected at a pivot point to the second side frame member 158 of the intermediate frame assembly 18 with a bolt that extends through the tubular component 108 and second side frame member 158 of the intermediate frame assembly 18 at the foot end 26 of the intermediate frame assembly 18. While the lift arms 100, 102 are fixed at specific points to the foot end 26 of the intermediate frame assembly 18, the lift arms 100, 102 are, however, able to pivot or rotate about the longitudinal axis of the tubular components 108 thereof.

Unlike the first ends 106 of the lift arms 100, 102, the opposing second ends 110 of lift arms 100, 102 have cam followers 112 connected thereto for moving in the foot end cam follower support assemblies 84, 86. As shown in FIGS. 4, 5 and 7, the cam follower 112 at the second end 110 of the first lift arm 100 traverses in the first cam follower support assembly 84 at the foot end 26 of the first side frame 78 of the weigh frame 70, and the cam follower 112 at the second end 110 of the second lift arm 102 traverses in the second cam follower support assembly 86 at the foot end 26 of the second side frame 80 of the weigh frame 70. Each of the cam follower support assemblies 84, 86 at the foot end 26 of the weigh frame 70 comprises a follower rail 114, a first end plate 116, a second end plate 118 and a bottom plate 120. The follower rail 114 and end plates 116, 118 are preferably welded to the respective side frames 78, 80, and the bottom plate 120 is bolted to the bottom of the respective side frame 78, 80 after the foot end raise/lower linkage 74 is assembled on the bed 10. As shown in FIG. 7 (referring to the head end raise/lower linkage assembly 72 but used for reference with respect to the foot end raise/lower linkage assembly 74), the cam followers 112 connected to the second end 110 of the lift arms 100, 102 engage the lower surface of the respective follower rails 114, and traverse back and forth along the lower surface of the follower rail 114. One of ordinary skill in the art would readily understand, however, that the function of the cam follower can be performed by many other standard components such as a simple rectangular block with a hole in the center of it for pivotally fixing it to the ends of the lift arms where cam followers are described above.

As shown in FIGS. 4 and 5, the strut 104 of the lift arm assembly 96 is welded in fixed connection between the first and second lift arms 100, 102 of the lift arm assembly 96 at the foot end raise/lower linkage 74. As explained in more detail below, the strut 104 operates as a moving pivot point for the foot end raise/lower linkage 74. Additionally, the strut 104 has a clevis linkage 122 extending therefrom. The clevis linkage 122 allows a piston 126 of the foot end raise/lower actuator 76 to connect to the foot end raise/lower linkage 74. The opposing end of the actuator 76 is connected to another clevis linkage 124 extending from the cross member 82 of the weigh frame 70. Accordingly, the foot end raise/lower actuator 76 is secured in place to the weigh frame 70 at the clevis linkage 124 extending from the cross member 82 of the weigh frame 70, and the piston 126 extending from the foot end raise/lower actuator 76 is connected to the clevis linkage 122 extending from the lift arm assembly 96.

The lift arm assembly 96 is also connected to the pivot assembly 98 in a pivoting or rotating connection. The pivot assembly 98 comprises a first pivot arm 130, a second pivot arm 132 and a strut 134 connecting one end of the first and second pivot arms 130, 132. Thus, in one embodiment the shape of the pivot assembly 98 is generally "U" shaped. The pivot assembly 98 is connected to the weigh frame 70 at the strut 134 thereof. Specifically, the strut 134 is connected at one end to the first side frame 78 at the foot end 26 of the weigh frame 70, and at the opposing end to the second side frame 80 at the foot end 26 of the weigh frame 70. Shoulder bolts or other fasteners may be utilized to connect the strut 134 of the pivot assembly 98 to the weigh frame 70 to allow the pivot assembly 98 to pivot about this connection. The opposing end of the pivot arms 130, 132, however, are connected to the lift arm assembly 96 at the strut 104 of the lift arm assembly 96. As shown in FIGS. 4 and 7, a shoulder bolt or other fastener is utilized to secure the end of the first pivot arm 130 to the strut 104 at the outside of the first lift arm 100, and another shoulder bolt or other fastener is utilized to secure the end of the second pivot arm 132 to the strut 104 at the outside of the second lift arm 102. This connection also is a pivot connection allowing both the lift arm assembly 96 and the pivot assembly 98 to pivotally or rotatably move independently relative to the connection therebetween.

Accordingly, the pivot assembly 98 pivots about the connection between the strut 134 and the weigh frame 70, thereby allowing the end of the pivot arms 130, 132 to rotate in a radius equal to the length of the pivot arms 130, 132. Similarly, because the lift arm assembly 96 is connected to the pivot assembly 98 at the pivoting connection described above, as the foot end raise/lower actuator 76 is actuated the actuator exerts pushing and pulling forces on the clevis linkage 122 of the lift arm assembly 96. When the actuator 76 exerts a pushing force on the clevis linkage 122 of the lift arm assembly 96, the lift arm assembly 96 is pushed toward the foot end 26 of the bed 10, however, instead of traversing longitudinally, because the lift arm assembly 96 is pivotally connected to the pivot assembly 98 at the strut 104 pivot point and also movably connected as the second end 110 of the lift arms 100,102 to the cam follower supports 84, 86, the cam followers 112 at the second end 110 of the lift arms 100, 102 follows the cam follower rail 114 as the pivot point between pivot assembly 98 and lift arm assembly 96 moves in a radius. Thus, the first end 106 of the lift arms 100, 102 moves generally vertically upwardly to raise the foot end 26 of the intermediate frame assembly 18. It is understood that when the actuator 76 pulls on the lift arm assembly 96 the reverse process will occur, thereby resulting in the first end 106 of the lift arms 100, 102 moving vertically downwardly to lower the foot end 26 of the intermediate frame assembly 18. Thus, as the piston 126 extends the foot end 26 of the intermediate frame assembly 18 is raised, and as the piston 126 retracts the foot end 26 of the intermediate frame assembly 18 is lowered.

The head end raise/lower linkage assembly 72 operates similar to the foot end raise/lower assembly 74 except for one main difference, the first end 136 of the lift arms 146, 148 of the lift arm assembly 142 at the head end 24 of the base assembly 16 is not fixed to the intermediate frame assembly 18, but rather is movably connected thereto as is explained in detail below.

Referring to FIGS. 4-9, the head end raise/lower actuator 75 is actuated to manipulate the head end raise/lower linkage assembly 72 to raise and lower the head end 24 of the bed 10. In a preferred embodiment, the head end actuator 75 exerts a pushing force on the head end linkage assembly 72 to raise or lift the head end 24 of the intermediate frame assembly 18, and also exerts a pulling force on the head end linkage assembly 72 to lower the head end 24 of the intermediate frame assembly 18. One of ordinary skill in the art would readily understand, however, that the actuator also operates in a reverse manner to raise and lower the intermediate frame assembly without departing from the scope of the present invention.

The head end raise/lower linkage assembly 72 comprises a lift arm assembly 142 and a pivot assembly 144. The lift arm assembly 142 includes a metal weldment component having first and second lift arms 146, 148 connected by a strut 150. As shown in FIGS. 4 and 7-9, the first end 152 of each lift arm 146, 148 has a cam follower 112 connected thereto which engages a cam follower support assembly 154 at the head end 24 of the first and second side intermediate frame members 156, 158, respectively, of the intermediate frame assembly 18 to prevent the intermediate frame assembly 18 from binding the head end raise/lower linkage assembly 72 when the intermediate frame assembly 18 is raised and lowered with respect to the base assembly 16. Specifically, the cam follower 112 on the first lift arm 146 engages the cam follower support assembly 154 on the first side intermediate frame member 156 of the intermediate frame assembly 18, and the cam follower 112 on the second lift arm 148 engages the cam follower support assembly 154 on the second side intermediate frame member 158 of the intermediate frame assembly 18.

The cam follower support assemblies 154 generally comprise an upper retaining member 160 and a lower retaining member 162. In one embodiment the upper retaining member 160 comprises a gusset 160 that is connected, preferably via welding, to the intermediate frame assembly 18. Additionally, in one embodiment the lower retaining member 162 generally comprises an angle bracket 162 secured to the inner surface of the respective intermediate frame member 156, 158. Typically, the cam follower 112 at the first end 152 of the lift arms 146, 148 engages the lower surface of the upper retaining member 160. Additionally, the cam follower 112 is able to pivot or rotate about its longitudinal axis to allow the lift arms 146, 148 to be manipulated as required.

Like the first ends 152 of the lift arms 146, 148, the opposing second ends 164 of lift arms 146, 148 have cam followers 112 connected thereto for moving in the head end cam follower support assemblies 88, 90. Such movement and engagement therebetween is generally similar to the movement/engagement of the cam followers at the second ends 110 of the lift arms 100, 102 in the cam follower support assemblies 84, 86 at the foot end raise/lower assembly 74. As shown in FIGS. 4, 5 and 7, the cam follower 112 at the second end 164 of the first lift arm 146 traverses in the first cam follower support assembly 88 toward the head end 24 of the first side frame 78 of the weigh frame 70, and the cam follower 112 at the second end 164 of the second lift arm 148 traverses in the second cam follower support assembly 90 toward the head end 24 of the second side frame 80 of the weigh frame 70. Each of the cam follower support assemblies 88, 90 toward the head end 24 of the weigh frame 70 comprises a follower rail 114, a first end plate 116, a second end plate 118 and a bottom plate 120. These components may be identical to those used in connection with the foot end raise/lower linkage assembly 74. The follower rail 114 and end plates 116, 118 are preferably welded to the respective side frames 78, 80, and the bottom plate 120 is bolted to the bottom of the respective side frame 78, 80 after the head end raise/lower linkage 72 is assembled on the bed 10. As shown in FIG. 7, the cam followers 112 connected to the second end 164 of the lift arms 146, 148 engage the lower surface of the follower rail 114 and traverses back and forth along the lower surface of the follower rail 114.

As shown in FIGS. 4 and 5, the strut 150 of the lift arm assembly 142 is welded in fixed connection between the first and second lift arms 146, 148 of the lift arm assembly 142 at the head end raise/lower linkage 72. Like strut 104 of the foot end raise/lower linkage 72, the strut 150 of the head end raise/lower linkage 72 operates as a moving pivot point for the head end raise/lower linkage 72. Additionally, the strut 150 has a clevis linkage 166 extending therefrom. The clevis linkage 166 allows a piston 168 of the head end raise/lower actuator 75 to connect to the head end raise/lower linkage 72. The opposing end of the actuator 75 is connected to another clevis linkage 124 extending from the cross member 82 of the weigh frame 70. Accordingly, the head end raise/lower actuator 75 is secured in place to the weigh frame 70 at the clevis linkage 124 extending from the cross member 82 of the weigh frame 70, and the piston 168 extending from the head end raise/lower actuator 75 is connected to the clevis linkage 166 extending from the lift arm assembly 142.

The lift arm assembly 142 is also connected to the pivot assembly 144 of the head end raise/lower linkage assembly 72 in a pivoting or rotating connection. The pivot assembly 144 comprises a first pivot arm 170, a second pivot arm 172 and a strut 174 connecting one end of the first and second pivot arms 170, 172. Thus, in one embodiment the shape of the pivot assembly 144 is generally "U" shaped. The pivot assembly 144 is connected to the weigh frame 70 at the strut 174 thereof. Specifically, the strut 174 is connected at one end to the first side frame 78 at the head end 24 of the weigh frame 70, and at the opposing end to the second side frame 80 at the head end 24 of the weigh frame 70. Shoulder bolts or other fasteners may be utilized to connect the strut 174 of the pivot assembly 144 to the weigh frame 70 to allow the pivot assembly 144 to pivot about this connection. The opposing end of the pivot arms 172, 174, however, are connected to the lift arm assembly 142 at the strut 150 of the lift arm assembly 142. As shown in FIGS. 4 and 7, a shoulder bolt or other fastener is utilized to secure the end of the first pivot arm 172 to the strut 150 at the outside of the first lift arm 146, and another shoulder bolt or other fastener is utilized to secure the end of the second pivot arm 174 to the strut 150 at the outside of the second lift arm 148. This connection also is a pivot connection allowing both the lift arm assembly 142 and the pivot assembly 144 to pivotally or rotatably move independently relative to the connection therebetween.

Accordingly, the pivot assembly 144 pivots about the connection between the strut 174 and the weigh frame 70, thereby allowing the end of the pivot arms 170, 172 to rotate in a radius equal to the length of the pivot arms 170, 172. Similarly, because the lift arm assembly 142 is connected to the pivot assembly 144 at the pivoting connection described above, as the head end raise/lower actuator 75 is actuated the actuator exerts a pushing force and/or pulling force on the clevis linkage 166 of the lift arm assembly 142. When the actuator 75 exerts a pushing force on the clevis linkage 166 of the lift arm assembly 142, the lift arm assembly 142 is moved toward the head end 24 of the bed 10, however, instead of traversing longitudinally, because the lift arm assembly 142 is pivotally connected to the pivot assembly 144 at the strut 150 pivot point and also movably connected as the second end 164 of the lift arms 146, 148 to the cam follower supports 88, 90, the cam followers 112 at the second end 164 of the lift arms 146, 148 follows the cam follower rail 114 as the pivot point between pivot assembly 144 and lift arm assembly 142 moves in a radius. Thus, the first end 152 of the lift arms 146, 148 moves generally vertically upwardly to raise the head end 24 of the intermediate frame assembly 18. It is understood that when the actuator 75 pulls on the lift arm assembly 142 the reverse process will occur, thereby resulting in the first end 152 of the lift arms 146, 148 moving vertically downwardly to lower the head end 24 of the intermediate frame assembly 18. Thus, as the piston 168 extends the head end 24 of the intermediate frame assembly 18 is raised, and as the piston 168 retracts the head end 24 of the intermediate frame assembly 18 is lowered. The raised most and lower most positions of one embodiment of the lift arm assembly 142 of the head end raise/lower linkage assembly 72 is illustrated in FIG. 7.

Referring to FIGS. 8-10, the intermediate frame assembly 18 of one embodiment of the bed 10 generally comprises an intermediate frame 180, a head deck section actuator 182 to raise and lower the head deck section 202, a seat deck actuator 184 to raise and lower the seat deck section 204, and a foot deck actuator 186 to raise and lower the foot deck section 206. In one embodiment the intermediate frame 180 is a metal weldment component having first and second opposing side frame members 156, 158, and a plurality of cross members connecting the opposing side frame members 156, 158. In the embodiment illustrated, the side frame members 156, 158 and the cross members are made of rectangular tubing, however, one of ordinary skill in the art would readily understand that any size or shape tubing, bar stock, round stock, bent flat stock, etc. is acceptable and would perform adequately without departing from the scope and spirit of the present invention.

In one embodiment, as shown in FIGS. 8 and 9, the intermediate frame 180 has four cross members 188, 190, 192 and 194 joining the opposing side frame members 156, 158. A first cross member 188 is provided at the head end 24 of the frame 180, a second cross member 190 is provided to support the head deck actuator 186, a third cross member 192 is provided to support the seat deck actuator 184, and a fourth cross member 194 is provided to support the foot deck actuator 186. Generally the cross members 190, 192, 194 supporting the actuators do not extend beyond the extent of the opposing side frame members 156, 158. The intermediate frame 180 is generally open at the very foot end 26 portion of the intermediate frame 180. As shown in FIG. 8, clevis linkages 187 are provided on certain cross members 190, 192, 194 to connect the appropriate actuator to the appropriate cross member in a manner to allow the actuators to pivot about the connection point between the actuator and the clevis as the piston rods of the actuators are extended and retracted.

The intermediate frame 180 also has connected at the head end 24 thereof cam follower support assemblies 154 for engaging the lift arm assembly 142 of the head end raise/lower linkage assembly 72. Specifically, a first of the cam follower support assemblies 154 is provided at the head end 24 of the first side frame member 156 of the intermediate frame 180, and a second of the cam follower support assemblies 154 is provided at the head end 24 of the second side frame member 158 of the intermediate frame 180. Each cam follower support assembly 154 generally comprises an upper retaining member 160 and a lower retaining member 162. The cam follower support assembly 154 may also have a side member 196.

A lower surface of the upper retaining member 160 generally engages the cam follower 112 at the first end 152 of the lift arms 146, 148 of the lift arm assembly 142 of the head end raise/lower linkage assembly 72. In one embodiment the upper retaining member 160 comprises a gusset 160 that is connected, preferably via welding, to the intermediate frame 180. As shown in FIGS. 8-10, a first gusset 160 is generally a plate connected to both the first cross member 188 and the first side frame members 156, and the second gusset 160 is also generally a plate connected to both the first cross member 188 and the second side frame member 158. The gusset 160 is generally positioned on the top surface of the cross member 188 and the respective side frame members 156, 158, and its lower surface interior of the cross member 188 and the respective side frame member 156, 158 provides the engaging surface for the cam follower 112 at the first end 152 of the respective lift arms 146, 148. Each gusset 160 also extends to a position exterior of the respective side frame members 156, 158, and has a holder 198 (also see FIG. 2) generally connected thereto. The holder 198 may be utilized to support a trapeze assembly (not shown) for the hospital bed 10.

In one embodiment the lower retaining member 162 generally comprises an angle bracket 162 secured to the inner surface of the respective intermediate side frame member 156, 158. The lower retaining member 162 prevents the cam follower 112 from falling downward, and also with the gusset 160 defines a channel of the cam follower support assembly 154 for the cam follower 112. Separate side members 196, best shown in FIG. 8, are connected to the interior side surface of each respective intermediate side frame member 156, 158, and generally provides for appropriate spacing of the cam follower 112 in the channel of the cam follower support assembly 154.

Referring to FIGS. 8 and 9, the tubular components 108 at the first ends 106 of the first and second lift arms 100, 102 are shown connected at their respective pivot points to the first and second side frame members 156, 158 of the intermediate frame assembly 18. In one embodiment, a bolt extends through the tubular component 108 and first side frame member 156 of the intermediate frame assembly 18 at the foot end 26 of the intermediate frame assembly 18 and is secured with a fastener, and a bolt extends through the tubular component 108 and second side frame member 158 of the intermediate frame assembly 18 at the foot end 26 of the intermediate frame assembly 18 and is also secured with a fastener. As explained above, while the lift arms 100, 102 are fixed at specific points to the foot end 26 of the intermediate frame assembly 18, the lift arms 100, 102 are able to pivot or rotate about the longitudinal axis of the tubular components 108 thereof.

As shown in FIG. 10, at least a portion of the support deck assembly 20 extends from and is connected to the intermediate frame assembly 18. In one embodiment of the bed 10, the support deck assembly 20 for the bed 10 comprises a plurality of different deck sections. For example, as shown in FIGS. 8-11, the support deck assembly 20 comprises a head deck section 202 adjacent the head end 24 of the bed 10, a seat deck section 204, and a foot deck section 206 adjacent the foot end 26 of the bed 10. These sections of the support deck assembly 20 generally comprise the main deck. The head deck section 202 may also be referred to as a first deck section, the seat deck section 204 may also be referred to as a second deck section, and the foot deck section 206 may also be referred to as a third deck section. The head deck section 202 is generally moveable from a generally horizontal position to a more vertical back-support position, and when the bed 10 is also a chair bed 10 as shown in FIG. 34, the foot deck section 206 is moveable from a generally horizontal position to a substantially vertical position. The seat deck section 204 is positioned between the head deck section 202 and the foot deck section 206. The seat deck section 204 is pivotably connected to the intermediate frame 180, such that the seat deck section 204 can pivot upwardly into a knee-gatch position.

The head deck section actuator 182 is connected at one end to a clevis extending from the intermediate frame 180 and at the opposing end to the head deck section 202 to raise and lower the head deck section 202, the seat deck actuator 184 is connected at one end to a clevis extending from the intermediate frame 180 and at the opposing end to the seat deck section 204 to raise and lower the seat deck section 204, and the foot deck actuator 186 is connected at one end to a clevis extending from the intermediate frame 180 and at the opposing end to the seat deck section 204 to raise and lower the foot deck section 206. The head and seat deck sections 202, 204 are also connected at other positions to the intermediate frame 180 as explained herein to allow pivoting thereof.

Referring to FIGS. 8-11 the head deck section 202 is connected to the intermediate frame 180 at four additional points (i.e., a 4 bar linkage), with a pair of dog-ear linkages 208 and with a head deck linkage assembly 210. Each of the dog-ear linkages 208 has a generally "L" shaped configuration. Such a configuration aids in providing a low shear pivoting action of the head deck section 202 when the head deck section 202 is manipulated from a substantially horizontal position, as shown in FIG. 1, to a more upright back support position, as shown in FIG. 35. One of the pair of dog-ear linkages 208 is pivotally connected at a first end to an exterior surface of the first intermediate side frame member 156, and the other of the pair of dog-ear linkages 208 is pivotally connected at a first end to an exterior surface of the second intermediate side frame member 158. The second ends of the dog-ear linkages 208 are pivotally connected to brackets 260 extending from the frame assembly 212 of the head deck section 202. One of ordinary skill in the art would readily understand, however, that the dog-ear linkage bars can be of any shape required to achieve the desired motion of the bed deck while clearing other bed components throughout the range of motion. In a simple configuration the dog-ear linkage bars could be straight.

Figure 37:
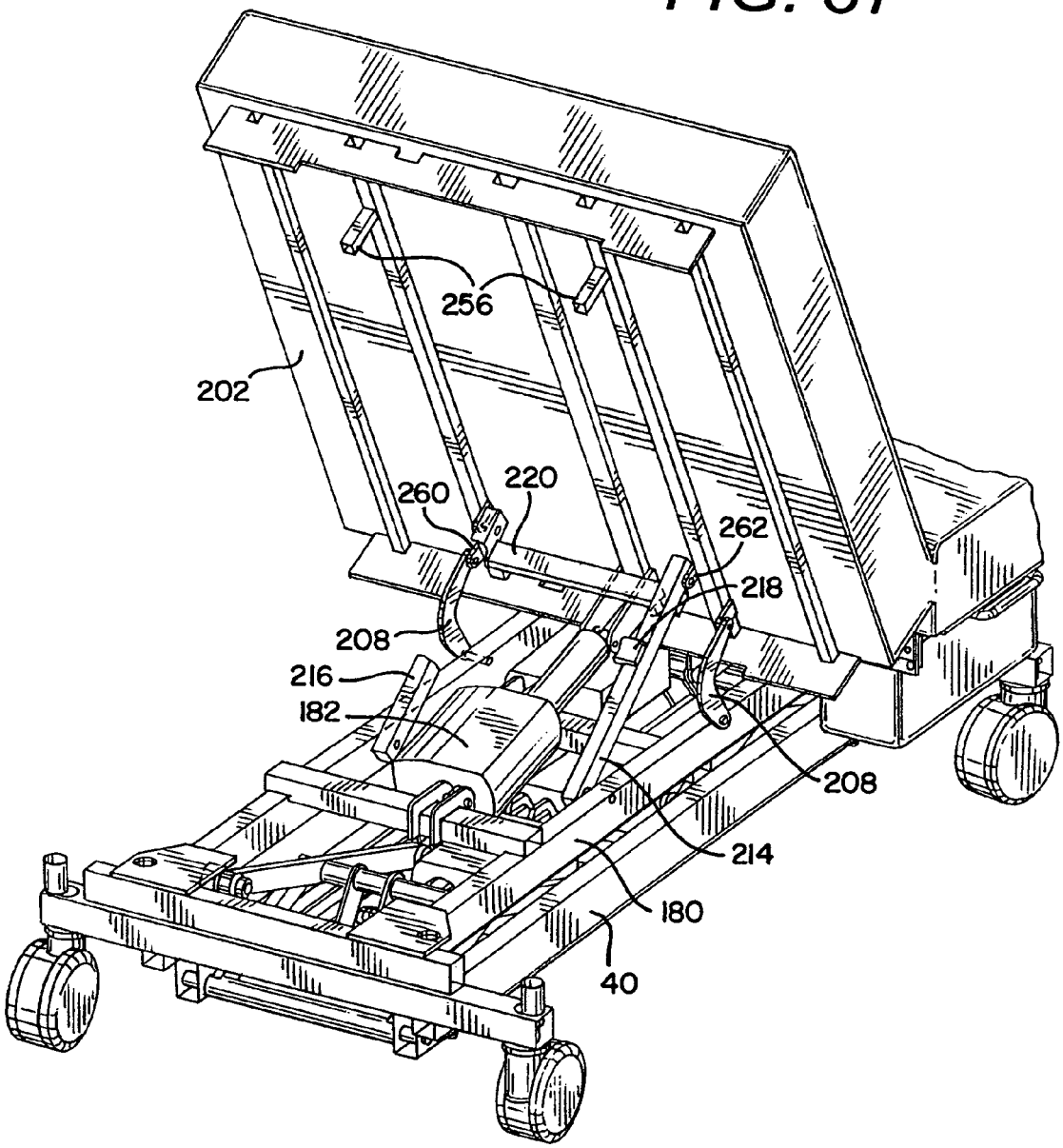
FIG. 37 is a partial rear perspective view of the chair bed of FIG. 34.

As best shown in FIGS. 8, 10 and 37, the head deck linkage assembly 210 generally comprises first and second longitudinal members 214, 216 connected by first and second cross members 218, 220 to add rigidity and strength to the head deck linkage assembly 210. The first end of the first longitudinal member 214 is pivotally connected to an inner surface 222 of the first intermediate side frame member 156, and the corresponding first end of the second longitudinal member 216 is pivotally connected to an inner surface 224 of the second intermediate side frame member 158. The second ends of the longitudinal members 214, 216 are pivotally connected to brackets 262 extending from the head frame assembly 212 of the head deck section 202.

In one embodiment of the bed 10, the head deck section 202 is raised and lowered by the head deck section actuator 182, however, rather than exerting a pushing force on the head deck section 202 to raise the head deck section 202, the head deck section actuator 182 exerts a pulling force on the head deck section 202 to raise that section, and it further correspondingly exerts a pushing force on the head deck section 202 to lower that section. As shown in FIG. 37, when the actuator 182 exerts a force to assist in raising the head deck section 202, the geometry of the four bar linkage (i.e., the pair of dog-ear linkages 208 and the head deck linkage assembly 210) in connection with the force exerted by the actuator 182 operates to raise the head deck section 202 about a virtual pivot axis that may be distinct from any pivot axis on the bed. In one embodiment such a virtual pivot axis is generally provided at a location above the surface of the bed 10 and toward the foot end 26 of the bed 10 with respect to the head deck section 202. With regard to the movement of the head deck section 202, as the head deck section 202 is raised by the preferred four bar linkage, the head deck section 202 is manipulated simultaneously both angularly upward from the intermediate frame 180 as well as toward the head end 24 of the bed 10. Similarly, as the head deck section 202 is lowered, the head deck section 202 is manipulated simultaneously both angularly downward toward the intermediate frame 180 as well as toward the foot end 26 of the bed 10. The result of the such movement is that the top surface of the mattress 22 remains a substantially constant length, thereby resulting in decreased shear observed by a patient resting on the bed 10. The head deck section 202 can pivot from approximately 0° in the horizontal position, to approximately 65° in the more vertical back-support position.

Referring to FIGS. 8-11, the seat deck section 204 is connected to the intermediate frame 180 with two brackets 226 and the seat deck actuator 184. Specifically, a first of the brackets 226 is connected in a fixed manner at a first end to the inner surface 222 of the first intermediate side frame member 156, and is pivotally connected at a second end to the frame assembly 228 of the seat deck section 204. Similarly, a second of the brackets 226 is connected in a fixed manner at a first end to the inner surface 224 of the second intermediate side frame member 158, and is pivotally connected at a second end to the frame assembly 228 of the set deck section 204. A clevis 230 extends downwardly from the seat frame assembly 228 to allow the seat deck actuator 184 to be pivotally connected thereto. The seat actuator 184 adjusts the angle of the seat deck 204 with respect to the frame. In one embodiment the pivot range of the seat deck section 206 is from approximately 0° in the horizontal to approximately 15° in the knee-gatch position. In a preferred embodiment the length of the seat deck section 204 is a fixed length.

In one embodiment of the bed 10, the foot end 26 of the seat deck section 204 is pivotally raised and lowered at the axis created by at the joint of the pivoting connection between the brackets 226 and the seat frame assembly 228. To pivotally raise the foot end 26 of the seat deck section 204 the seat deck section actuator 184 exerts a pushing force on the seat deck section 204, and it further correspondingly exerts a pulling force on the seat deck section 204 to lower that section. Accordingly, the seat deck section 204 is moveable from a generally horizontal position, as shown in FIGS. 1 and 34, to an angularly raised position with respect to the intermediate frame 180, also known as a knee-gatch position, as shown in FIG. 36.

Generally, in one embodiment when the bed 10 is in the flat or horizontal state, the head deck actuator 182 is fully extended, the seat deck actuator 184 is fully retracted, and the foot deck actuator 186 is fully extended. To raise the head deck section 202, the head deck actuator 182 retracts (i.e., a pulling loading). To raise the seat deck section 204, the seat deck actuator 184 extends (i.e., a pushing loading). To drop the foot deck section 206, the foot deck actuator 186 retracts (i.e., a pushing loading). Further, to raise and lower the intermediate frame assembly 18, the head end and foot end raise/lower actuators 75, 76 are synchronized. To place the bed in a Trendelenburg position, the head end raise/lower actuator 75 retracts and the foot end raise/lower actuator 76 extends. Conversely, to place the bed in the reverse Trendelenburg position, the head end raise/lower actuator 75 extends and the foot end raise/lower actuator 76 retracts.

Figure 12:
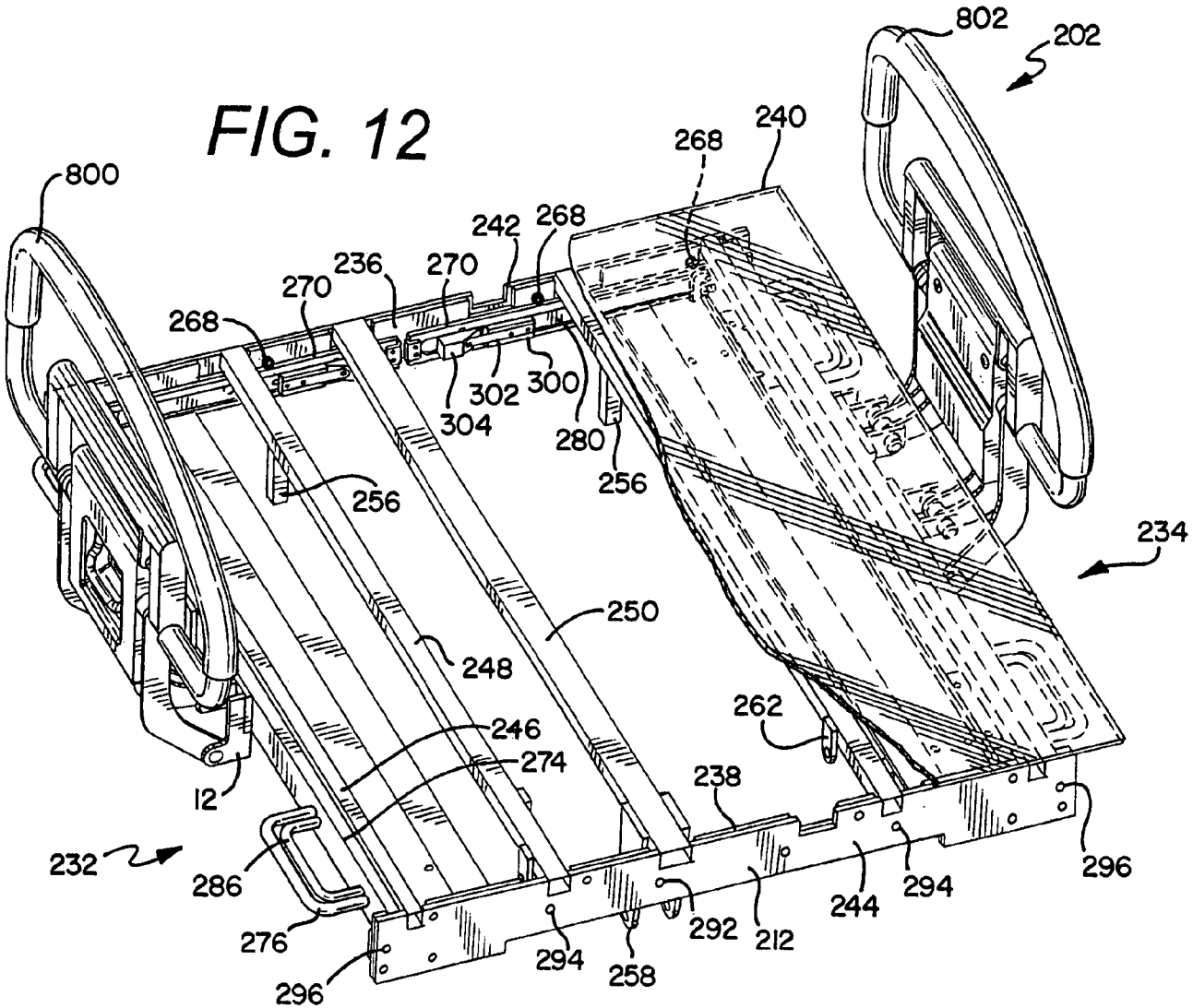
FIG. 12 is a perspective view of one embodiment of a head deck section with the deck partially removed.
Figure 13:
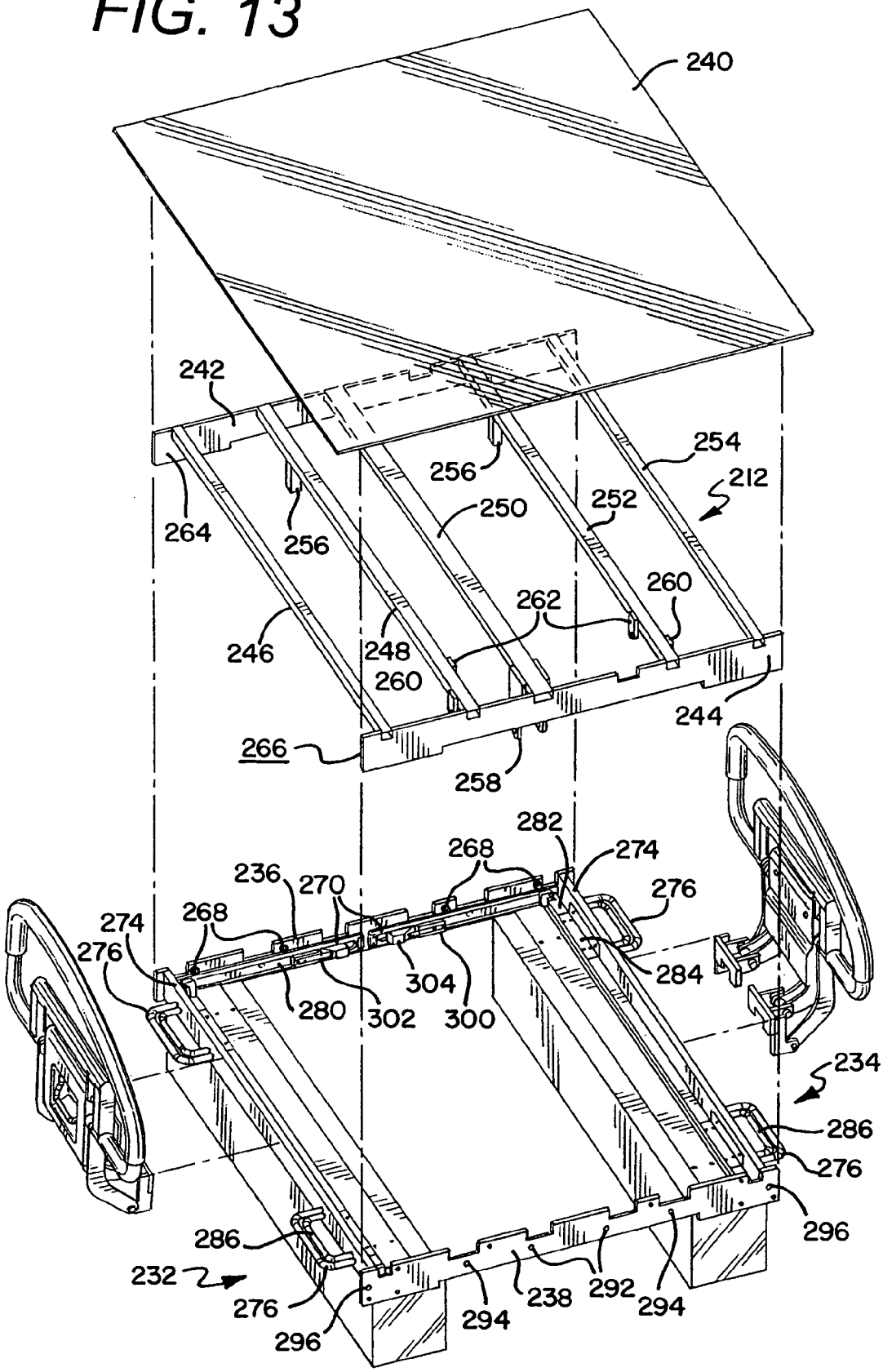
FIG. 13 is an exploded perspective view of one embodiment of a head deck section for a hospital bed having an extension mechanism for expanding the width of the bed.

As shown in FIGS. 12 and 13, in one embodiment of the bed the head deck section 202 generally comprises a head frame assembly 212 and a head deck plate 240. Alternatively, the head deck plate 240 may be replaced by an X-ray assembly to allow X-rays to be taken of the patient without the patient having to be removed from the bed 10. Additionally, in one embodiment wherein the bed has a variable width component, the head deck section 202 also comprises a first side head deck extender assembly 232 and a second side head deck extender assembly 234. The deck extender assemblies are also referred to as patient support extension assemblies. The first side head deck extender assembly 232 is utilized to increase the width of the bed at the first side 28 of the bed 10, and the second side head deck extender assembly 234 is utilized to increase the width of the bed at the second side 30 of the bed 10. The deck extender assemblies 232, 234 are slidingly connected to the head deck section 202 and allowed to move relative thereto with the use of a first head deck roller plate 236 and a second head deck roller plate 238. In one embodiment the deck extender assemblies 232, 234 are connected to the main support deck assembly 20 below a surface 240 of the support deck assembly 20.

The head deck frame assembly 212 comprises a head end plate 242, a foot end plate 244 and a plurality of cross members 246, 248, 250, 252 and 254 connecting the head end plate 242 and the foot end plate 244. Two of the cross members 248, 252 have a deck stopper 256 extending downwardly therefrom. The deck stoppers 256 contact the top surface of the first and second intermediate frame members 156, 158 when the head deck section 202 is in the lowermost position (i.e., when it is in the substantially horizontal bed position) to assist in supporting the head deck section 202 in this position. Another of the cross members 250 has extending therefrom the clevis member 258 for connecting the piston of the head deck section actuator 182. Finally, other of the cross members 248, 252 have brackets 260 extending therefrom for pivotally connecting the second end of the dog-ear linkages 208, and brackets 262 for pivotally connecting the second end of the longitudinal members 214, 216 of the head deck linkage assembly 210. The head deck frame assembly 212 is preferably a metal weldment, and the head deck plate 240 is preferably fastened thereto. Like the other deck plates, the head deck plate 240 may be made of a ¼" thick plastic material, or thinner metal material.

Figure 15:
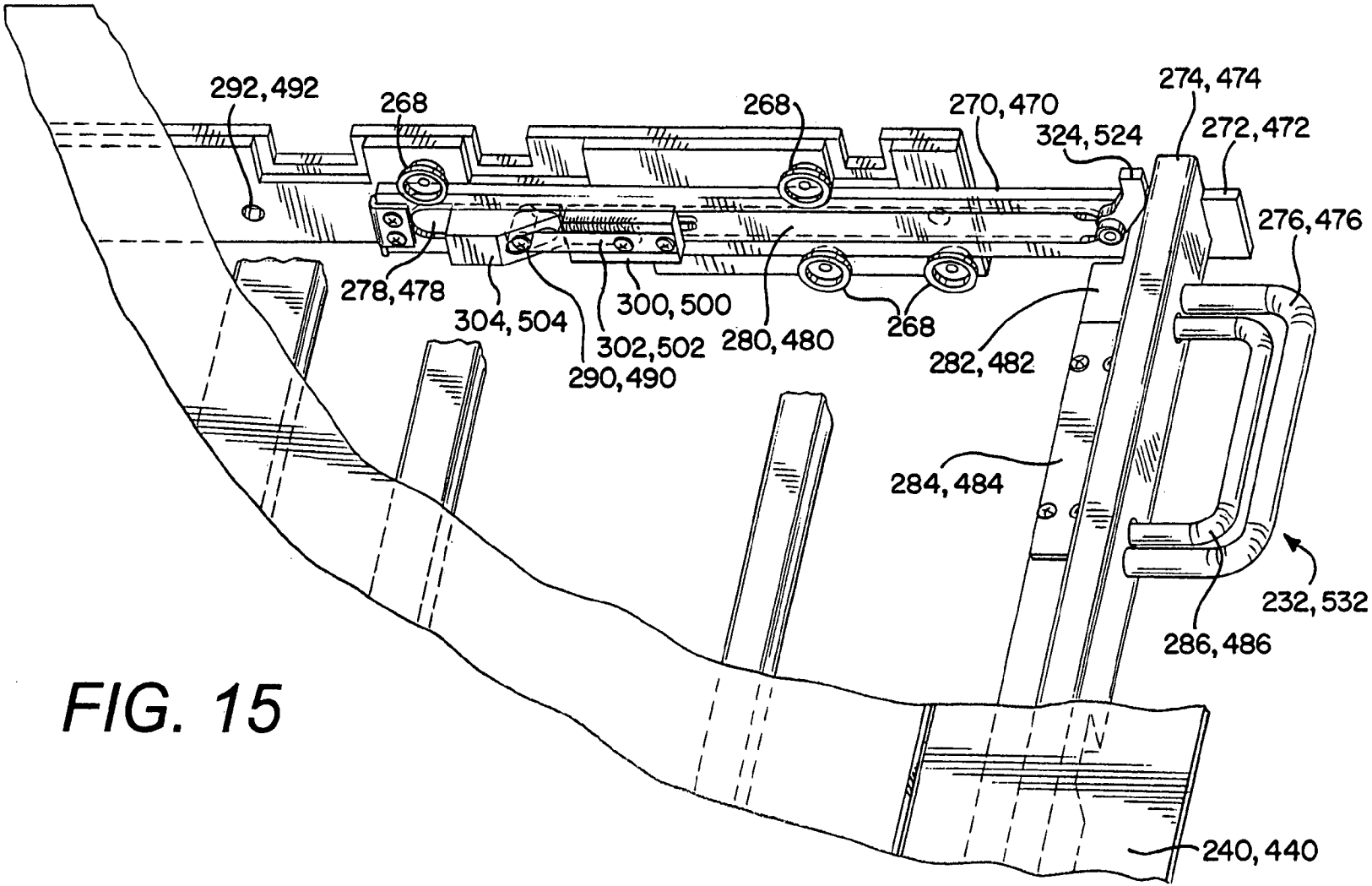
FIG. 15 is an enlarged broken-away partial perspective view of an actuation mechanism for the extension mechanism of FIG. 13.

The first head deck roller plate 236 is fixedly connected to the head end plate 242 of the head deck frame assembly 212 at the inner surface 264 thereof, and the second head deck roller plate 238 is fixedly connected to the foot end plate 244 of the head deck frame assembly 212 at the inner surface 266 thereof. The first and second side head deck extender assemblies 232, 234 are then movably connected between a plurality of rollers 268 extending from the first and second head deck roller plates 236, 238, as shown in FIG. 15, similar to a drawer in a cabinet. As identified in FIGS. 18-20, the first and second side head deck extender assemblies 232, 234 are independently moveable from a first retracted position (see FIG. 18) to a second expanded (see FIG. 20). Similarly, the supplemental mattresses on the first and second side head deck extender assemblies 232, 234 are thus repositioned from a first retracted position (see FIG. 18) to a second expanded position (see FIG. 20). In one embodiment the distance from the centerline of the bed 10 to an edge of the mattress 22 is identified as distance $W_1$, and the distance from the centerline of the bed 10 to an edge of the supplemental mattress 320 after the supplemental mattress 320 is in the second expanded position is identified as distance $W_2$, and $W_2$ is greater than $W_1$. In a preferred embodiment, the width of the supplemental mattress is approximately 5 inches, and thus the distance from $W_1$ to $W_2$ is approximately 5 inches. In one embodiment, however, the distance to the rotation position is an additional 7 to 7.5 inches from the expanded position (see FIG. 19).

Referring to FIGS. 12, 13 and 15-17, the first and second side head deck extender assemblies 232, 234 of the head deck section 202 each generally comprise a head end rail 270, a foot end rail 272, and an endplate 274 connecting the head end rail 270 and the foot end rail 272. Two handles 276 are secured to the endplate 274 to assist the user in grasping and manipulating the endplate 274 to move the deck extender sections. The head end and foot end rails 270, 272 of the deck extender assemblies 232, 234 each have a recessed slot 278 for housing a pull rail 280 therein (see FIG. 15A). The depth of the slot 278 is not the entire thickness of the end rail 270, 272, but instead is only slightly greater than the thickness of the pull rail 280, which is thinner than the end rails 270, 272. Thus, in a preferred embodiment slot 278 is not a thru slot. The pull rails 280, in conjunction with a number of additional components described herein, are utilized to release a plunger to allow the deck extender assemblies to be relocated between first, second and third positions.

Figure 16:
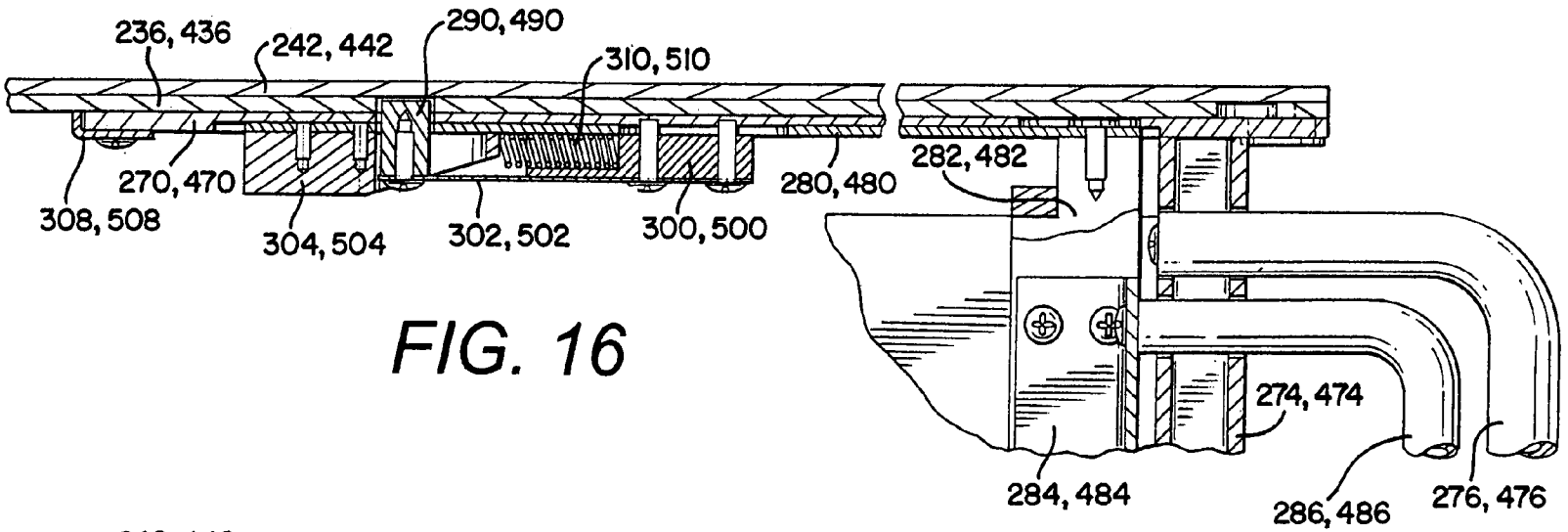
FIG. 16 is a partial cross-sectional top view of the actuation mechanism for the extension mechanism of FIG. 13 in a non-engaged position.
Figure 17:
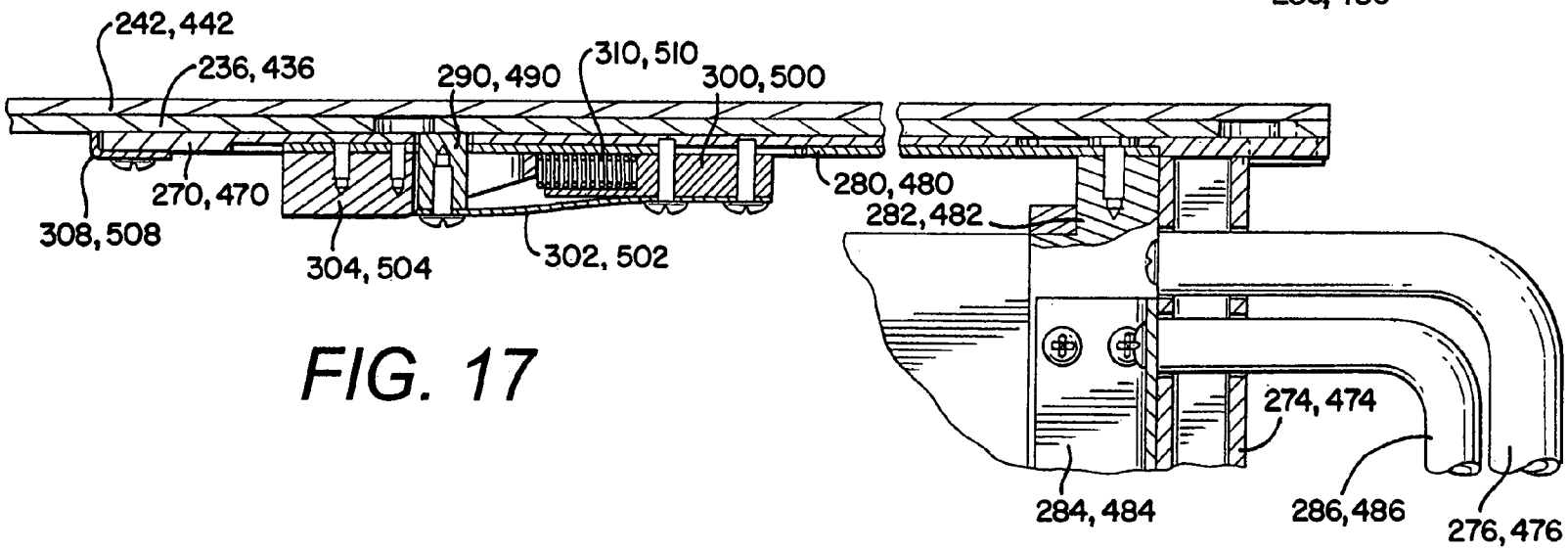
FIG. 17 is a partial cross-sectional top view of the actuation mechanism for the extension mechanism of FIG. 13 in an engaged position.

To manipulate the pull rails 280, two interior release handles 286 are connected via a bracket 284 to a release bar 282 which engages the pull rails 280. A release handle 286 is shown in FIG. 16 in the non-actuated or non-engaged position. In the actuated or engaged position of FIG. 17, however, the release handle 286 is pulled toward the deck extender handle 276 to actuate the pull rails 280. A first end of the release bar 282 is connected to the pull rail 280 in the slot 278 of the head end rail 270, and a second end of the release bar 282 is connected to the opposing pull rail 280 in the slot 278 of the foot end rail 272. The pull rails 280 are free to traverse in the slots 278 when the release handle 286 is actuated (subject to the spring force of the spring 310 described below).

Figure 15A:
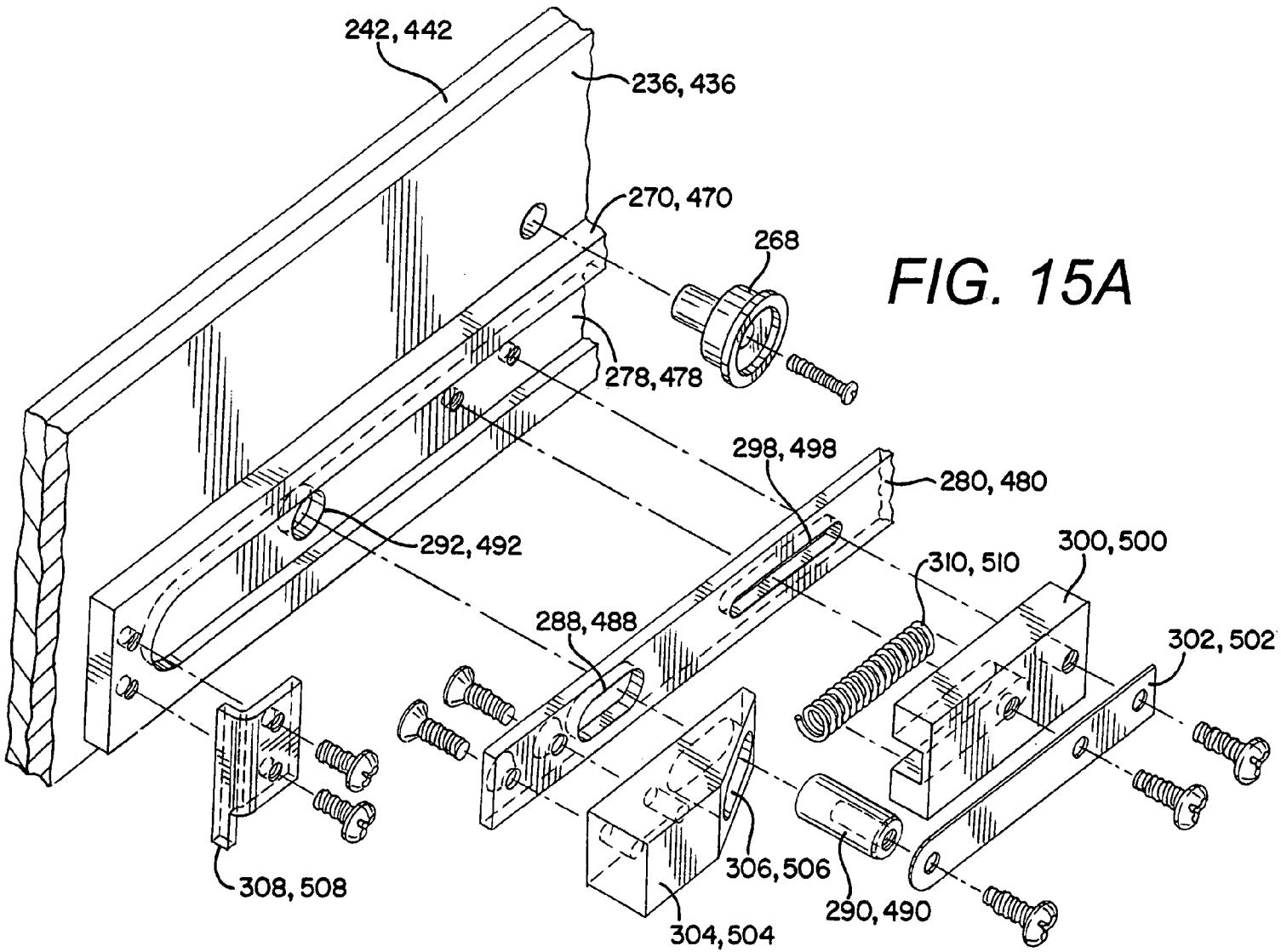
FIG. 15*a* is a partial exploded perspective view of an actuation mechanism of FIG. 15.

As shown in FIG. 15A, the pull rails 280 have a plurality of thru slots. A first slot 288 is provided as an opening to allow the plunger 290 to pass through the pull rail 280 and the appropriate end rail 270, 272, and also engage a plurality of apertures 292, 294, 296 in the first and second head deck roller plates 236, 238 (see FIG. 13). Each aperture corresponds to the three positions of the head deck extender assembly as explained herein. A second slot 298 is provided to allow for fasteners to secure a support block 300, supporting a leaf spring 302 connected to the plunger 290, directly to each of the head end and foot end rails 270, 272. Specifically, one support block 300 (with the leaf spring 302 and plunger 290) is fixedly connected to the head end rail 270, and another support block 300 (also with a leaf spring 302 and plunger 290) is fixedly connected to the foot end rail 272. The slot 298 in the pull rails 280 allows the support blocks 300 to be positioned adjacent the pull rails 280, but to be fixed to the respective head and foot end rails 270, 272. Accordingly, when the pull rails 280 are manipulated via the release handle 286 the support blocks 300 do not move. Instead, the support blocks 300 move only in direct relation to the head and foot end rails 270, 272.

An angle block 304 is connected to the pull rails 280 adjacent the support block 300, and as such any movement of the angle block 304 is a direct result and in direct relation to movement of the pull rails 280 and release handle 286. The angle block 304 has a slot 306 that mates with the first slot 288 in the pull rail 280. When the components are assembled, the plunger 290 connected to the support block 300 extends through both the slot 306 in the angle block 304 and the slot 288 in the pull rail 280 and mates with one of the apertures 292, 294, 296 in the first and second head deck roller plates 236, 238.

A stop 308 is connected at the end of the pull rail 280. The stop 308 prevents the deck extender assemblies 232, 234 from becoming disassembled from the appropriate deck section in the partially-deployed position of FIG. 19. The deck extender assemblies 232, 234 also have a spring 310 provided in a cutout in the support block 300. The spring 310 exerts a spring force on the angle block 304. The force exerted on the angle block 304 is translated to the pull rails 280, the release bar 282 and the release handle 286, thereby providing a force to maintain these components in the non-engaged and non-actuated position as shown in FIG. 16. Only by exerting a force on the release handle 286 greater than the spring force of the two springs 310 (and the leaf spring friction on angle block 304) will the release mechanism of the deck extender assemblies 232, 234 be actuated.

In a preferred embodiment, the first side head deck extender assembly 232 is a mirror image of the second side head deck extender assembly 234. Accordingly, all components described herein with respect to the first side head deck extender assembly 232 are also found in their appropriate locations in the second side head deck extender assembly 234. Additionally, it is understood that in a preferred embodiment the deck extender assemblies operate completely independently. Accordingly, any deck extender assembly of the bed may be in the retracted or non-deployed position, the partially deployed position, or the expanded or deployed position at any time, irrespective of any other deck extender assembly.

Figure 18:
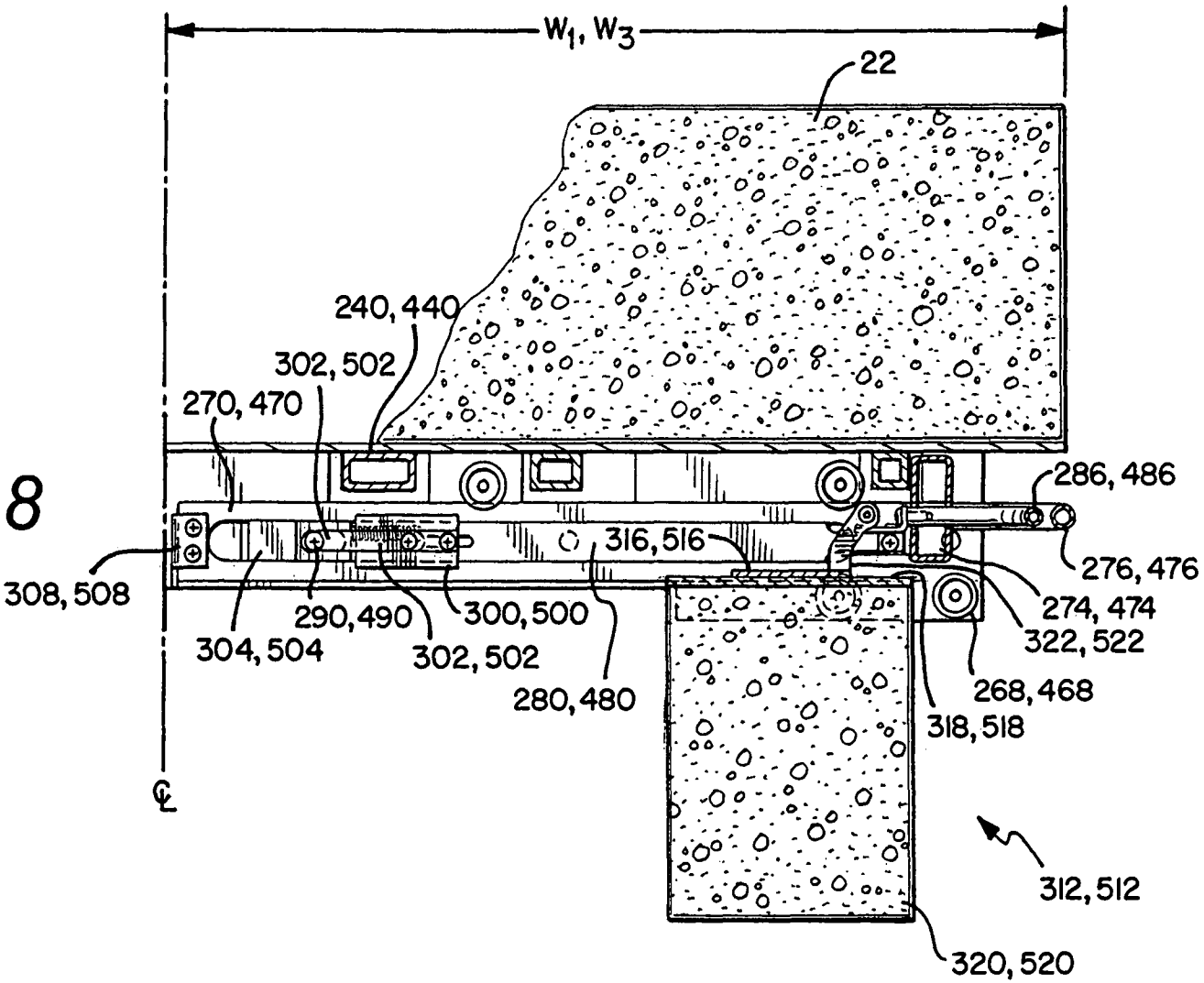
FIG. 18 is a partial cross-sectional end view of the head deck section and extension mechanism of FIG. 13 in a non-deployed position.
Figure 20:
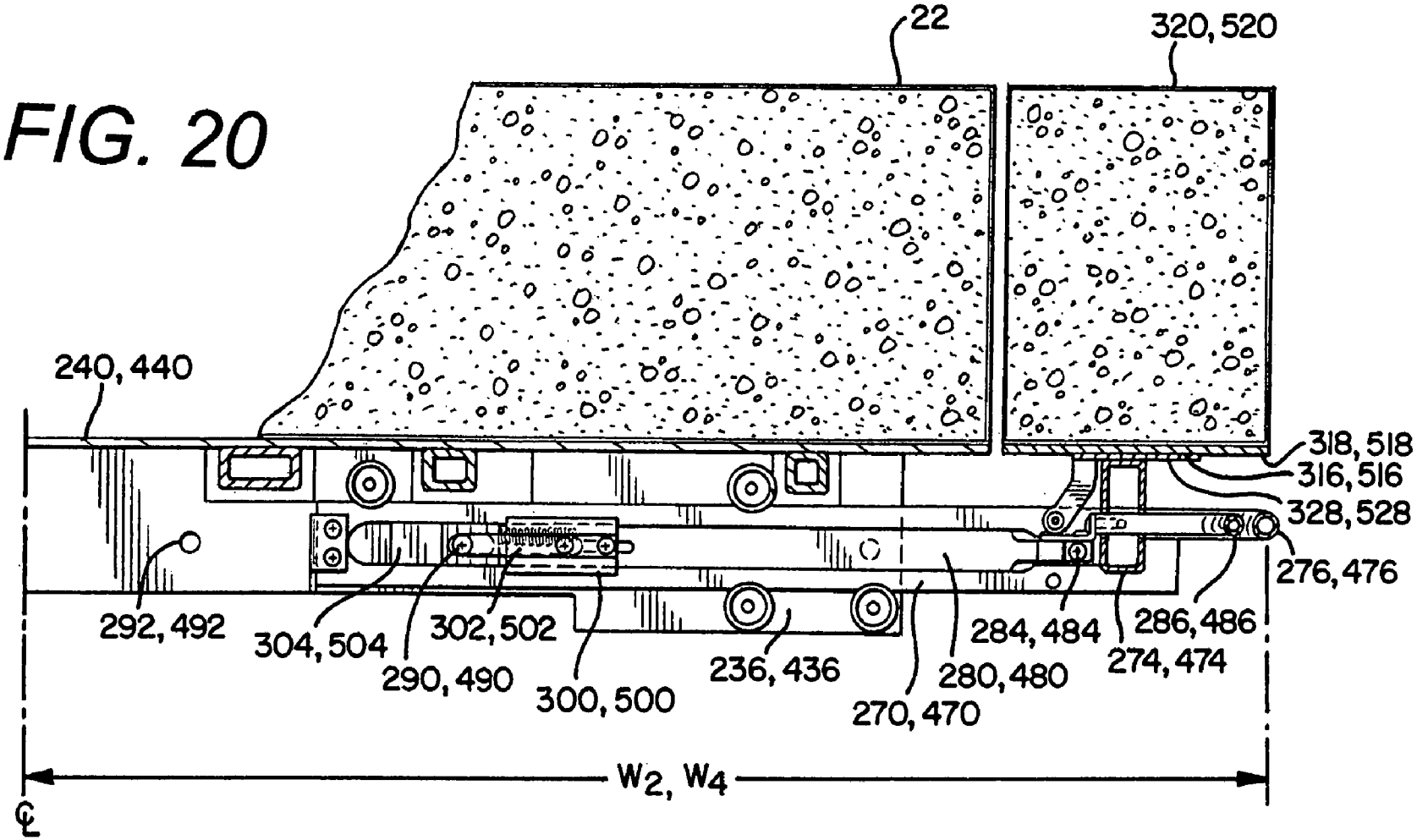
FIG. 20 is a partial cross-sectional end view of the head deck section and extension mechanism of FIG. 13 in a deployed position.

In the retracted or non-deployed position as shown in FIG. 18, the deck extender assemblies 232, 234 are generally underneath the deck plate 240. Further, in the retracted position of the plungers 290 of the deck extender assembly 232, 234 are positioned in the first aperture 292 of the head deck roller plates 236, 238, respectively. To move the deck extender assemblies 232, 234 to the extended or deployed position as shown in FIG. 20, the user actuates the release handle 286 by pulling the release handle 286 toward the deck extender handle 276. When the release handle 286 is actuated, the pull rails 280 are manipulated in the slots 278 of the head end and foot end rails 270, 272, thereby moving the angle block 304 toward the support block 300 (See FIGS. 16 and 17). The angled surface on the angle block 304 engages the leaf spring 302 to lift the leaf spring 302 and disengage the plunger 290 from the first aperture 292. When the plunger 290 is released from the first aperture 292 the deck extender assembly 232 or 234 is free to traverse to the extended position, wherein the plunger 290 will mate with the second aperture 294 and secure the deck extender assembly 232 or 234 in the extended position. In this extended or deployed position the deck extender assembly is out approximately 5" from its original non-deployed position.

Figure 19:
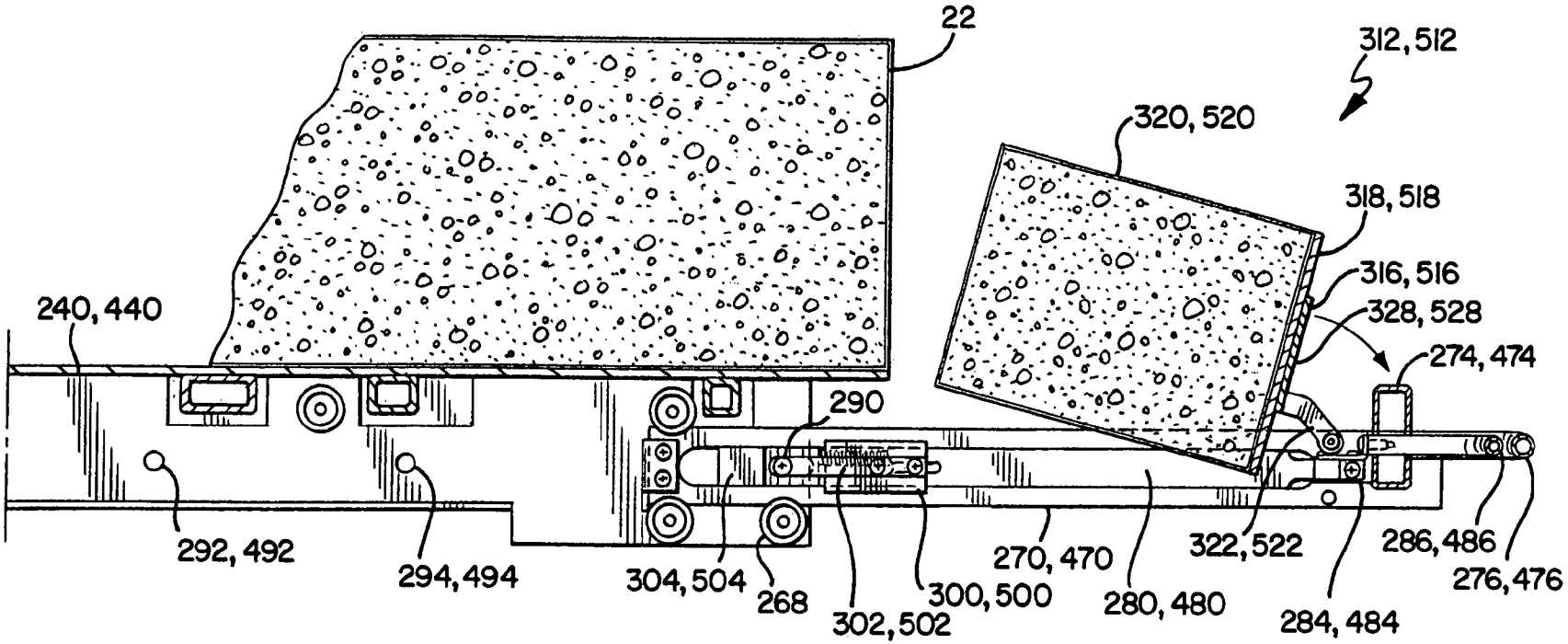
FIG. 19 is a partial cross-sectional end view of the head deck section and extension mechanism of FIG. 13 in a partially-deployed position.

A third position, shown in FIG. 19 and referred to as the partially deployed position, occurs when the deck extender assembly 232 or 234 is manipulated, following the steps outlined above, such that the plunger 290 mates with and engages the third aperture 296. As is explained below in detail, when the deck extender assembly 232 or 234 is in the partially deployed position, which is further extended than the deployed position, a supplemental mattress assembly is free to be rotated from a first position below the deck to a second position at deck level. The partially deployed position is out an additional 7" to 7.5" from the deployed position, making it approximately 12" to 12.5" from the original non-deployed position. After the supplemental mattress assembly is rotated to the second position, the deck extender assembly 232 is then manipulated back 7" to 7.5" to the extended position as shown in FIG. 20. To place the supplemental mattress assembly in the first position under the deck and to move the deck extender assembly 232 or 234 back to the retracted position, a reverse process of the above is performed.

As briefly explained above, in a preferred embodiment each of the deck extender assemblies 232, 234 also has a supplemental mattress assembly connected thereto for extending the patient support surface of the bed. In a preferred embodiment, a first side supplemental mattress assembly 312 is provided for the first side head deck extender assembly 232, and a second side supplemental mattress assembly 314 is provided for the second side head deck extender assembly 234 to increase the width of the surface supporting the patient. In a preferred embodiment, the width of the supplemental mattress is adapted to increase the width of the mattress of the bed approximately 5" per side, for a total mattress width increase of 10". Each of the supplemental mattress assemblies 312, 314 generally comprise a pivotable bolster plate 316, a supplemental mattress support plate 318 and a supplemental mattress 320. The supplemental mattresses are independently rotatably connected to the deck extender assemblies in both the retracted positions and the extended positions. It is further understood that in a preferred embodiment, the supplemental mattresses are connected to the bed in both the first position and the second position. An alternate embodiment to extend the patient support surface of the bed is also described herein.

As shown in FIGS. 12, 13, 15 and 18-20, the bolster plate 316 has a first arm 322 extending from one end of the bolster plate 316, and a second arm 324 extending from the opposing end of the bolster plate 316. The first arm 322 is pivotally connected to the head end rail 270 of the deck extender assembly, and the second arm 324 is pivotally connected to the foot end rail 272 of the deck extender assembly. Thus, in one embodiment the supplemental mattress assemblies 312, 314 can be rotated from a first lower position, as shown in FIG. 18, to a second upper position, as shown in FIG. 20, by rotating the bolster plate 316 as shown in FIG. 19. In the first lower position the supplemental mattresses are generally under a plane of the main deck 20, and in the second raised position the supplemental mattress are generally over the plane of the main deck 20.

In a first position, as shown in FIG. 18, the bolster plate 316 is generally underneath the deck plate 240. The bolster plate 316 has a top surface 326 and a lower surface 328. The supplemental mattress support deck or plate 318 is connected to a top surface 326 of bolster plate 316, and the supplemental mattress 320 is connected to the side of the support plate 318 opposing the bolster plate 316. Accordingly, via their connection to the bolster plate 316, the supplemental mattress 320 and mattress support plate 318 rotate or pivot with the bolster plate 316.

In the first position, as shown in FIGS. 3 and 18, the supplemental mattress 320 is positioned underneath the head deck plate 240. By rotating the supplemental mattress assembly 312 or 314 the bolster plate 316 is manipulated, as shown in FIG. 19, to the second position, as shown in FIG. 20, such that the lower surface 328 sits on or rests on the end plate 274 of the deck extender assembly 312 or 314.

Similar to the first side head deck extender assembly 232 being a mirror image of the second side head deck extender assembly 234 in a preferred embodiment, the first side supplemental mattress assembly 312 is preferably a mirror image of the second side supplemental mattress assembly 314. Accordingly, all components described herein with respect to the first side supplemental mattress assembly 312 are also found in their appropriate locations in the second side supplemental mattress assembly 314. Additionally, it is understood that in a preferred embodiment the supplemental mattress assemblies are adapted to operate independently.

Figure 11:
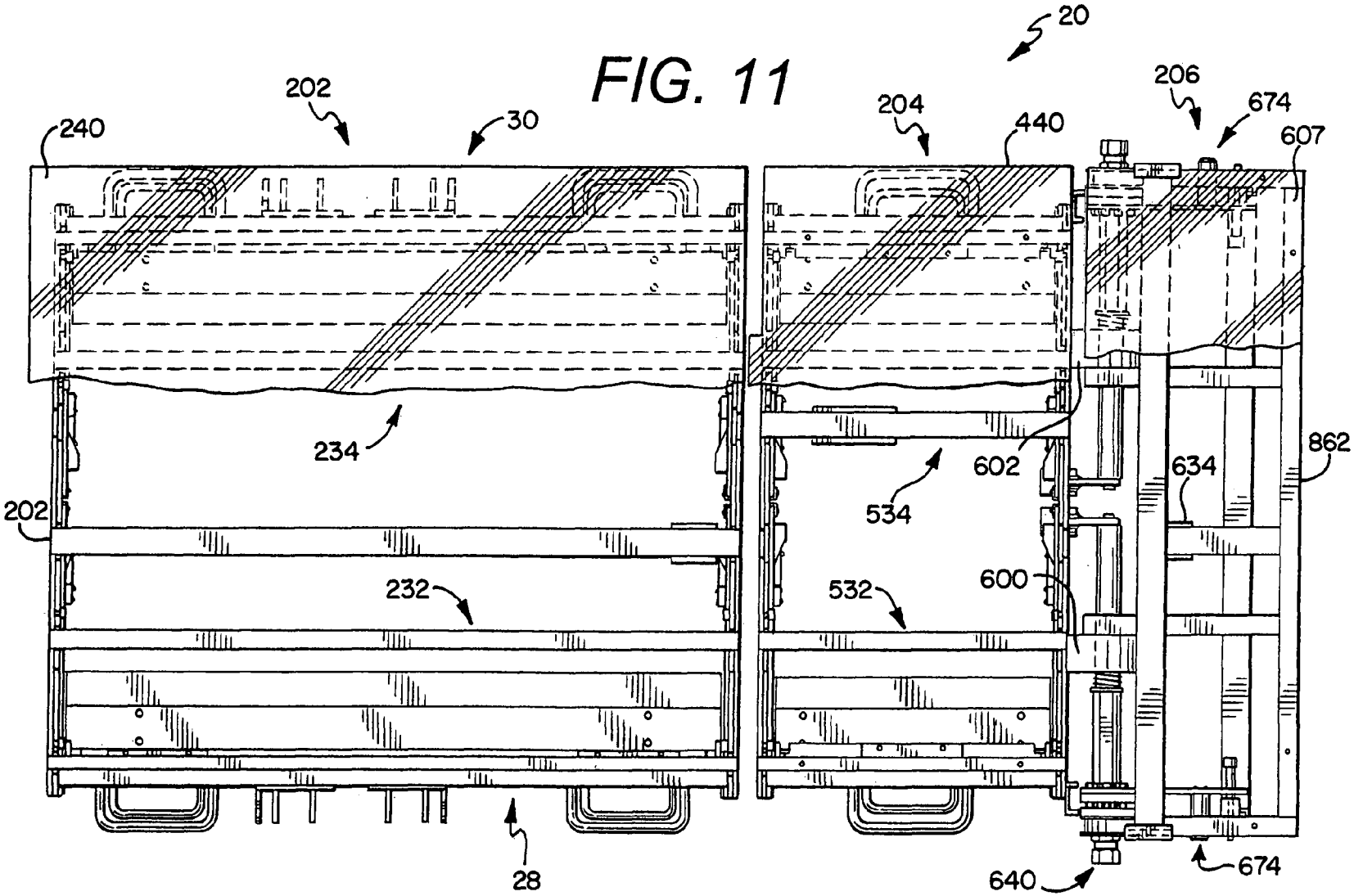
FIG. 11 is a top plan view of the deck sections of the hospital bed of FIG. 10.
Figure 14:
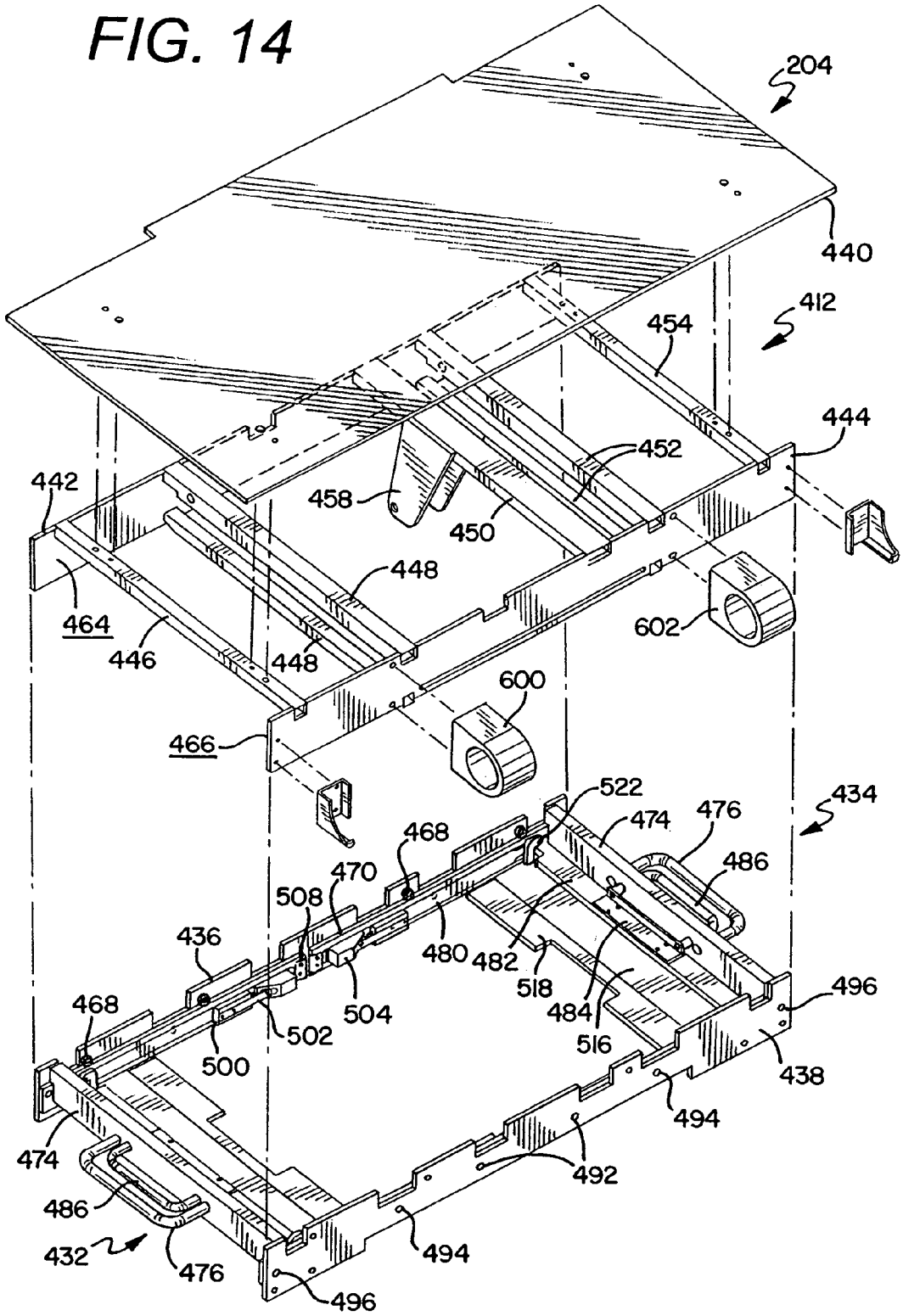
FIG. 14 is an exploded perspective view of one embodiment of a seat deck section for a hospital bed having an extension mechanism for expanding the width of the bed.

As shown in FIGS. 10, 11 and 14, in one embodiment of the bed the seat deck section 204 generally comprises a seat frame assembly 412 and a seat deck plate 440. Additionally, in one embodiment wherein the bed has a variable width component, like the head deck section 202, the seat deck section 204 also comprises a first side seat deck extender assembly 432 and a second side seat deck extender assembly 434. The first side seat deck extender assembly 432 is utilized to increase the width of the bed at the first side 28 of the bed 10, and the second side head seat extender assembly 434 is utilized to increase the width of the bed at the second side 30 of the bed 10. The deck extender assemblies 432, 434 are connected to the seat deck section 204 and allowed to move relative thereto with the use of a first seat deck roller plate 436 and a second seat deck roller plate 438.

The seat deck frame assembly 412 comprises a head end plate 442, a foot end plate 444 and a plurality of cross members connecting the head end plate 442 and the foot end plate 444 to provide sufficient rigidity and strength for the seat deck frame assembly 412. In one embodiment, the seat deck frame assembly 412 has one end cross member 446 adjacent the first side deck extender assembly 432, and one end cross member 454 adjacent the second side deck extender assembly 434. Additionally, a first pair of cross members 448 are utilized to support the frame assembly 412 and further to support a first hinge 600 for the foot deck section 206, and a second pair of cross members 452 are utilized to support the frame assembly 412 and further to support a second hinge 602 for the foot deck section 206. Finally, another of the cross members 450 has extending therefrom the clevis member 458 for connecting the piston of the seat deck section actuator 184.

The first seat deck roller plate 436 is fixedly connected to the head end plate 442 of the seat deck frame assembly 412 at the inner surface 464 thereof, and the second seat deck roller plate 438 is fixedly connected to the foot end plate 444 of the seat deck frame assembly 412 at the inner surface 466 thereof. The first and second side seat deck extender assemblies 432, 434 are then movably connected between a plurality of rollers 468 extending from the first and second seat deck roller plates 436, 438, as shown in FIGS. 14 and 15, similar to a drawer in a cabinet. Like the first and second side head deck extender assemblies 232, 234, the first and second side seat deck extender assemblies 432, 434 are also independently moveable from a first retracted position (see FIG. 18) to a second expanded position (see FIG. 20). Similarly, the supplemental mattresses on the first and second side seat deck extender assemblies 432, 434 are thus repositioned from a first retracted position (see FIG. 18) to a second expanded position (see FIG. 20). In one embodiment, the distance from the centerline of the bed 10 to an edge of the mattress 22 at the seat section is identified as distance $W_3$, and the distance from the centerline of the bed 10 to an edge of the supplemental mattress 320 after the supplemental mattress 320 is in the second expanded position at the seat deck section is identified as distance $W_4$, and $W_4$ is greater than $W_3$. In a preferred embodiment, the width of the supplemental mattress is approximately 5 inches, and thus the distance from $W_3$ to $W_4$ is approximately 5 inches. In one embodiment, however, the distance to the rotation position is an additional 7 to 7.5 inches from the expanded position (see FIG. 19).

As shown in FIGS. 14-17, the first and second side seat deck extender assemblies 432, 434 each generally comprise a head end rail 470, a foot end rail 472, and an endplate 474 connecting the head end rail 470 and the foot end rail 472. A handle 476 is secured to the endplate 474 to assist the user in grasping and manipulating the endplate 474. In one embodiment the seat deck extender assemblies utilize one handle 476, while the head deck extender assemblies utilize two handles 276 because of their increased size. The head end and foot end rails 470, 472 of the deck extender assemblies 432, 434 each have a recessed slot 478 for housing a pull rail 480 therein (see FIG. 15). The depth of the slot 478 is not the entire thickness of the end rail 470, 472, but instead is only slightly greater than the thickness of the pull rail 480, which is thinner than the end rails 470, 472. Thus, in a preferred embodiment slot 478 is not a thru slot. The pull rails 480, in conjunction with a number of additional components described herein, are utilized to release a plunger to allow the deck extender assemblies to be relocated between first, second and third positions.

The pull rails 480 are manipulated similar to pull rails 280 described above. Specifically, an interior release handle 486 is connected via a bracket 484 to a release bar 482 which engages the pull rails 480. The release handle 486 is shown in FIG. 16 in the non-actuated or non-engaged position. In the actuated or engaged position of FIG. 17, however, the release handle 486 is pulled toward the deck extender handle 476 to actuate the pull rails 480. A first end of the release bar 482 is connected to the pull rail 480 in the slot 478 of the head end rail 470, and a second end of the release bar 482 is connected to the pull rail 480 in the slot 478 of the foot end rail 472. The pull rails 480 are free to traverse in the slots 478 when the release handle 486 is actuated (subject to the spring force of the spring 510 described below).

As shown in FIG. 15, the pull rails 480 have a plurality of thru slots. A first slot 488 is provided as an opening to allow the plunger 490 to pass through the pull rail 480 and the appropriate end rail 470, 472, and also mate with a plurality of apertures 492, 494, 496 in the first and second seat deck roller plates 436, 438 (see FIG. 14). A second slot 498 is provided to allow for fasteners to secure a support block 500, supporting a leaf spring 502 connected to the plunger 490, directly to each of the head end and foot end rails 470, 472. Specifically, one support block 500 (with the leaf spring 502 and plunger 490) is fixedly connected to the head end rail 470, and another support block 500 (also with a leaf spring 502 and plunger 490) is fixedly connected to the foot end rail 472. The slot 498 in the pull rails 480 allows the support blocks 500 to be positioned adjacent the pull rails 480, but to be fixed to the respective head and foot end rails 470, 472. Accordingly, when the pull rails 480 are manipulated via the release handle 486 the support blocks 500 do not move. Instead, the support blocks 500 move only in direct relation to the head and foot end rails 470, 472.

An angle block 504 is connected to the pull rails 480 adjacent the support block 500, and as such any movement of the angle block 504 is a direct result and in direct relation to movement of the pull rails 480. The angle block 504 has a slot 506 that mates with the first slot 488 in the pull rail 480. When the components are assembled, the plunger 490 connected to the support block 500 extends through both the slot 506 in the angle block 504 and the slot 488 in the pull rail 480 and mates with one of the apertures 492, 494, 496 in the first and second seat deck roller plates 436, 438.

A stop 508 is connected at the end of the pull rail 480. The stop 508 prevents the deck extender assemblies 432, 434 from becoming disassembled from the appropriate deck section in the partially-deployed position of FIG. 19. The deck extender assemblies 432, 434 also have a spring 510 provided in a cutout in the support block 500. The spring 510 exerts a spring force on the angle block 504. The force exerted on the angle block 504 is translated to the pull rails 480, the release bar 482 and the release handle 486, thereby providing a force to maintain these components in the non-engaged and non-actuated position as shown in FIG. 16. Only by exerting a force on the release handle 486 greater than the spring force of the two springs 510 will the release mechanism of the deck extender assemblies 432, 434 be actuated.

In a preferred embodiment, the first side seat deck extender assembly 432 is a mirror image of the second side seat deck extender assembly 434. Accordingly, all components described herein with respect to the first side seat deck extender assembly 432 are also found in their appropriate locations in the second side seat deck extender assembly 434. Additionally, it is understood that in a preferred embodiment the deck extender assemblies operate completely independently. Accordingly, any deck extender assembly of the bed may be in the retracted or non-deployed position, the partially deployed position, or the expanded or deployed position at any time, irrespective of any other deck extender assembly.

Like the head deck extender assemblies, in the retracted or non-deployed position as shown in FIG. 18, the seat deck extender assemblies 432, 434 are generally underneath the seat deck plate 440. Further, in the retracted position of the plungers 490 of the deck extender assembly 432, 434 are positioned in the first aperture 492 of the seat deck roller plates 436, 438, respectively. To move the deck extender assemblies 432, 434 to the extended or deployed position as shown in FIG. 20, the user actuates the release handle 486 by pulling the release handle 486 toward the deck extender handle 476. When the release handle 486 is actuated, the pull rails 480 are manipulated in the slots 478 of the head end and foot end rails 470, 472, thereby moving the angle block 504 toward the support block 500 (See FIGS. 16 and 17). The angled surface on the angle block 504 engages the leaf spring 502 to lift the leaf spring 502 and release the plunger 490 from the first aperture 492. When the plunger 490 is released from the first aperture 492 the deck extender assembly 432 or 434 is free to traverse to the extended position, wherein the plunger 490 will mate with or engage the second aperture 494 and secure the deck extender assembly 432 or 434 in the extended position. Similarly, the extended or deployed position is approximately 5" from the original non-deployed position.

A third position, shown in FIG. 19 and referred to as the partially deployed position, occurs when the deck extender assembly 432 or 434 is manipulated, following the steps outlined above, such that the plunger 490 mates with the third aperture 496. As is explained below in detail, when the deck extender assembly 432 or 434 is in the partially deployed position, which is out approximately an additional 7" further extended than the deployed position, a supplemental mattress assembly is free to be rotated from a first position below the deck to a second position at deck level. After the supplemental mattress assembly is rotated to the second position, the deck extender assembly 432 is then manipulated to the extended position as shown in FIG. 20. To place the supplemental mattress assembly in the first position under the deck and to move the deck extender assembly 432 or 434 back to the retracted position, a reverse process of the above is performed.

In a preferred embodiment each of the deck extender assemblies 432, 434 also has a supplemental mattress assembly connected thereto for extending the patient support surface of the bed. In a preferred embodiment, a first side supplemental mattress assembly 512 is provided for the first side seat deck extender assembly 432, and a second side supplemental mattress assembly 514 is provided for the second side seat deck extender assembly 434. Each of the supplemental mattress assemblies 512, 514 generally comprise a pivotable bolster plate 516, a supplemental mattress support plate 518 and a seat deck supplemental mattress 520. An alternate embodiment to extend the patient support surface of the bed is also described herein.

As shown in FIGS. 12-20, the bolster plate 516 has a first arm 522 extending from one end of the bolster plate 516, and a second arm 524 extending from the opposing end of the bolster plate 516. The first arm 522 is pivotally connected to the head end rail 470 of the deck extender assembly, and the second arm 524 is pivotally connected to the foot end rail 472 of the deck extender assembly. Thus, in one embodiment the supplemental mattress assemblies 512, 514 can be rotated from a first lower position, as shown in FIG. 18, to a second upper position, as shown in FIG. 20, by rotating the bolster plate 516 as shown in FIG. 19. In the first lower position the supplemental mattresses are generally under a plane of the main deck 20, and in the second raised position the supplemental mattress are generally over the plane of the main deck 20. In a preferred embodiment, however, the supplemental mattresses are always connected to the bed.

In a first position, as shown in FIG. 18, the bolster plate 516 is generally underneath the seat deck plate 440. The bolster plate 516 has a top surface 526 and a lower surface 528. The supplemental mattress support plate 518 is connected to a top surface 526 of bolster plate 516, and the seat supplemental mattress 520 is connected to the side of the support plate 518 opposing the bolster plate 516. Accordingly, via their connection to the bolster plate 516, the supplemental mattress 520 and mattress support plate 518 rotate or pivot with the bolster plate 516.

In the first position, as shown in FIGS. 3 and 18, the seat supplemental mattress 520 is positioned underneath the seat deck plate 440. By rotating the supplemental mattress assembly 512 or 514 the bolster plate 516 is manipulated, as shown in FIG. 19, to the second position, as shown in FIG. 20, such that the lower surface 528 sits on or rests on the end plate 474 of the deck extender assembly 512 or 514.

Similar to the first side seat deck extender assembly 432 being a mirror image of the second side seat deck extender assembly 434 in a preferred embodiment, the first side supplemental mattress assembly 512 is preferably a mirror image of the second side supplemental mattress assembly 514. Accordingly, all components described herein with respect to the first side supplemental mattress assembly 512 are also found in their appropriate locations in the second side supplemental mattress assembly 514. Additionally, it is understood that in a preferred embodiment the supplemental mattress assemblies are adapted to operate independently.

As shown in FIGS. 8-11, the support deck assembly 20 of the patient support assembly 19 also comprises a foot deck section 206. In one embodiment the foot deck assembly 206 does not have a deck extender assembly, but in alternate embodiment a foot deck extender assembly is possible and within the scope of the present invention. The foot deck section 206 is pivotally mounted to the bed 10 and/or chair bed 10 for movement about a pivot axis between a generally horizontal up position, as shown in FIG. 3, and a generally vertical downwardly extending position, as shown in FIG. 35. In a preferred embodiment, the foot deck section 206 has a fixed constant length at all times, including in the horizontal up position and the downwardly extending position. When the foot deck section 206 is in the downwardly extending position, a foot end 26 edge 862 of the foot deck section 206 is still a distance from a floor supporting the chair bed 12.

As shown in FIG. 11, the foot deck section 206 is adjacent the seat deck section 204, and is pivotally/rotatably connected to the seat deck section 204, and more specifically to the hinges 600, 602 extending from the seat deck section 204. All references to the terms rotate and pivot (or any variation of these terms) herein, are expressly not limited to movement about an axis or a center.

Figure 25:
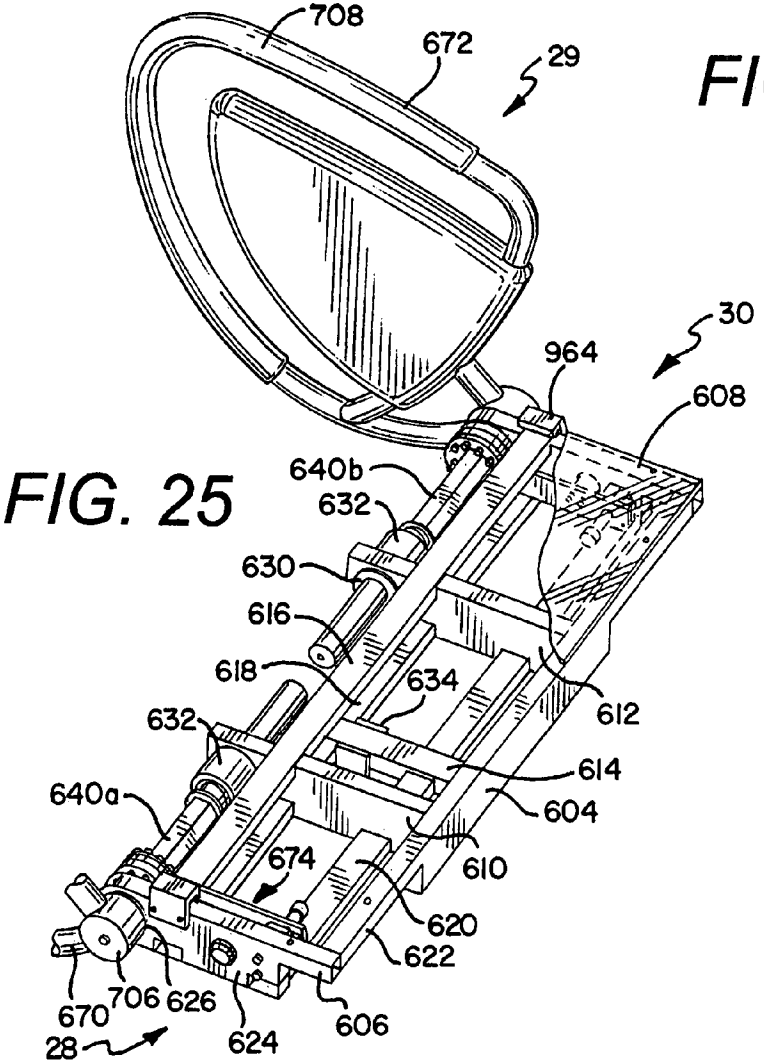
FIG. 25 is a perspective view of one embodiment of a foot deck section for a hospital bed.

In one embodiment, as shown in FIGS. 11 and 25, the foot deck section 206 includes a foot frame 604 and foot deck plate 207. Preferably, the foot frame 604 has first and second opposing outer frames 606, 608, first and second inner frames 610, 612, an actuator connecter member 614, and first, second, third and fourth cross members 616, 618, 620 and 622. In the embodiment illustrated, the foot frame 604 is a metal weldment made of rectangular tubing, however, one of ordinary skill in the art would readily understand that any size or shape tubing, bar stock, round stock, bent flat stock, etc. is acceptable and would perform adequately without departing from the scope and spirit of the present invention.

Figure 26:
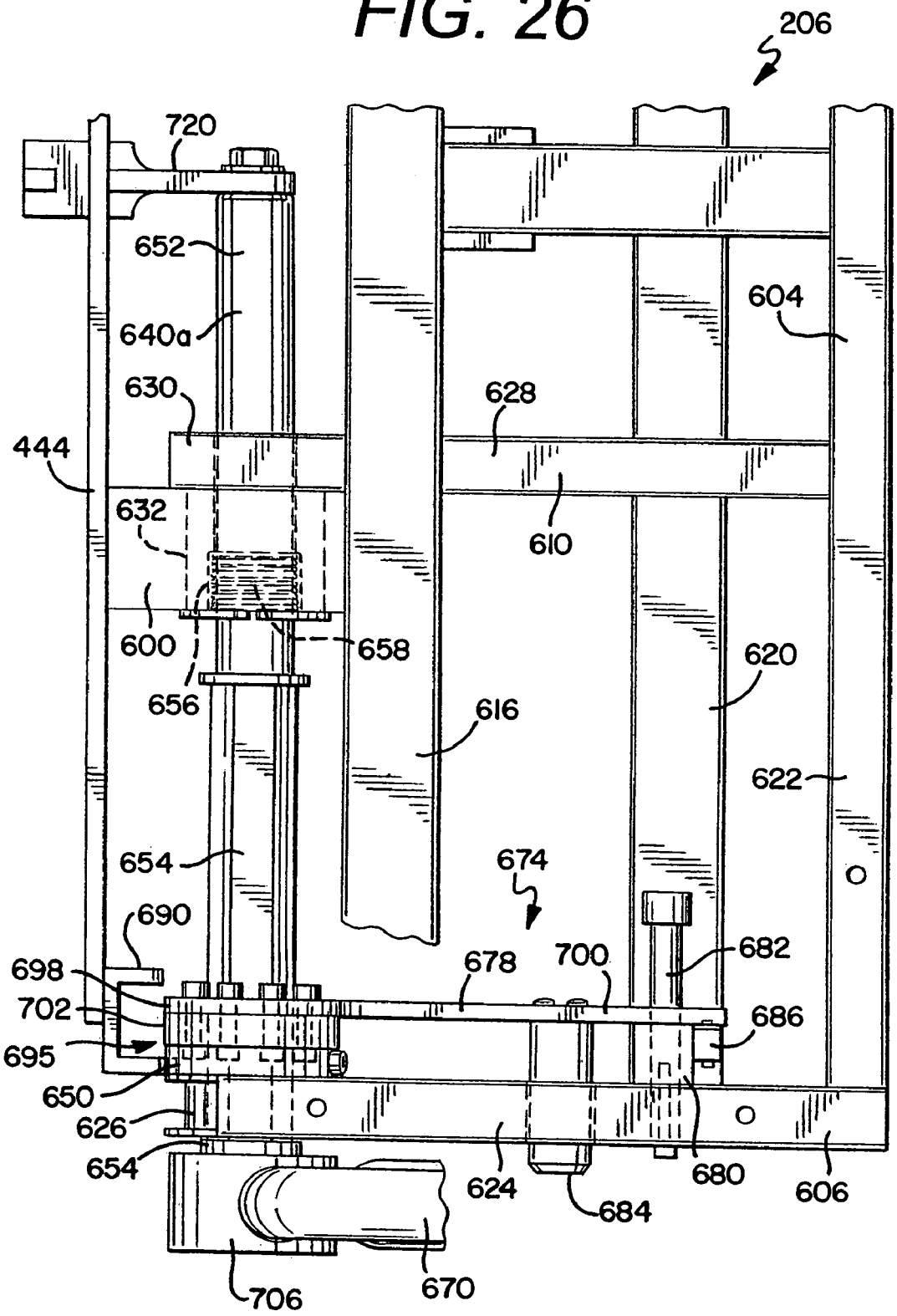
FIG. 26 is a partial top view of the actuation assembly for the foot deck section of FIG. 25 in the engaged position.
Figure 27:
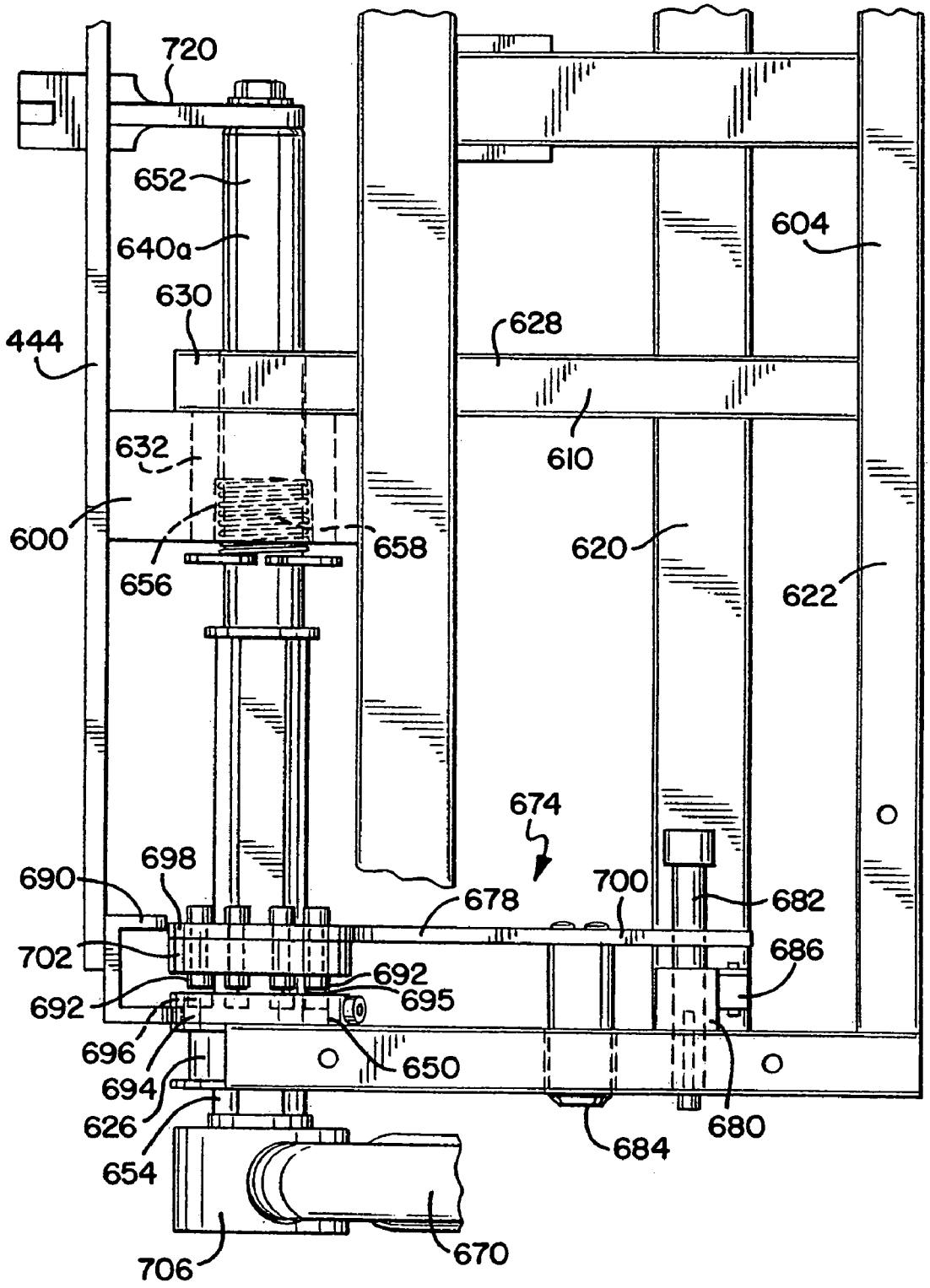
FIG. 27 is a partial top view of the actuation assembly for the foot deck section of FIG. 25 in the non-engaged position.

As shown in FIGS. 26 and 27, the first and second outer frames 606, 608 of the foot frame 604 are generally comprised of a frame component 624 and a bushing member 626. The bushing member 626 is seated in the frame component 624 and is utilized to rotatably seat a first coupling member 650 of the coupling assembly. Similarly, the first and second inner frames 610, 612 are generally comprised of a frame component 628 and a bushing member 630. Bushing member 630 is seated in the frame component 628, but also has a flange portion 632 extending beyond the frame component 628. As is explained later herein, the flange portion 632 of the bushing member 630 engages the respective hinge 600, 602 extending from the seat deck section 204 to allow for rotating/pivoting of the foot deck section 206.

With respect to the members of the foot frame 604, a first end of the cross members 616, 618, 620 and 622 is connected to the frame component 624 of the first outer frame 606, and the second end of the cross members 616, 618, 620 and 622 is connected to the frame component 624 of the second outer frame 608. And, the actuator connector member 614 is connected between the second, third and fourth cross members 618, 620 and 622. The actuator connector member 614 has a clevis 634 extending therefrom for connecting the piston 636 of the foot deck actuator 186 to the foot frame 604. The foot deck actuator 186 is also connected to the intermediate frame 180 at a clevis 187 extending from the fourth cross member 194 of the intermediate frame 180 (see FIGS. 8 and 9). The foot deck actuator 186 assists in adjusting the angle of rotation of the foot deck 206, and also moving the foot deck 206 from the generally horizontal position (see e.g., FIG. 1) to the a substantially vertical position (see e.g., FIG. 35), and all positions therebetween.

In one embodiment the foot deck section 206 generally pivots or rotates about a foot deck pivot axis as shown in FIGS. 9 and 11. In a preferred embodiment, the foot deck pivot axis extends about a longitudinal axis of the shaft 640 connecting the foot deck section 206 to the seat deck section 204, and thus the foot deck section 206 can be said to pivotally extend from the seat deck section 204. Referring to FIGS. 11 and 25, in a most preferred embodiment the shaft 640 about which the foot deck section 206 pivots or rotates has a first side shaft component **640*a* and a second side shaft component 640*b*. The first side shaft 640*a* generally extends from a point adjacent a midline of the bed 10 toward the first side 28 of the bed 10, and the second side shaft 640*b* generally extends from a point adjacent a midline of the bed 10 toward the second side 30 of the bed 10**.

As shown in FIG. 11, the foot deck section 206 is adjacent the seat deck section 204, and is pivotally/rotatably connected to the hinges 600, 602 extending from the seat deck section 204. To accomplish such, the first side shaft **640*a* is seated at a first portion of its length within one of the bushing members 630 of the first inner frame 610, and at a second portion of its length within the coupling 650 of the first outer frame 606. Similarly, the second side shaft 640*b* is seated at a first portion of its length within one of the bushing members 630 of the second inner frame 612, and at a second portion of its length within the coupling 650 of the second outer frame 608**.

In one embodiment, the foot deck section 206 is pivotably or rotatably connected at the engagement between the hinges 600, 602 and the flange portion 632 of the bushing members 630. As shown in FIG. 11, the hinges 600, 602 have a bore which engages the outer surface of the flange portion 632 of the bushing members 630. Specifically, the first hinge 600 engages the flange portion 632 of the bushing member 630 in the first inner frame 610 to support the first side shaft **640*a*, and the second hinge 602 engages the flange portion 632 of the bushing member 630 in the second inner frame 612 to support the second side shaft 640*b*. Such engagement allows the foot deck section 206 to pivot or rotate about the central axis of the hinge members 600, 602 in response to forces by the foot deck actuator 186 on the foot deck frame 604. The shafts 640*a*, 640*b* also engage the foot deck frame 604 at the first and second outer frame members 606, 608**, respectively.

As shown in FIGS. 11 and 25-27, each of the shafts **640*a*, 640*b* has a cylindrical portion 652 and a non-cylindrical portion 654. The non-cylindrical portion 654 may have an hexagonal cross-sectional configuration. The cylindrical portions 652 of shafts 640*a*, 640*b* are provided adjacent the inner frames 610, 612 of the foot frame 604 to allow the foot deck assembly 206 to rotate within the bushing member 630 at the inner frames 610, 612. The non-cylindrical portions 652** are utilized to engage the coupling assembly.

The diameter of the cylindrical portions 652 of the shafts **640*a*, 640*b* is approximately equal to the diameter of the bore of the bushings 630 at the first and second inner frames 610, 612. The bushings 630, however, also have a counterbore portion 656 generally within the flange portion thereof 632 as best shown in FIGS. 26 and 27. The counter bore 656 is utilized to house a spring 658 which provides a force to bias the shafts 640***a*, 640*b* outward such that the projections 692 extending from the reaction arm 678 are positioned within mating apertures 696 of the coupling member 650 in the engaged state of the activation mechanism.

While the foot deck section 206 is adapted to pivot or rotate within the hinges 600, 602 to rotate or pivot the foot deck section 206 from the horizontal position to the vertical position, the shafts 640*a*, 640*b* can also independently rotate to allow either of the pair of second siderails 29 to independently move from the first position, wherein the siderail is a barrier positioned above the top patient support surface, to the second position wherein the siderail is moved generally below the top patient support surface.

In one embodiment, the footboard 25, as shown in FIG. 42, is removably connected to the foot deck section 206. The footboard 25 generally comprises a footboard frame or, support member 697, having first and second arms, and a footboard barrier 699. The footboard barrier 699 is generally fixedly connected to the footboard frame 697, and preferably is fixed in a transverse relationship. As such, the footboard support member 697 generally extends in a plane parallel to the plane of the foot deck section 206. The first and second arms of the footboard frame 697 extend into apertures 691 at the foot end 26 of the foot deck frame 604. Typically, the footboard 25 is only connected to the bed 10 when the support assembly 19 is in the horizontal or flat position. The bed 10 contains a sensor that can sense the existence of the footboard 25 being connected to the bed 10. When the sensor senses the footboard 25 connected to the bed 10, the actuators of the bed 10 prevent the bed 10 from being positioned into the chair position (i.e., the foot deck actuator 186 is precluded from moving the foot deck section 206 into the substantially vertical position of a chair configuration). Conversely, when the sensor senses that the footboard 25 is not connected to the bed 10, the bed 10 is free to be reconfigured into the chair configuration.

The second pair of siderail assemblies 29 generally comprises a first foot end siderail 670 located at the first side 28 of the bed, and a second foot end siderail 672 at the second side 30 of the bed. In one embodiment, the foot end siderails 670, 672 are operably connected to the foot deck section 206 of the bed and remain stationary relative to the foot deck section 206 during movement of the foot deck section 206 between the generally horizontal position and the substantially vertical position. Referring to FIGS. 25-27, in a preferred embodiment the first foot end siderail 670 is connected to the first side shaft 640*a*, and the second foot end siderail 672 is connected to the second side shaft 640*b*. The first and second foot end siderails 670, 672 are moveable from a first position (see FIG. 1), wherein they generally provide a barrier preventing the patient from unintentional exit off the bed either of the sides 28, 30 thereof, to a second position (see FIG. 3), wherein a barrier is not provided above the patient support surface. Each of the foot end siderails 670, 672 are independently moveable from the first position to the second position. Additionally, in one embodiment the foot end siderails 670, 672 are adapted to be fixed to the first position, wherein the foot end siderails 670, 672 remain stationary relative to the foot deck section 206 during movement of the foot deck section 206. A controller (not shown) for the bed may be connected to either or both of the siderails 670, 672 and/or handles.

To provide for both fixed retaining of the siderails 670, 672 to the foot deck section 206 and independent movement of the siderails 670, 672 relative to the foot deck section 206, a lock or locking assembly 674 is provided. The locking assembly 674 is moveable from an engaged state (shown in FIG. 26), wherein the siderail 670, 672 is fixed in the first position relative to the foot deck section 206 and generally has at least a portion of the siderail barrier 676 positioned above the patient support deck 20, and a disengaged state (shown in FIG. 27), wherein the siderail 670, 672 is free to rotate independent of the foot deck section 206 and is moveable to a second position (shown in FIG. 3) having at least a portion of the siderail barrier 676 positioned below the patient support deck 20.

In one embodiment the locking mechanism 674 comprises the coupling assembly, a reaction arm 678, a reaction block 680, a slider shaft 682, an activator 684, a first sensor 686, a second sensor 688 and a stop 690. The coupling assembly generally comprises the first coupling member 650, the reaction arm 678 and a plurality of projections 692 extending from the reaction arm 678. The coupling member 650 has an interior bore having a cross-sectional geometry which matches the cross-sectional geometry of the non-cylindrical portion 654 of the shaft 640*a*, 640*b*. The coupling member 650 also has a first flange 694 and a second flange 695. The first flange 694 generally has a larger outside diameter than the second flange 695, and the second flange 695 extends longitudinally from the first flange 694. The first flange 694 has a plurality of apertures 696 in its side face which are provided in a configuration identical to the configuration of the projections 692 extending from the reaction arm 678 (see FIGS. 28 and 29). In the engaged state the projections 692 extending from the reaction arm 678 are positioned within mating apertures 696 in the coupling member 650. In such a configuration wherein the projections 692 are provided within the apertures 696 in the coupling member 650, the shaft 640*a*, 640*b* is fixed to the reaction arm 678 of the locking mechanism 674. The configuration of the projections 692 and mating apertures 696 only allows engagement between the two components when the siderail 670, 672 is in the first position. Accordingly, the reaction arm 678 cannot engage the coupling member 650 when the siderail 670, 672 is in the second position.

The reaction arm 678 has an engaging portion 698, also referred to as a cylindrical portion 698 due to its geometrical configuration in one embodiment, and a longitudinal portion 700. In one embodiment the cylindrical portion 698 of the reaction arm has a cylindrical spacer 702 connected thereto. The cylindrical portion 698 of the reaction arm 678 and the cylindrical spacer 702 have a central bore which mates with the outer diameter of the second flange 695 of the coupling member 650. Accordingly, unless restricted, the reaction arm 678 and cylindrical spacer 702 are free to rotate on the second flange 695, and similarly, the second flange 695 is free to rotate within the bore of the reaction arm 678 and cylindrical spacer 702 unless restricted. The longitudinal portion 700 of the reaction arm 678 extends past the reaction block 680 and adjacent the first sensor 686. Additionally, the activator 684 is connected to the longitudinal portion 700 of the reaction arm 678. The activator 684 also extends through an aperture in the appropriate outer frame member 606, 608 of the foot deck frame 604.

The reaction arm 678 generally has two connection points for fixing the relative position of the reaction arm 678. The first connection point is adjacent the reaction block 680. The reaction block 680 is fixed with a plurality of fasteners to the appropriate outer frame 606, 608. Further, a slider shaft 682 is fixed to the reaction block 680. In a preferred embodiment the slider shaft 682 is a shoulder bolt. The reaction arm 678 has an aperture in the longitudinal portion 700 thereof which mates with the slider shaft 682. Accordingly, the reaction arm 678 can move from a first position, where the longitudinal portion 700 of the reaction arm 678 contacts the reaction block 680, to a second position about the longitudinal axis of the slider shaft 682, wherein the longitudinal portion 700 of the reaction arm 678 is spaced a distance from the reaction block 680. The first position is the engaged position, wherein the projections 692 extending from the reaction arm 678 are positioned within mating apertures 696 in the coupling member 650 to fix the siderails relative to the foot deck section 206. The second position is the disengaged position, wherein the projections 692 are spaced a distance from the apertures 696 and thus not engaged thereby to allow the shaft 640*a*, 640*b*, the coupling member 650 connected thereto, and the foot end siderails 670, 672 to rotate freely. To move the reaction arm 678 from the first position to the second position the activator 684 is pushed in at the outside of the appropriate outer frame member 606, 608 of the foot deck frame 604. The activator 684 operates to enable the siderail 670, 672 to change from the engaged state to the disengaged state.

Figure 28:
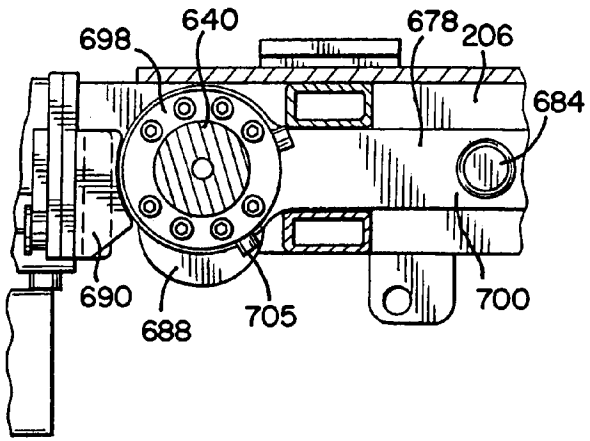
FIG. 28 is a partial side elevation view of the actuation assembly of FIG. 26.
Figure 29:
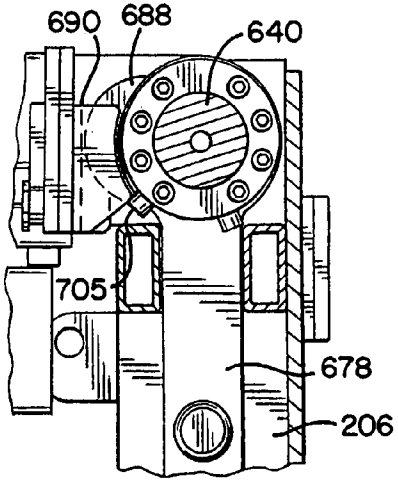
FIG. 29 is a partial side elevation view of the actuation assembly of FIG. 27.

As shown in FIGS. 28 and 29, the reaction arm 678 also has a second sensor 688 connected thereto. The second sensor 688 is preferably a mechanical sensor that is a metal cam that engages a stop 690 in certain positions to preclude the reaction arm 678 of the locking mechanism 674 from being placed in the disengaged state, thereby precluding the foot end siderails 670, 672 from being taken out of the first position and precluding movement of the reaction arm 678 to the second position when the foot deck section 206 is in various position (i.e., locking the activator). For example, this aspect of the locking mechanism 674 (i.e., the cam second sensor 688 and the stop 690) prevents the siderails 670, 672 from being movable to their second position when the foot deck section 206 is in the substantially vertical chair position, and generally any position past 30° from the horizontal. Instead, when the foot deck section 206 is in the chair position, the siderails 670, 672 adjacent the foot deck 206 remain above the patient support surface for the patient to use as a handrail. First and second stops 690 are secured to the seat deck section 204 adjacent the appropriate hinges 600, 602. The configuration of the stop 690 and the cam sensor 688 operates to only allow the foot deck siderails 670, 672 from being manipulated to the second position at certain positions of the foot deck 206 (generally when the foot deck section 206 is less than 30° form the horizontal position). Another stop 705 is provided on the coupling member 650 to contact the stop 690 and prevent the foot deck assembly 206 from extending angularly past the vertical position from the horizontal position.

The first sensor 686 is typically a proximity switch that can sense the existence of the longitudinal portion 700 of the reaction arm 678 when the reaction arm 678 is in the engaged position. When the proximity switch 686 does not sense the existence of the reaction arm 678 in the engaged position, the sensor 686 sends a signal to a controller of the bed to preclude the foot deck actuator 186 from moving the foot deck section 206 into the substantially vertical position of a chair configuration. Thus, the foot deck siderails 620, 622 cannot be rotated to the second lower position when the foot deck 206 is in the chair position, and similarly when the siderails are in the disengaged position and allowed to rotate to the second position the foot deck section 206 is prevented from rotating to the chair position.

The foot end siderails 670, 672, or alternately handles, are generally rotatably coupled to the foot deck section 206 in the preferred embodiment. In one embodiment, the foot end siderails 670, 672 are removably fixed to their appropriate foot deck shaft 640*a*, 640*b*, and are manipulated by allowed movement of the shaft 640*a*, 640*b*. Each siderail 670, 672 generally comprises a connection member 706, and a barrier 708. In one embodiment the connection member 706 has an internal non-cylindrical bore that mates with the non-cylindrical portion 654 of the shaft. A removable fastener is then secured therebetween to fix the siderail to the shaft. The siderails 670, 672 are provided not only as barriers, but as handles to assist the patient in moving out of the foot end 26 of the chair bed 12. Because the siderails 670, 672 are fixed to the shaft 640*a*, 640*b* in the engaged state, and because the shaft 640*a*, 640*b* is fixed to the foot deck section 206 through the reaction arm 678 of the locking mechanism, in the engaged state the siderails 670, 672 are also fixed to the foot deck section 206 and have relative movement therewith the foot deck section 206. Thus, as the foot deck section 206 is rotated from the generally horizontal position to the substantially vertical position, the foot end siderails 670, 672 also rotate therewith. The patient can hold onto the foot end siderails 670, 672 during this rotation to advance the patient toward the foot end 26 of the chair bed 10 for easier exit therefrom and entrance thereto. The patient can also grasp the siderails as handles when exiting and entering the chair bed 10.

Because the foot end siderails 670, 672 are independently fixed to their respective shaft 640*a*, 640*b*, the foot end siderails 670, 672 move from their first position to their second position through rotational movement. Thus, the barrier portion 708 of the siderails 670, 672 moves in a single plane from the first position above the support deck 20 to the second position below the support deck to provide full access to the patient on the top surface of the mattress 22. The barrier portion 708 is configured to be conveniently gripped by the patient while entering and exiting the bed. Additionally, in alternate embodiments controls (such as a control button or switch) and/or a controller are integral with any of the siderail assemblies identified herein. Such controls may be provided in the foot end siderails 670, 672 and utilized to lower the foot deck section 206 from the generally horizontal position to the substantially vertical position. By having controls in the siderail assemblies the patient can hold onto the foot end siderails 670, 672 and lower the foot deck section 206 simultaneously at a controlled rate to assist in both rotating the foot deck section 206 and advancing the patient toward the foot end 26 of the bed for easier exit therefrom.

Each of the foot end siderails 670, 672 can also independently slide inward and outward about the longitudinal axis of their respective shafts 640*a*, 640*b*. As shown in FIGS. 26 and 27, in one embodiment the opposing ends of the shafts 640*a*, 640*b* are connected to brackets 720 that contact the respective seat deck extender assemblies 432, 434. Accordingly, in one embodiment as either of the seat deck extender assemblies 432, 434 are extended outwardly to increase the width of the bed, the foot end siderail 670, 672 at that side of the bed can also move outwardly. To accomplish such, each shaft 640*a*, 640*b* merely independently slides about its axis such that the cylindrical portion 652 of each shaft slides in bushings 630, and the non-cylindrical portion 654 of each shaft slides in the coupling member 650. When the seat deck extender assemblies 432, 434 are pushed back inward to their first position, the foot end siderails 670, 672 will also move inwardly therewith to their standard position. The brackets 720 operate as stops that contact the seat deck extender assemblies. In one embodiment, the brackets 720 also engage another stop which prevents the siderails 670, 672 from extending out past the deployed position of the seat deck extender assemblies 432, 434 (i.e., the siderails 670, 672 only extend outwardly a maximum of approximately 5". Accordingly, in this embodiment the siderail 670, 672 is moveable from a first position generally adjacent the support deck and located a first distance from a centerline of the bed 10, to a second laterally outward position located a second distance from the centerline of the bed 10, the second distance being greater than the first distance.

The bed 10 also incorporates a variety of lock-out features. For example, when the seat deck actuator 184 is extended, the foot deck actuator 186 is locked out and cannot retract, however, when the seat actuator 184 is fully retracted the foot actuator 186 can retract. When the foot actuator 186 is retracted the seat actuator 184 shall be locked out and prevented from extending. When the foot end siderails 29 or handles are in the second or down position, the foot actuator 186 is locked out and cannot retract. When the bed 10 is in a reverse Trendelenburg position, the foot actuator 186 is locked out and cannot retract, and when the foot actuator 186 is retracted, the bed 10 is prevented from moving to the reverse Trendelenburg position.

As explained above, the bed also has a first set of siderails 27. In one embodiment the first set of siderails 27 are provided toward the head end 24 of the bed. The first set of siderails 27 generally comprise a first head end siderail 800 located at the first side 28 of the bed, and a second head end siderail 802 located at the second side 30 of the bed. In one embodiment, the head end siderails 800, 802 are operably connected to the head deck section 202 of the bed and remain stationary relative to the head deck section 202 during movement of the head deck section 202 between the generally horizontal position and a more vertical back support position. In alternate embodiments, either of the sets of siderails 27, 29 may be connected to any frame of the bed, but typically the intermediate frame. Additionally, the head end siderails 800, 802 may be connected to the seat deck section 204, the seat deck extenders, or any other support deck.

Referring to FIGS. 10-13, in a preferred embodiment the first head end siderail 800 is connected to the first side head deck extender assembly 232, and the second head end siderail 802 is connected to the second side head deck extender assembly 234. The first and second head end siderails 800, 802 are moveable from a first position (see FIG. 1), wherein they generally provide a barrier preventing the patient from unintentional exit off the bed either of the sides 28, 30 thereof, to a second position (see FIG. 3), wherein a barrier is not provided above the patient support surface. Each of the head end siderails 800, 802 are independently moveable from the first position to the second position. In both the first and second positions the head end siderails 800, 802 are adapted to remain stationary relative to the head deck section 202 during movement of the foot deck section 202.

Figure 21:
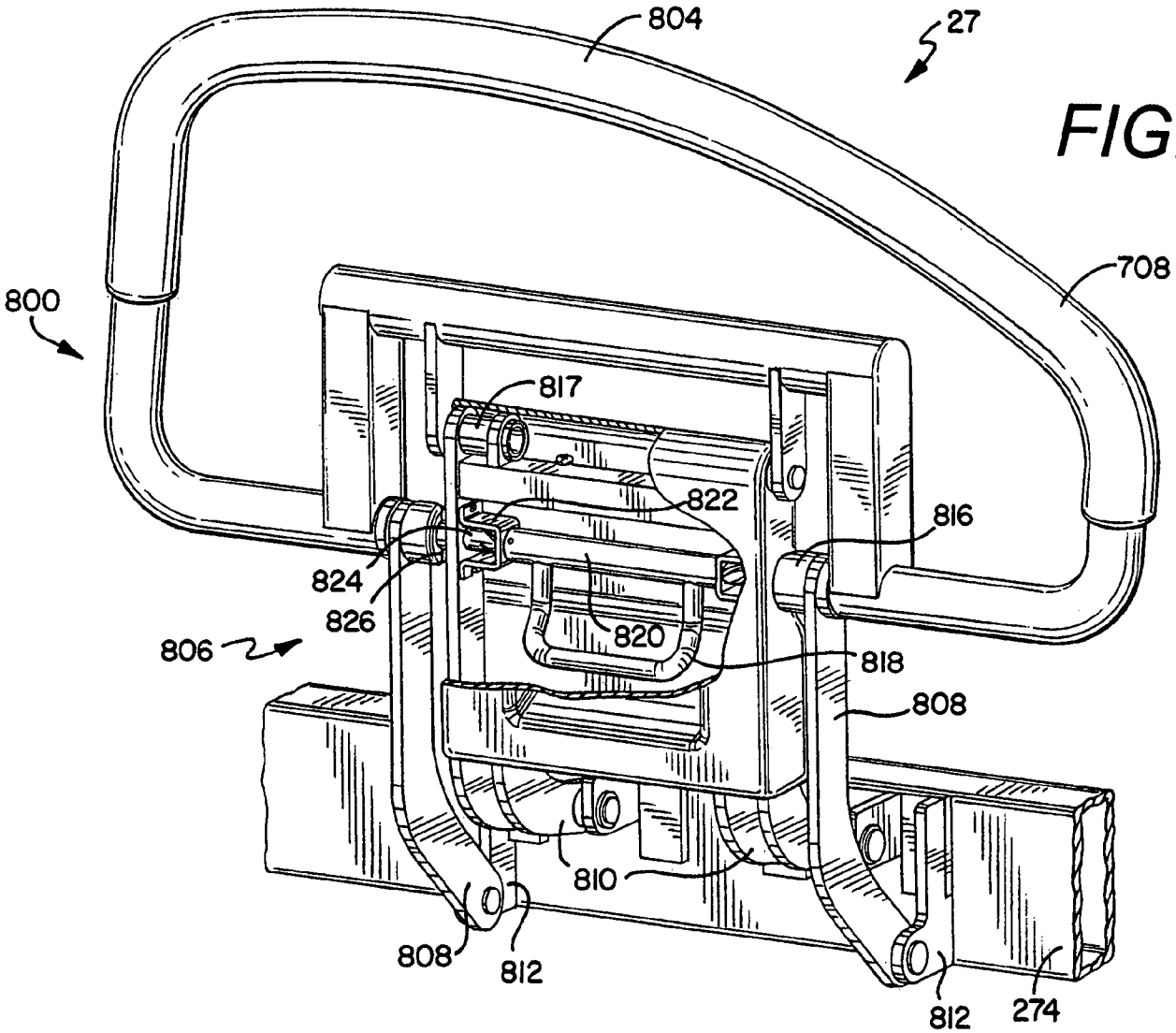
FIG. 21 is a perspective view of one embodiment of the head end siderail assembly.

As shown in FIGS. 1 and 21 each of the head end siderails 800, 802 comprises a handle component 804, a handle release mechanism 806, first and second outer linkages 808, first and second pairs of inner linkages 810, first and second brackets 812, and a handle housing 814. The first and second brackets 812 are connected to the bed, and in one embodiment they are connected to the endplate 274 of the respective head deck extender assembly 232, 234. The first outer linkage 808 and the first pair of inner linkages 810 are pivotally connected at one end to the first bracket 812, and the second outer linkage 808 and second pair of inner linkages 810 are pivotally connected at one end to the second bracket 812. The second end of the first outer linkages 808 are pivotally connected to the handle 804 adjacent a locking block 816. Similarly the and first and second pair of inner linkages 810 are pivotally connected to the inner frame 817 of the siderails 800, 802. As such, the first and second outer linkages 808, and first and second pairs of inner linkages 810 form a four-bar linkage for each head siderail 800, 802. In the first position, wherein the siderails 800, 802 are fixed in the up position, the four-bar linkage is locked together. To move the siderails 800, 802 to the second position the lock connecting the four-bar linkage is unlocked allowing the linkage to rotate to the second position.

In moving from the first position to the second position, the handle component 804 of the head end siderails 800, 802 generally stays vertical, but the remaining portions thereof may not. To move the head end siderails 800, 802 from the first position to the second position the handle release mechanism 806 is actuated to release the siderail 800, 802. The handle release mechanism 806 generally comprises a handle 818, a hollow handle shaft 820, a bracket 822 for the shafts 818, 824 first and second threaded shafts 824, a plurality of pins 828 connecting the hollow shaft 820 and the threaded shafts 824, and a receiver 826 for each of the threaded shafts 824.

Figure 22:
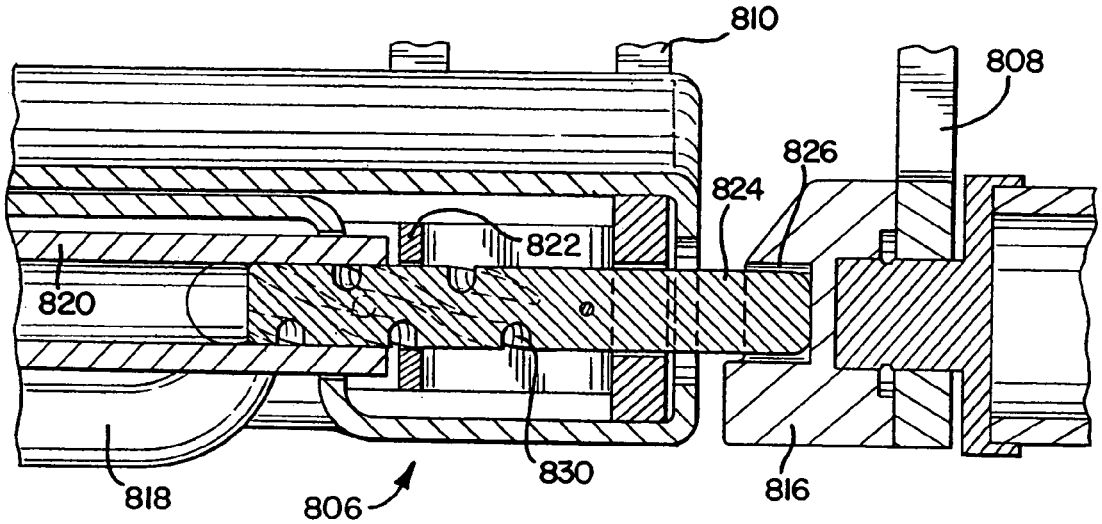
FIG. 22 is a cross-sectional view of the actuation mechanism for the head end siderail assembly of FIG. 21 in the non-deployed position.
Figure 24:
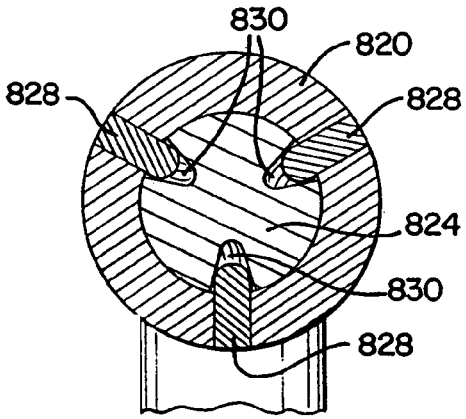
FIG. 24 is a cross-sectional view of the actuation shaft taken of FIG. 22.

FIG. 22 illustrates the handle release mechanism 806 in its standard state. As such, the handle 818 is generally positioned in a downward direction (see also FIG. 1). In the non-actuated position one of the threaded shafts 824 extends out of first end of the hollow handle shaft 820 and the other of the threaded shafts 824 extends out of the second end of the hollow handle shaft 820. In a preferred embodiment, three pins 828 extend through a wall of the hollow shaft 820 at each end of the hollow shaft 820. The pins 828 extend into helical grooves 830 in each of the threaded shafts 824 (see FIG. 24). The threaded shafts 824 extend through an aperture in the inner linkage 810. outside of the handle housing 814 and into a receiver cavity 826 in the locking block 816 connected to the outer linkage 808. When the threaded shafts 824 are secured in the locking block 816, the four-bar linkage is connected in a locked position.

Figure 23:
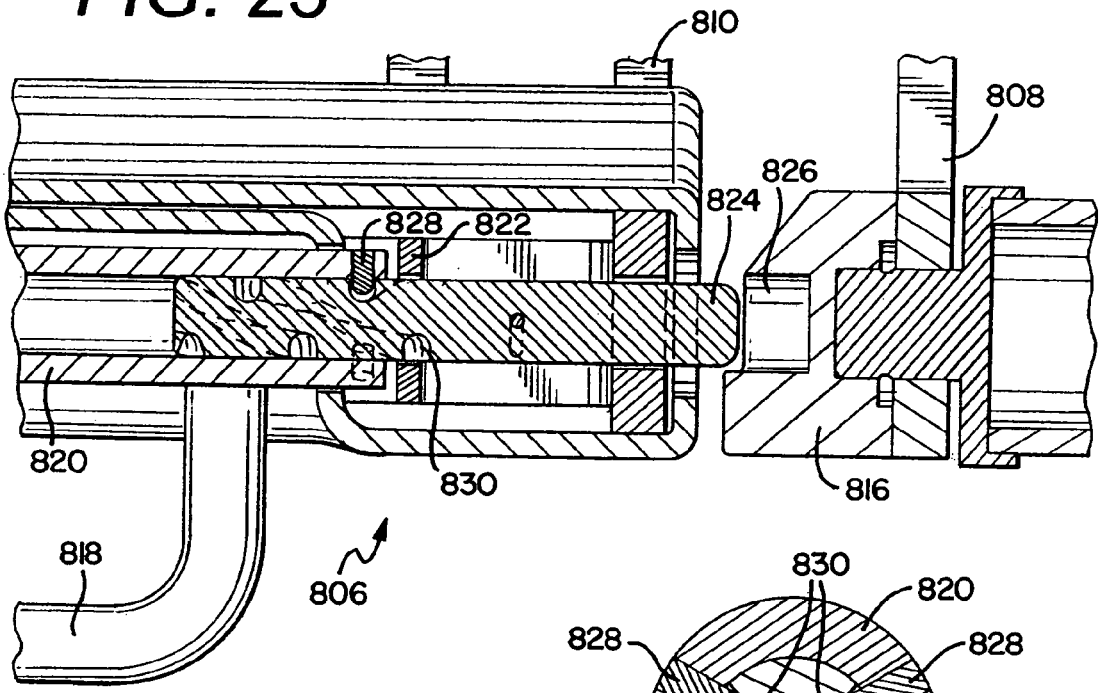
FIG. 23 is a cross-sectional view of the actuation mechanism for the head end siderail assembly of FIG. 21 in the deployed position.

To actuate the handle release mechanism 806 and lower the siderail, the handle 818 is raised by an operator as shown in FIG. 23. When the handle 818 is raised the handle shaft 820, which is fixedly connected to the handle 818, is rotated about its longitudinal axis. As the handle shaft 820 rotates the pins 828 at the ends of the handle shaft 820 also rotate about the longitudinal axis of the handle shaft 820. The pins 828 are provided in the helical grooves 830 of the threaded shafts 824 at each end of the handle shaft 820. By rotating the pins 828 in the helical grooves 830, each of the threaded shafts 824 are drawn further into the center channel of the hollow shaft 820, and similarly out of the receiver cavity 826 in the locking block 816. Once the threaded shaft 824 exits the receiver cavity 826 in the locking block 816 the siderail 800, 802 is free to be repositioned from the first position to the second position. It is further understood that a mechanical damper 834 may be provided to assist in safely lowering the siderails 800, 802 at a more controlled rate from the first position to the second position. As shown in FIG. 1, the mechanical damper 834 may be connected between the bed frame, including the endplate 274 of the deck extender assembly, and the siderail assembly 800, 802. In a preferred embodiment the first and second positions of the siderail 800, 802 are both provided outside the mattress 22 of the bed 10, and not underneath the mattress. Additionally, in alternate embodiments controls and/or controller are integral with any of the siderail assemblies identified herein.

As previously disclosed, the bed 10 has a patient support assembly 19, which in some embodiments includes a mattress 22. One embodiment of a mattress 22 for the bed 10 is shown in FIGS. 30-33. Another embodiment is shown in FIGS. 38-41. The mattress 22 is provided on the deck plates of the head deck, seat deck and foot deck sections 202, 204, 206. Accordingly, while the mattress 22 is generally a single component, the mattress 22 has corresponding integral head, seat and foot portions thereof which are provided over each of the head deck, seat deck and foot deck sections 202, 204, 206. Thus, for reference purposes, though the mattress is a single component it will be identified as having a head mattress portion 850, a seat mattress portion 852 and a foot mattress portion 854. Additionally, the mattress 22 includes an encasing 856 that generally covers the entire mattress 22. In an alternate embodiment, however, various internal sections of the mattress 22 may be provided in more than one piece and placed in the encasing 856, for example, the mattress 22 may comprise a first mattress piece fit into a recess of an encasement and a second mattress piece fit into a second recess of the encasement or abutting the first mattress piece.

Figure 30:
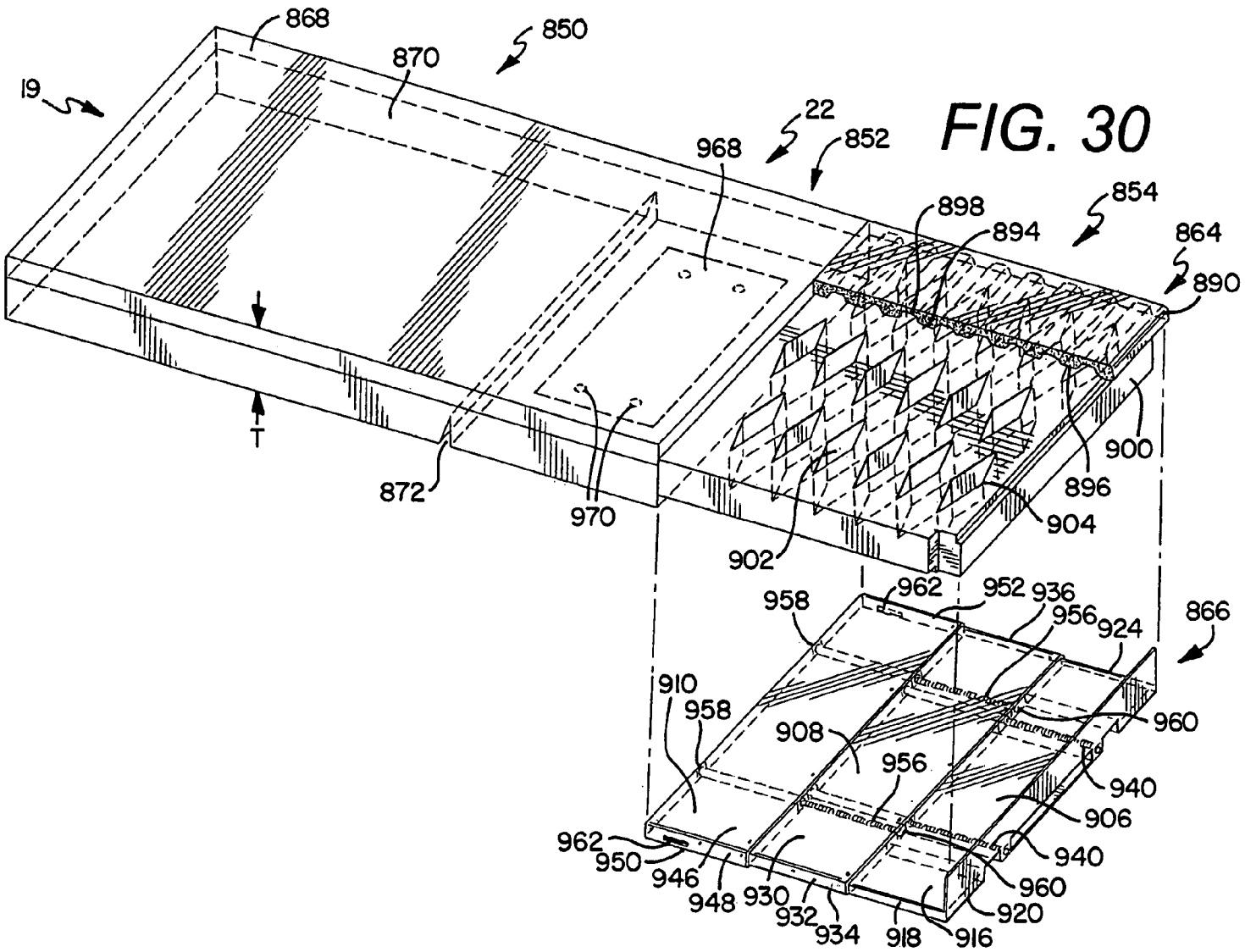
FIG. 30 is an exploded perspective view of one embodiment of a mattress for a hospital bed.

Referring to FIG. 30, at least a portion of the mattress 22 is made of a first upper foam layer 868 and a second lower foam layer 870. Alternatively, the mattress 22 may have air bladder portions thereto. The lower foam layer 870 is generally made of a viscoelastic foam having a first density, and the upper foam layer 868 is generally made of a viscoelastic foam having a second density. Generally, the lower foam layer 870 is stiffer than the upper foam layer 868. In one embodiment, the upper foam layer 868 of at least a portion of the mattress 22 is comprised of a foam material having an indentation load depth (I.L.D.) in the range of 20-40 I.L.D., and the lower foam layer 870 of at least a portion of the mattress 22 is comprised of a foam material having an indentation load depth in the range of 40-60 I.L.D., however alternate densities are possible without departing from the scope of the present invention. In a preferred embodiment the head mattress portion 850 and seat mattress portion 852 are manufactured of unitary layers that form the upper and lower foam layers 868, 870. The lower foam layer 870, however, has a cutout 872 in the shape of a wedge to assist in the bending characteristics of the mattress 22 at the joint of the mattress 22 between the head deck section 202 and the seat deck section 204.

In a preferred embodiment of the mattress 22, the mattress 22 has a thickness (T) of approximately 6", with the upper foam layer 868 being approximately 2" thick, and the lower foam layer 870 being approximately 4" thick. The upper foam layer 868 is generally glued or otherwise attached to the lower foam layer 870 to form an integral mattress component 22.

The mattress 22 is supported on the support deck assembly 20. As shown in FIG. 3, in one embodiment in the horizontal position the support deck assembly 20 has a length $D_1$ extending from the head end 24 to the foot end 26 of the support deck 20, and the mattress 22 has a length $M_1$ extending from the first end 858 of the mattress 22, which is typically adjacent the head end 24 of the bed 10, to the second end 860 of the mattress 22, which is the foot end 26 thereof. In this embodiment, $M_1$ is greater than $D_1$ by a length $L_1$. In such an embodiment, the mattress 22 extends beyond an edge 862 of the foot end 26 of the foot deck section 206 by a distance having a length $L_1$, such that the mattress 22 is cantilevered and overhangs the foot end 26 of the foot deck section 206 by a distance equal to the length $L_1$. In a preferred embodiment the length, $L_1$, of which the mattress 22 extends over the edge of the support deck 20 is greater than the thickness (T) of the mattress 22. Further, in a preferred embodiment the difference between $M_1$ and $D_1$ is greater than the fixed length of the foot deck section 206. It is understood that the mattress 22 extends from the head end 24 of the bed 10 to a distance past the foot end 26 of the frame of the bed.

Additionally, in one embodiment the mattress 22 retracts to a second position as shown in FIG. 35. In the second position a portion of the mattress 22 extends a distance beyond the edge 862 of the foot deck a length $L_2$, with the dimension of $L_2$ being less than the dimension of $L_1$.

As explained herein, the mattress 22 preferably has a width reducing and expanding member. In one embodiment the width reducing/expanding members is an integral retractable portion. The mattress 22 may also have a length reducing/expanding member to reduce the length of the mattress. The length reducing/expanding member may also be an integral retractable portion in different embodiments. In one embodiment, the foot mattress section 854 has a first extended length when the foot deck section 206 is in the generally horizontal up position, and a second retracted length when the foot deck section 206 is in the downwardly extending position. The first extended length is greater than the second retracted length.

In one embodiment, for the mattress 22 to retract from the first position to the second position, the mattress 22 has a compressible mattress portion 864. In another embodiment, the mattress 22 also has an integral retractable rigid mattress portion 866 to aid in compressing the compressible mattress portion 864. In a preferred embodiment, the retractable rigid mattress portion 866 is connected to the compressible mattress portion 864.

In the embodiment wherein the mattress retracts generally at the foot end 26 portion thereof, although compression and retraction occur at the seat and head sections 850, 852 also, the portion of the mattress 22 at the foot end 26 of the foot deck 206, i.e., the foot mattress portion 854, which retracts comprises both the compressible mattress portion 864 and the retractable rigid portion 866. In an alternate embodiment the rigid mattress portion 866 may be placed adjacent the head end 24 of the mattress 22 to shorten the length of the mattress 22 at that end. Such an embodiment may aid in reducing shear on the patient when the head deck section 202 is raised from the horizontal bed orientation to the raised back orientation. Additionally, the compressible mattress portion 864 includes more than merely the foam portion at the foot mattress portion 854, and instead may also include portions of the seat and head mattress areas 850, 852. Accordingly, the compressible mattress portion 864 may extend about a plurality of deck sections.

A portion of the compressible mattress portion 864 is comprised of two layers of compressible material 890, 900. In a preferred embodiment, the compressible material is a non-inflatable material, and is preferably a foam material. The first layer 890 comprises a soft foam material having a lower undulated surface section 894 defining peak formations 896 separated by valley formations 898. The peaks and valleys 896, 898 are dimensioned such that when the compressible mattress portion 864 is compressed from the foot end 26 of the mattress 22, the peak formations 896 will displace closer to one another within the valley formations 898 to thereby shorten the foot mattress portion 854. The second layer 900 also comprises a soft foam material, but instead of having an undulated surface, the second layer 900 has cavities 902 therein. In a preferred embodiment the cavities 902 are in the shape of diamonds. Accordingly, the geometry of the second compressible section 900 is distinct from the geometry of the first compressible section 890. As the second layer 900 is compressed, the peaks 904 of the diamonds will displace closer to one another to thereby shorten the foot mattress portion 854 and reduce any buckling of the foot mattress portion 854. The first and second layers 890, 900 are secured together, typically with a glue or other adhesive, and are also secured to the first upper foam layer 868 and a second lower foam layer 870 at the joint between the seat mattress portion 852 and the foot mattress portion 854.

Figure 31:
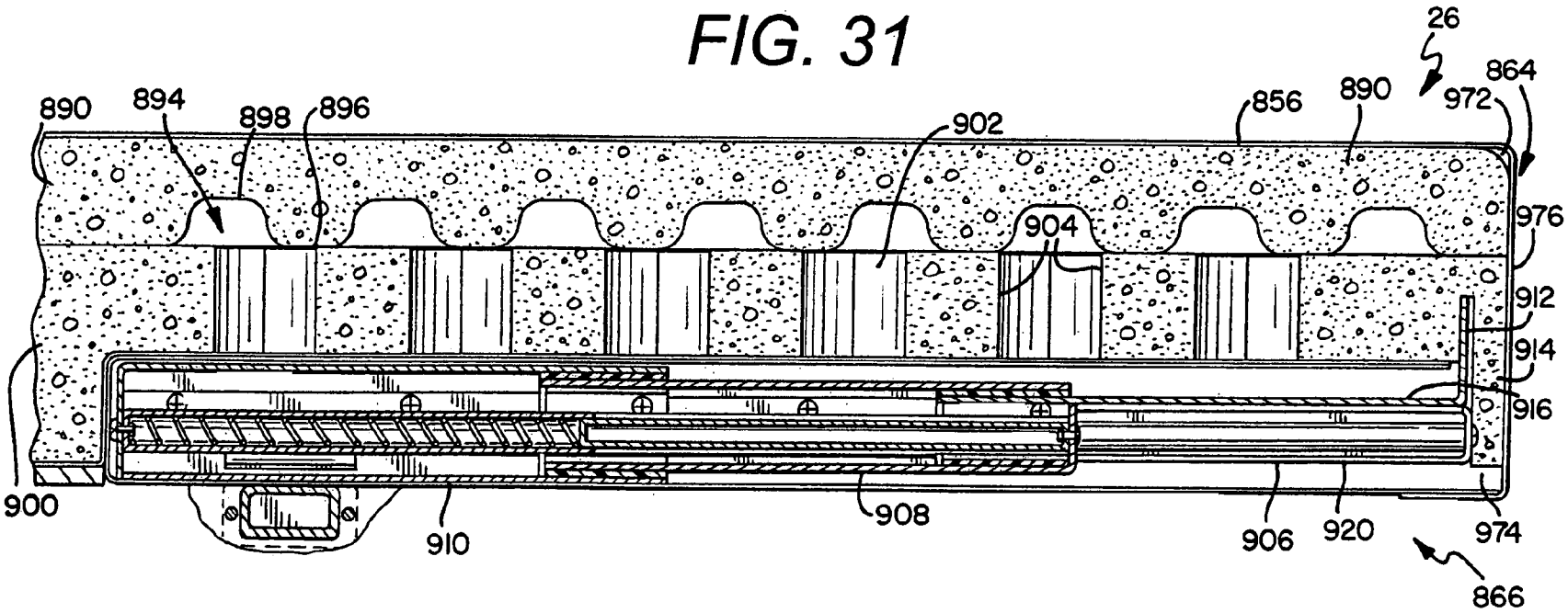
FIG. 31 is a cross-sectional view of an expandable/retractable portion of a mattress for a hospital bed in the expanded orientation.
Figure 33:
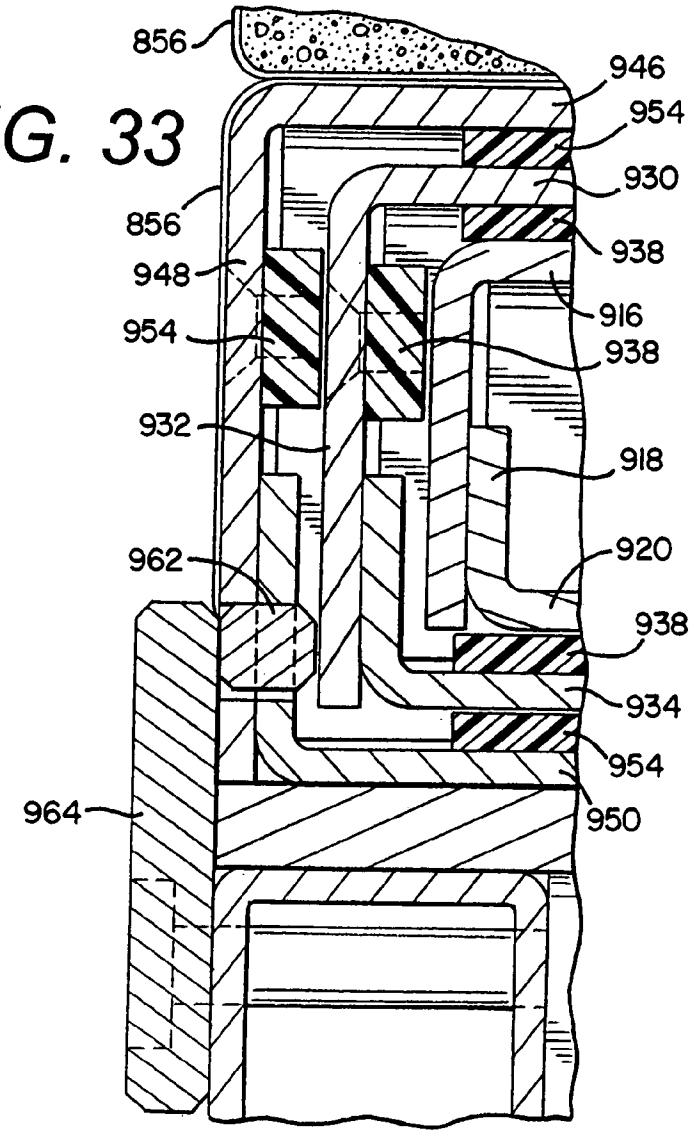
FIG. 33 is a partial cross-sectional view of the expandable/retractable mechanism utilized in the mattress of FIG. 31.
Figure 32:
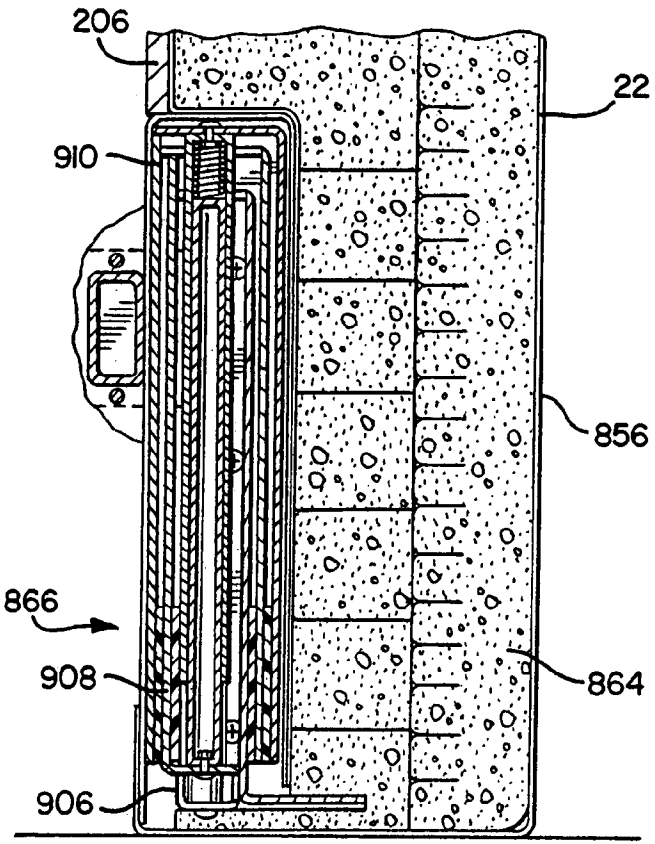
FIG. 32 is a cross-sectional view of an expandable/retractable portion of a mattress for a hospital bed in the retracted orientation.

The retractable rigid mattress portion 866 assists in retracting and extending the foot mattress portion 854, and it also provides strength and rigidity to the cantilevered portion of the mattress 22 overhanging the foot deck section 206 of the support deck assembly 20. In one embodiment, as shown in FIGS. 31-33, the retractable portion 866 comprises a combination of hollow structures slidingly connected to adjacent hollow structures. In one embodiment, the hollow structures are retracting or telescoping drawers 906, 908, 910. FIG. 31 illustrates the retractable portion 866 and compressible mattress portion 864 in the extended position, and FIG. 32 illustrates the retractable portion 866 and the compressible mattress portion in the retracted position. In the retracted position, the rigid mattress portion 866 is closer to the foot end 26 of the foot deck 206 than in the first, expanded position.

Thus, the entire mattress 22 comprises the head mattress portion 850, the seat mattress portion 852 and the foot mattress portion 854. And, the head and seat mattress portions 850, 852 comprise the first upper foam layer 868 and a second lower foam layer 870, and the foot mattress portion 854 comprises the compressible mattress portion 864 and the retractable rigid portion 866. All of these portions are fitted in the mattress encasement 856.

The first, and smallest drawer 906 of the rigid mattress portion 866 is provided at the foot end 26 of the foot mattress portion 854 of the mattress 22. The first drawer 906 has an upwardly extending transverse lip 912 which engages a portion of the compressible mattress portion 864 thereabove. Specifically, the second layer 900 of the compressible mattress portion 864 has a flange 914 extending therefrom, and the lip 912 is fixedly secured to both the flange 914 and the body of the compressible mattress portion 864 at the foot end 26 thereof. Typically, the opposing end of the rigid mattress portion 866 (i.e., the second and third drawers 908, 910) is not directly connected to the compressible mattress portion 864. By having the retractable rigid mattress portion 866 secured to the compressible mattress portion 864, as the retractable rigid mattress portion retracts and expands, the compressible mattress portion 864 will retract and expand simultaneously. As shown in FIGS. 30-31, the first drawer 906 has a top wall 916, a first side wall 918, a bottom wall 920 and a second side wall 924. The bottom wall 920 preferably has two bend sections 926, 928 to increase the rigidity of the first drawer section 906.

The first drawer 906 retracts into the second drawer 908. Like the first drawer 906, the second drawer 908 is shaped like a box and is generally made by bending a piece of metal sheet stock. The second drawer 908 has a top wall 930, a first side wall 932, a bottom wall 934, and a second side wall 936. The second drawer 908 also has a plurality of plastic bushing strips 938 adjacent its entrance at the inner surface of each of four walls 930, 932, 934 and 936 thereof. The bushing strips 938 inside the second drawer 908 engage the outer surface of the first drawer 906 to aid in the sliding of the first drawer 906 into the cavity of the second drawer 908. One of the top and/or bottom walls 916, 920 of the first drawer 906 may have a lip thereto to engage a bushing strip 938 as a stop to prevent the first drawer 906 from being disengaged from the second drawer 908. Additionally, at least one compression spring 940 may be provided to assist in biasing the first drawer 906 toward the extended position. Preferably, a first spring 940 is located within one of the bend sections 926 and a second spring 940 is located within the other bend section 928. The springs 940 engage rear bends 942 in the second drawer 908, and front bends 944 in the first drawer 906.

The second drawer 908 retracts into the third drawer 910, similar to the first drawer 906 retracting into the second drawer 908. Like the second drawer 908, the third drawer 918 is shaped like a box and is generally made by bending a piece of metal sheet stock. The third drawer 910 has a top wall 946, a first side wall 948, a bottom wall 950, and a second side wall 952. The third drawer 910 also has a plurality of plastic bushing strips 954 adjacent its entrance at the inner surface of each of four walls 946, 948, 950 and 952 thereof. The bushing strips 954 inside the third drawer 910 engage the outer surface of the walls of the second drawer 908 to aid in the sliding of the second drawer 908 into the cavity of the third drawer 910. One of the top and/or bottom walls 930, 934 of the second drawer 908 may have a lip thereto to engage one of the bushing strips 954 as a stop to prevent the second drawer 908 from being disengaged from the third drawer 910. Additionally, at least one compression spring 956 may be provided to assist in biasing the second drawer 908 toward the extended position. Preferably, a first spring 956 is located within one of the bend sections of the first drawer 906 and a second spring 956 is located within the other bend section 928. The springs 956 engage rear bends 958 in the third drawer 910, and front bends 960 in the second drawer 908, respectively, in the two bend sections. Telescoping tubing members may be provided over the springs to assist in retaining the springs in the appropriate locations.

The third drawer 910 also has an aperture 962 in each of its side walls 948, 952. The aperture 962 receives a bracket 964 extending from the foot deck section 206. The bracket 964 assists in retaining the mattress 22, and specifically the foot mattress portion 854 thereof, to the support deck assembly 20. Thus, a portion of the rigid mattress portion 866 is fixed in position with respect to the foot deck 206. To access the aperture 910 in the retractable rigid mattress portion 866 of the mattress, the mattress encasing 856 has an associated aperture therethrough.

Another means by which the mattress 22 is secured to the support deck 20 is via a seat plate 968. The seat plate 968, shown in FIG. 30, is a metal plate secured to the bottom of the seat mattress portion 852, preferably with an adhesive. The seat plate 968 has a plurality of fastener receivers 970 therein. To secure the mattress 22, fasteners are passed through apertures in the seat deck plate 440 (as well as apertures in the mattress encasing 856) and received in a mating engagement by the receivers 970 in the seat plate 968.

The entire mattress 22 is fitted into a closable mattress encasing 856. In one embodiment, the encasing 856 has a first cavity or pocket 972 and a second cavity or pocket 974. The foam portions of the head mattress portion 850, the seat mattress portion 852 and the foot mattress portion 854 are fitted into the first cavity 972, and the retractable rigid portion 866 of the mattress 22 connected to the compressible portion 864 is fitted into the second cavity 974. The first and second cavities 972, 974 are joined adjacent the connection between the compressible mattress portion 864 and the retractable rigid portion 866 of the foot mattress portion 854. Additionally, a single closure flap 976 secures the opening of both the first and second cavities 972, 974. Further, the encasing 856 may have wing portions (not shown) extending from the sides of the encasing 856. Preferably the wing portions are positioned adjacent the deck extender assemblies and associated supplemental mattresses when the mattress 22 is positioned on the support deck assembly 20. Accordingly, in a preferred embodiment wing portions are provided at the head and seat sections along the first side of the mattress, and at the head and seat sections along the second side of the mattress. Additionally, the wing portions are preferably made of a stretchable material. The wing portions may attach to either the deck extender assembly or the supplemental mattress when the deck extender assembly and supplemental mattress are positioned in their extended or second position. Finally, a foam insert may be utilized to close the gap between the supplemental mattresses at the head and seat sections when they are extended.

In use, as the foot deck section 206 of the support deck 20 is rotated downwards into the chair position, the encasing 856, having a fixed length, will pull on the foot mattress portion 854 as the encasing 856 is bent around the radius at the joint between the seat deck section 204 and the foot deck section 206, thereby retracting the foot mattress portion 854 inwardly from the first elongated position to the second retracted position by decreasing the length of the mattress 22, preferably without the use of actuators. As the foot deck section 206 is returned to the horizontal bed orientation, however, the bias springs 940, 956 in the retractable rigid portion 866 will aid in expanding the foot mattress portion 854 to its original length. Accordingly, in a preferred embodiment, the retracting and expanding mattress 22 is non-actuated, meaning it has a non-actuated extendable and retractable portion (i.e., the rigid retractable portion 866 and the compressible mattress portion 864) that contracts from a first elongated position to a second contracted position.

Figure 39:
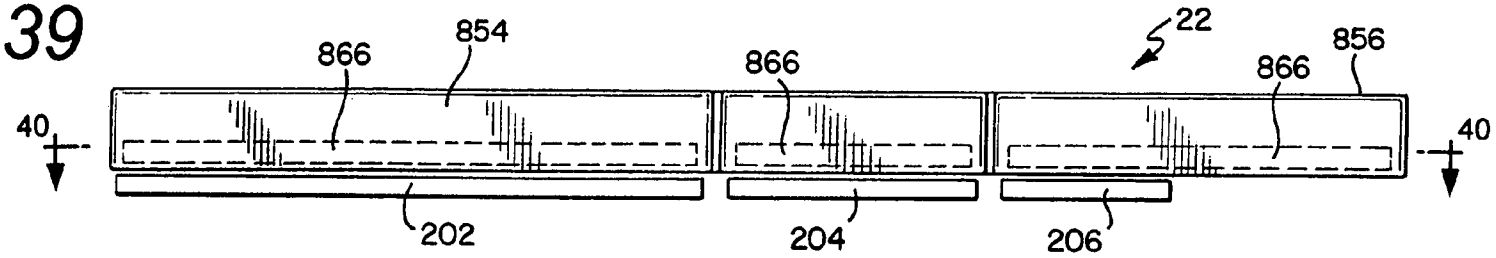
FIG. 39 is a side elevation view of the alternative expandable mattress of FIG. 38.
Figure 40:
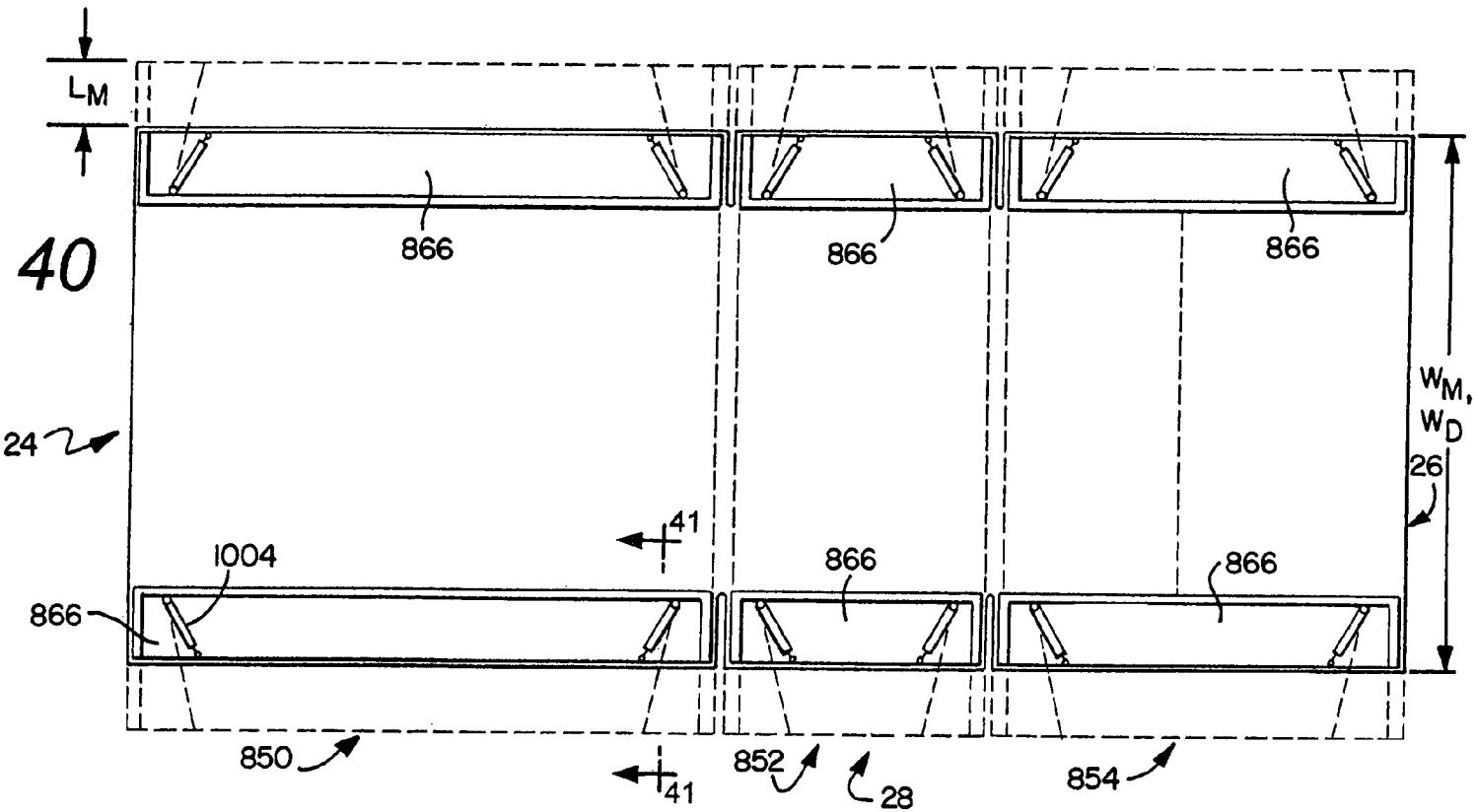
FIG. 40 is a top cross-sectional view about line 40-40 of FIG. 39.

An alternate embodiment of the mattress 22 is shown in FIGS. 38-41. In that embodiment, the mattress 22 is expandable at an area of the mattress including at least one of the head end 24, foot end 26, first side 28 or second side 30. Accordingly, the expandable mattress 22 may have an increasing width at the first side 28 and/or second side 30 of the bed 10, at any or all of the deck sections 202, 204, 206, and/or at the head end 24 and/or foot end 26 of the bed 10. In one embodiment, at the area of the mattress 22 where it is expandable, the mattress 22 extends a distance beyond the support deck assembly 20. Further, in a preferred embodiment of the alternate mattress 22, the portion of the mattress 22 that extends a distance beyond the support deck assembly 20 is cantilevered from and overhangs the portion of the deck 20 by a length $L_M$. As shown in FIG. 40, the mattress 22 has a standard width, $W_M$, and the support deck 20 has a standard width, $W_D$. The mattress is extendable at any of its sections by a length $L_M$ past the width of the deck. In a preferred embodiment the length, $L_M$, by which any portion of the mattress 22 extends over the edge of the support deck 20 is greater than the thickness (T) of the mattress 22. As in the prior embodiment, the mattress 22 includes an encasing 856 that generally covers the entire mattress 22.

Referring to FIGS. 39 and 40, in one embodiment of the alternate mattress 22 the extendable portion of the mattress 22 has a rigid integral mechanical retractable and expandable portion 866 to increase and reduce the length/width of the mattress 22. Separate rigid integral mechanical retractable and expandable portions 866 may be provided at each of the first and second sides of each the head, seat and foot mattress sections 850, 852, 854. Additionally, the mattress 22 may have a compressible mattress portion 864. Like the prior embodiment, in a preferred form both the compressible mattress portion 864 and the integral mechanical retractable and expandable portion 866 are provided, and they are connected to each other.

Figure 41:
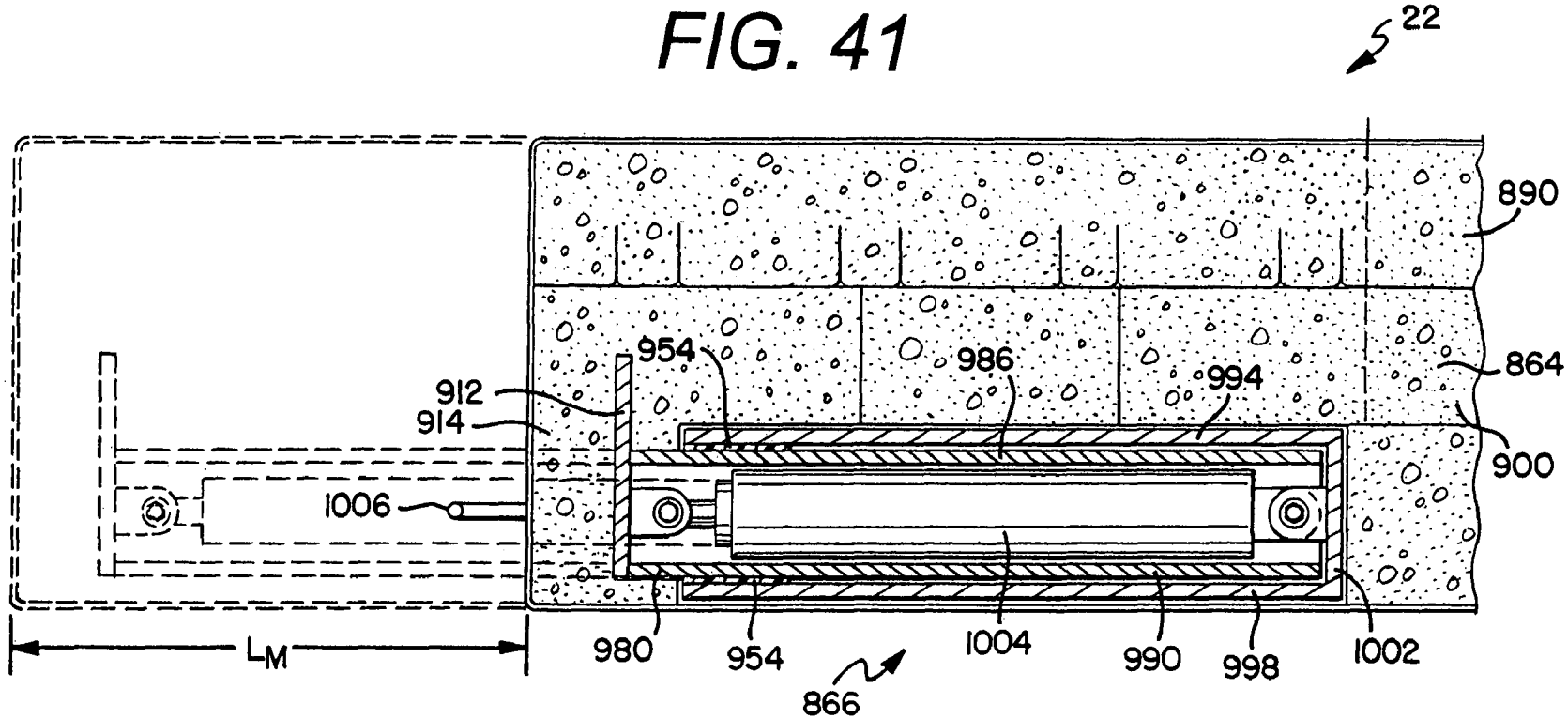
FIG. 41 is a side cross-sectional view about line 41-41 of FIG. 40.

The compressible mattress portion 864 may be comprised either of one or two layers of a foam material. As shown in FIG. 41, the compressible mattress portion 864 comprises two layers of compressible material 890, 900. In a preferred embodiment, the compressible material is a non-inflatable material, and is preferably a foam material. The first layer 890 comprises a soft foam material having at least a portion thereof having a lower undulated surface section defining peak formations separated by valley formations as previously identified. The peaks and valleys are dimensioned such that when the compressible mattress portion 864 is compressed from an edge of the mattress 22, the peak formations will displace closer to one another within the valley formations to thereby compress the compressible mattress portion 854. The second layer 900 also comprises a soft foam material, but instead of having an undulated surface, the second layer 900 has cavities therein, which are preferably in the shape of diamonds as previously identified. As the second layer 900 is compressed, the peaks of the diamonds will displace closer to one another to thereby compress the compressible mattress portion. The first and second layers 890, 900 are secured together, typically with a glue or other adhesive.

The retractable rigid mattress portion 866 assists in retracting and extending the compressible mattress portion 854. In an embodiment wherein the rigid mattress portion overhangs the deck, this section also provides strength and rigidity to the cantilevered portion of the mattress 22 overhanging the respective deck section. In one embodiment, as shown in FIG. 41, the rigid retractable members 866 comprises a combination of structures slidingly connected to adjacent structures, such as a first and second sliding members 980, 982. FIG. 41 illustrates a top view of a plurality of rigid retractable members 866 at each side and section of the mattress 22.

The first sliding member 980 is provided adjacent the edge (i.e. the first end 28, second end 30, head end 24 and/or foot end 26) of the mattress 22. The first member 980 has an upwardly extending transverse lip 912 which engages a portion of the compressible mattress portion 864 thereabove. In one embodiment, the second layer 900 of the compressible mattress portion 864 has a flange 914 extending therefrom, and the lip 912 is fixedly secured to the flange 914. By having the retractable rigid mattress portion 866 secured to the compressible mattress portion 864, as the retractable rigid mattress portion 866 retracts and expands, the compressible mattress portion 864 will retract and expand simultaneously. As shown in FIG. 41, the first member 980 has a top wall 986, a first side wall 988, a bottom wall 990 and a second side wall 992.

The first member 980 retracts into the second member 982. Like the first member 980, the second member 982 is shaped like a box and has a top wall 994, a first side wall 996, a bottom wall 998, a second side wall 1000 and a rear wall 1002. The second member 982 also has a plurality of plastic bushing strips 954 adjacent its entrance at the inner surface of each of four walls thereof. The bushing strips 954 inside the second member 982 engage the outer surface of the walls of the first member 980 to aid in the sliding of the first member 980 into the cavity of the second member 982. The second member 982 may be secured to the deck, such as with fasteners, to retain proper positioning.

Additionally, in one embodiment at least one actuator 1004, such as a gas spring, is connected between the first member 980 and the second member 982, preferably in an internal cavity 1006 between the two components. Alternate embodiments may not employ actuators, and instead will be manually manipulated. The actuators 1004 assist in expanding and retracting the rigid mattress portion 866. Both the retracted and expanded positions are shown in FIGS. 40 and 41. The actuators 1004 may be actuated by pressing on the side of the mattress against the rigid mattress portion 866, or by a handle 1006 connected to the rigid mattress portion as shown in FIG. 41. Alternatively, the actuators 1004 may be controlled by a controller (including a remote controller), and can be independently powered such as with electricity, to be automatically expandable and retractable.

The entire mattress 22 is fitted into a closable mattress encasing 856. The encasing may have extendable or elastic portions thereto at the edges of the encasing to allow for the extension and retraction of the various mattress sections.

Figure 43:
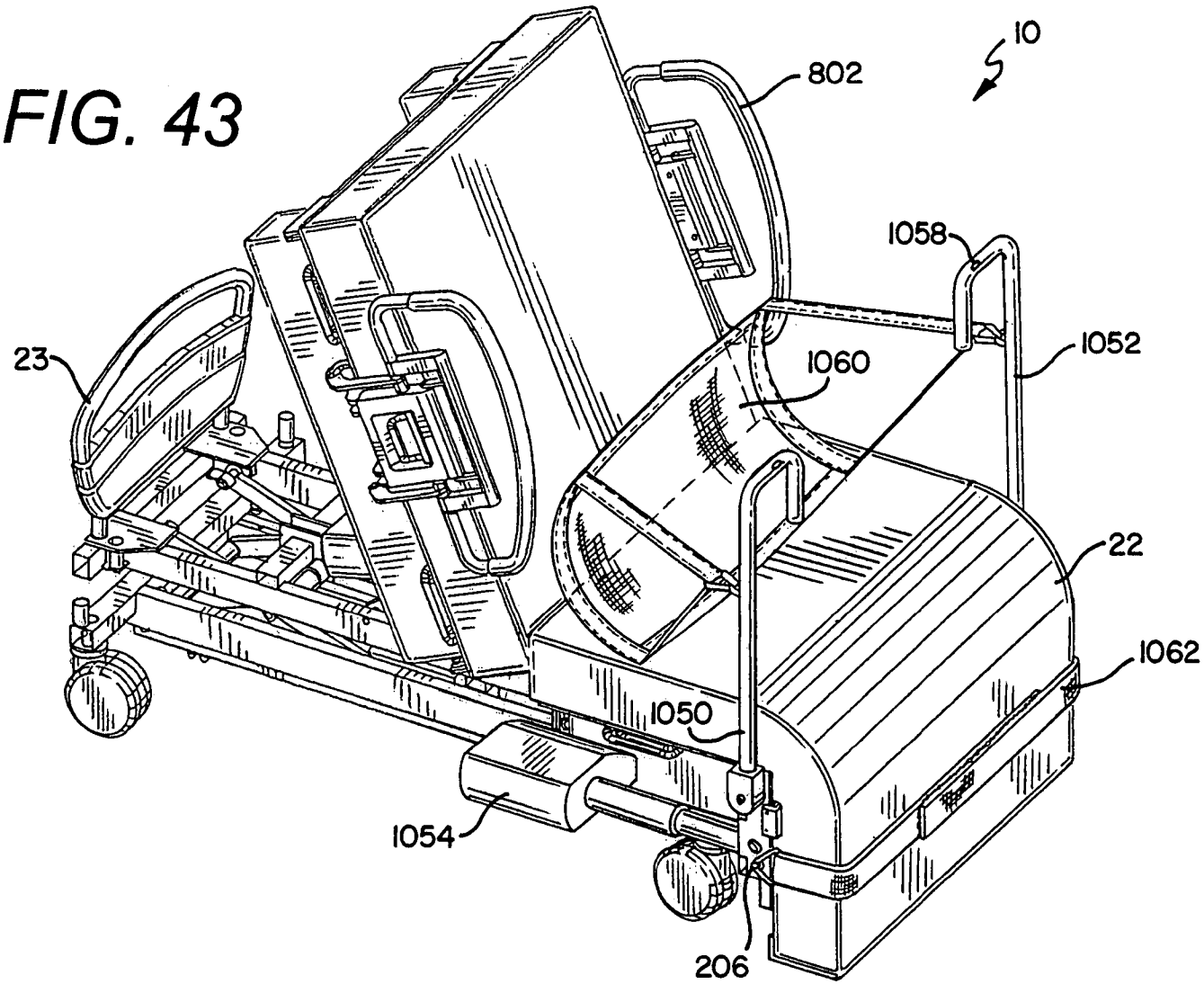
FIG. 43 is a perspective view of an another embodiment of a bed having a sling assist and leg retainer.

Referring now to FIGS. 42 and 43, there are shown additional embodiments of the bed 10 employing first and second powered handles 1050, 1052 to assist a patient in positioning themselves to an upright chair position (i.e., from the bed chair position wherein the head deck section 202 is at a maximum angle of approximately 65° to the horizontal to a position where the patient's back is at generally positioned at a 90° angle to the horizontal) referred to as sit assist, as well as assisting a patient from exiting out of the foot end 26 of the bed 10 when the bed is in the chair orientation, referred to as sit-to-stand assist. In FIG. 42, portions of the intermediate frame assembly 18 and support deck assembly 20 are illustrated, including portions of the head deck section 202, seat deck section 204 and foot deck section 206. Instead of having a foot end siderail 670, 672 as explained above that is moveable between an engaged position, wherein the siderail 670, 672 is fixed in movement relative to the foot deck section 206, and a disengaged position, wherein the siderail 670, 672 is free to rotate or pivot apart from movement of the foot deck section 206, this embodiment of the bed 10 includes separately actuated handles 1050, 1052. The separately actuated handles 1050, 1052 may be connected to the head deck section 202, seat deck section 204, foot deck section 206 or frame. The configuration of the handle 1050, 1052 may be modified without departing from the scope of the present invention. Additionally, it is understood that the handles 1050, 1052 are removable from the bed 10 and can be replaced with different handles having different configurations and different accessories attached thereto.

As shown in FIG. 42, a handle actuator 1054 operates as a powered manipulator of the handles 1050 and/or 1052. Separate handle actuators 1054 may be provided for each of the handles 1050, 1052, or a single handle actuator 1054 may be utilized to manipulate both the handles 1050, 1052. Generally, the handle actuator 1054 is connected to one of the intermediate frame assembly 18 or the support deck assembly 20, and preferably the handle actuator 1054 is connected to the intermediate frame 180.

In one embodiment the handle actuator 1054 is connected to a shaft for the handle 1050, 1052, and as shown in FIG. 42, the handle actuator 1054 may be connected to the foot deck shaft 640 shaft as shown in FIG. 42. As such, in this embodiment the handles 1050, 1052 generally pivot or rotate about the shaft 640, and the portion of the handle 1050, 1052 grasped by the patient moves about a radius to assist in moving the patient upward and outward. In alternate embodiments employing different types of actuators, a shaft may not be necessary and the actuator may be connected directly to the handle or to some alternate connector or linkage assembly. Referring again to FIG. 42, the piston of the handle actuator 1054 is connected to a plate 1056 that is connected to the shaft 640, which the handle 1050, 1052 is also connected to. In one embodiment, the plate 1056 is further connected to the locking assembly 674 at the foot deck 206, and preferably to the coupling member 650 thereof. Accordingly, in one embodiment the handle actuator 1054 operates only the handles 1050, 1052, and in another embodiment the handle actuator 1054 may also operate the foot deck 206. Additionally, the handle 1050, 1052 can be disengaged from the handle actuator 1054 and locking assembly 674 to allow the handle 1050, 1052 to be rotated to the second position as identified above with respect to the second siderail assemblies 29.

The handles 1050, 1052 are configured to be conveniently gripped by the patient while both in the bed (i.e. assisting the patient to obtain a generally 90° sitting position), as well as when entering and exiting the bed 10 as a hand hold. It is understood that the handles may operate as a siderail, and that the previously identified siderails may operate as handles. The handle is movable from a first position, wherein a gripping portion of the handle is located a first distance from the head end 24 of the bed to a second position located a second distance from the head end 24 of the bed, the second distance being greater than the first distance.

Additionally, in a preferred embodiment a control switch 1058 (such as a control button or toggle switch) electrically connected to one or more of the actuators through a bed controller is also provided on one or more of the handles 1050, 1052. The control switch 1058 is utilized to pivot the handles 1050, 1052, and in some embodiments also to manipulate the foot deck section 206 from the generally horizontal position to the substantially vertical position. The control switch 1058 in the handle 1050, 1052 allows the patient to simultaneously grasp and retain the handle 1050, 1054 as the handle 1050, 1052 is being manipulated by the actuator controlled by the patient. By having controls therein the handles 1050, 1052 can be easily manipulated at a controlled rate to assist the patient in attaining an upright chair orientation, in advancing the patient toward the foot end 26 of the bed for easier exit therefrom, in assisting in advancing the patient out of the chair bed, and in manipulating various deck sections, such as the foot deck section 206.

Referring to FIG. 43, the bed 10 may include a sling 1060 to further assist in advancing and raising the patient out of the chair bed 10. In one embodiment one end of the sling 1060 is connected to the first handle 1050, and the opposing end of the sling 1060 is connected to the second handle 1054. As the handles 1050, 1052 are pivoted the sling 1060, which is preferably positioned behind and partially below a portion of the patient, is simultaneously rotated upwardly and outwardly to assist in raising the patient and advancing the patient out of the chair bed. In alternate embodiments, the handles 1050, 1052 may telescope upwardly to further assist the patient in advancing out of the bed or moving themselves when in the bed. Further, in alternate embodiments the sling 1060 may be retractable by separate actuators to operate to raise the sling 1060 without moving the handles 1050, 1052.

Further, as shown in FIG. 43, a leg retainer 1062 may be provided. The leg retainer 1062 assists in retaining the legs of the patient in a fixed position so that when the handles 1050, 1052 and/or sling 1060 are used to assist the patient to the standing position the feet of the patient can operate as a pivot point instead of being capable of sliding out from under the patient. In one embodiment the leg retainer 1062 comprises a strap to retain the legs of the patient. The strap preferably has a first component and a second component that can be easily and repeatedly connected and disconnected together, such as by Velcro or a buckle connection. The strap 1062 is generally connected to the mattress 22 or the foot deck section 206, however, it may be connected to other components such as the frame.

Figure 44:
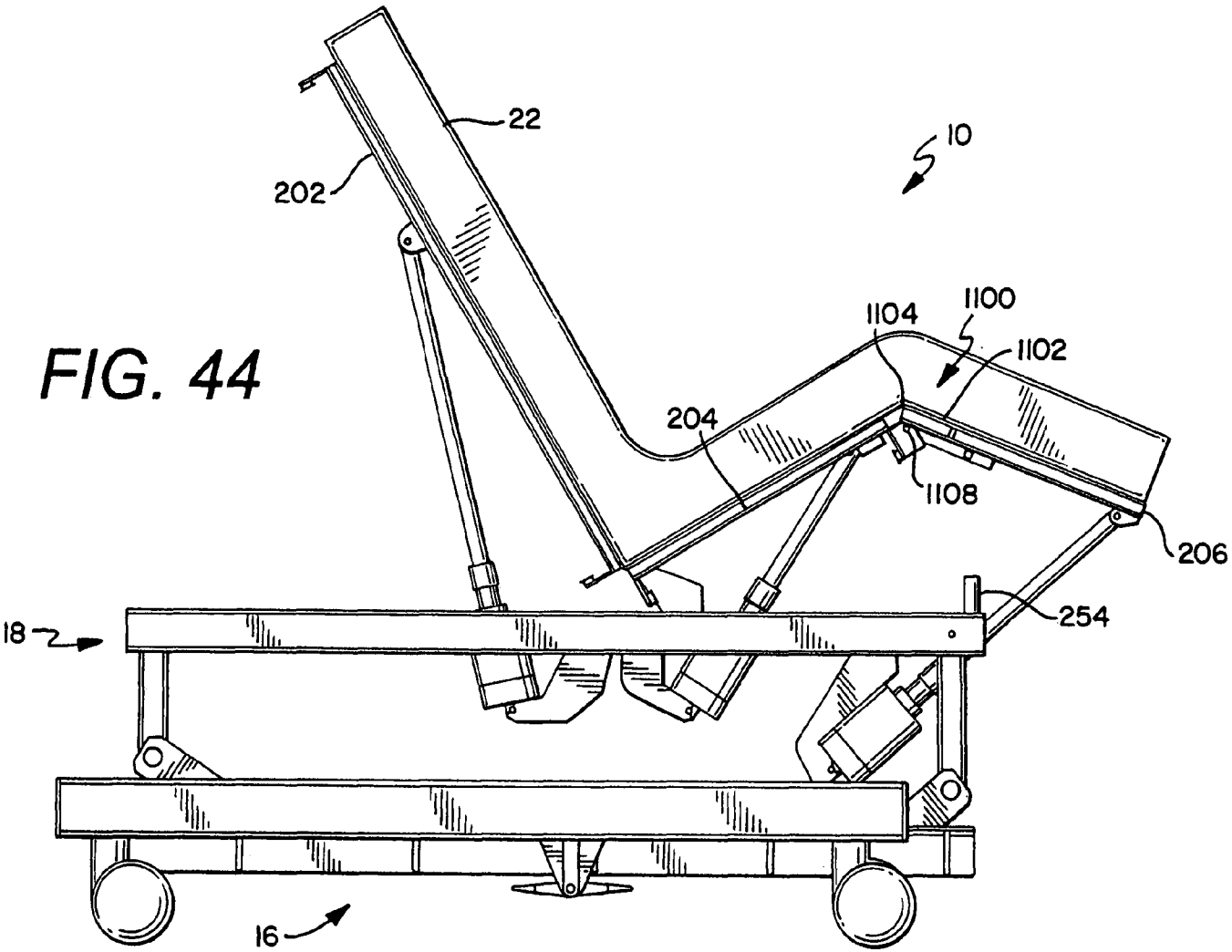
FIG. 44 is a side elevation view of another embodiment of a bed having a knee break assembly.

In an alternate embodiment as shown in FIG. 44, the bed 10 may also have a knee break assembly 1100 as a part of the support deck assembly 20. In one embodiment the knee break assembly 1100 is generally disposed between the seat deck section 204 and the foot deck section 206. The knee break assembly 1100 comprises a knee deck section 1102, one or more pivot assemblies 1104 and one or more stops 1106. In one embodiment, a first pivot assembly 1104 pivotally connects the seat deck section 204 to the knee deck section 1102, and a second pivot assembly 1104 pivotally connects the foot deck section 206 to the knee deck section 1102. The pivot assemblies 1104 generally allow for pivoting movement of the adjacent deck sections in relation to the knee deck section 1102, or for direct movement of different knee deck sections 1102. The stops 1106 may be disposed on the frame for facilitating the transition of the bed from one position to another. Alternatively, the stop 1106 may be a roller to provide for smoother movement of the different deck sections.

Figure 45:
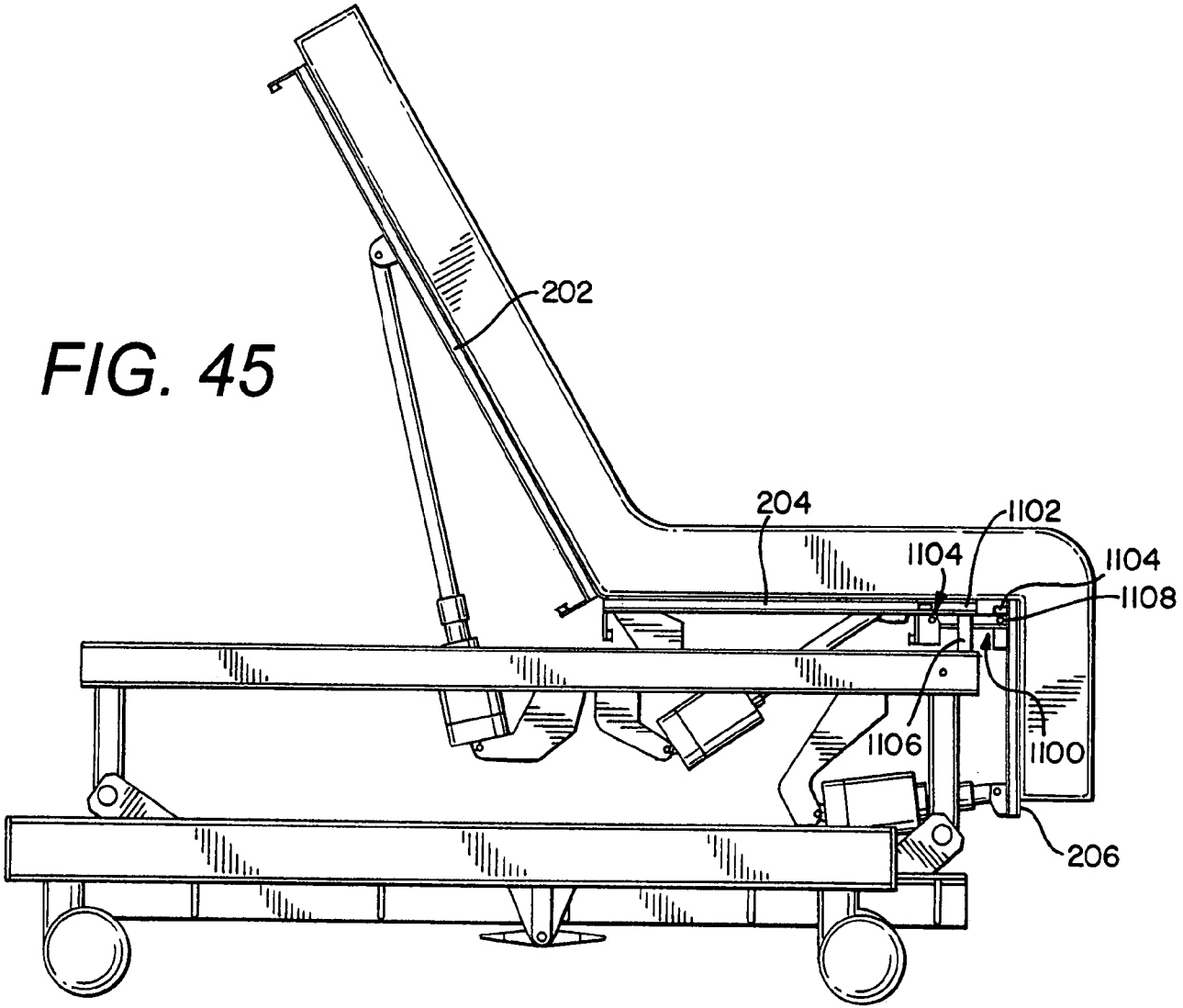
FIG. 45 is another side elevation view of another embodiment of a bed having a knee break assembly; and, FIG. 46 is a side elevation view of a bed having an alternate knee break assembly.

In operation, the knee break assembly 110 provides at least two spaced apart breaks in the knee area (a first break on one side of the knee deck section 1102 and a second break on the opposing side of the knee deck section 1102), providing for natural and comfortable leg positions for the patient. In the knees-up position, also referred to as the knee-gatch position, as shown in FIG. 44, the break is closer to the center of the body, providing a shorter seat section of mattress that allows for a more natural knee bend for the patient. In the seat position as shown in FIG. 45, the knee break is closer to the foot deck section 206. By moving the knee break closer to the foot end 26 of the bed 10, the effective length of the foot deck section 206 becomes shorter while the effective length of the seat deck section 204 becomes longer. Making the foot deck section 206 shorter allows the entire patient support assembly 19 to be able to move closer to the floor when in a chair position prior to the end of the foot deck section 206 hitting the floor. In this embodiment, the mattress 22 may extend beyond a foot end 26 of the foot deck section 206, or it may not extend beyond a foot end 26 of the foot deck section 206. The actuators of the bed provide for manipulating each of the deck sections 202, 204, 206, 1102 into the various positions.

Figure 46:
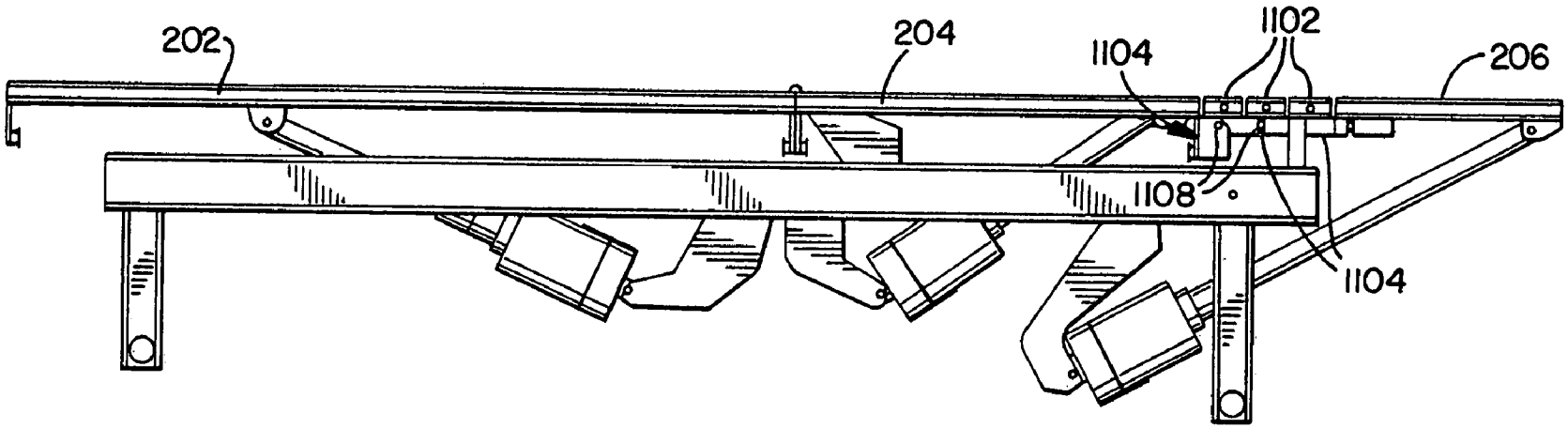

Referring to FIG. 46, the patient support deck assembly 20 may include a plurality of knee deck sections 1102 positioned between the seat deck section 204 and the foot deck section 206. As shown in FIG. 46, one embodiment employs three knee deck sections 1102. Each knee deck section 1102 includes an associated pivot assembly 1104. By employing multiple knee deck sections 1102 the length of the seat deck section 204 can be adjusted to better suit the anatomy of the patient. For example, a particular knee deck section 1102 can be chosen and locked into place to provide a longer effective seat deck section 204 for patients that are taller. Additionally, different knee deck sections 1102 may be chosen so that the knee breaks at a different pivot assembly 1104 during operation of the bed from the horizontal position to the knee gatch position and ultimately to the chair position.

In different embodiments the pivot assemblies 1104 include anti-rotation features to keep the next forward knee deck section 1102 from rotating backwards or upwards when a particular knee deck section 1102 has been chosen to adjust the effective length of the seat deck section 204. In one embodiment the anti-rotation feature comprises an anti-rotation pin secured within at least one pivot hole of a pivot assembly. Those with skill in the art will recognize that other arrangements are possible for the multiple segment knee deck section assembly.

Further, the pivot assemblies 1104 may be locked to lock the knee deck sections 1102 in place to provide for different length effective seat deck sections 204. In one embodiment a knee lock mechanism 1108 may be employed to be engaged and disengaged as needed. When engaged various knee deck sections 1102 may be locked to have the knee deck assembly 1000 break further from the seat deck section 204. The knee lock mechanism 1008 may include a solenoid mechanism attached to one of the deck sections, the solenoid having a piston that engages an aperture in a bracket connected to a knee deck section 1002. When the piston engages the aperture the knee deck section 1002 is locked in position, but when the piston does not engage the aperture the knee deck section 1002 is free to be manipulated and pivot in accordance with the actuators of the bed. A plurality of apertures may be provided in the bracket to lock the knee deck sections 1002 in various positions.

While the knee link assembly 1000 has been described as a joint between the seat deck section 204 and the foot deck section 206 it is understood by those of ordinary skill in the art that the knee link assembly concept can be used at other locations of patient support surfaces on beds, as well as locations of patient support surfaces of other types of patient supports such as birthing beds, operating tables, stretchers, wheel chairs that provide a variable or adjustable geometry surface, etc.

While different beds are referenced herein, such as a standard bed 10, a chair bed, an expanding width bed, etc. it is understood that any feature disclosed herein may be utilized with any type patient support mechanism, and reference to one type of bed respecting a particular feature does not preclude incorporation of that feature into any other type of bed.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A patient support for a bed, the patient support comprising:

a deck supported on a frame, the deck having a head end and a foot end, the head end being adjacent a head end of the bed and the foot end being adjacent a foot end of the bed, wherein the deck has a first deck section, a second deck section and a third deck section, the first deck section located adjacent the head end of the bed, the third deck section located adjacent the foot end of the deck and having an edge that is an endmost edge of the deck at the foot end thereof, and the second deck section between the first deck section and the third deck section, wherein the first deck section is moveable from a generally horizontal position to a more vertical back-support position, and wherein the second deck section is pivotable upwards; and, a mattress supported on the deck, an end portion of the mattress extending a distance beyond a foot end edge of the third deck section a length, $L_1$, when the mattress is in a first position, such that the end portion of the mattress is cantilevered and overhangs the foot end edge of the third deck section a distance greater than a thickness of the mattress in the first position, and wherein the mattress retracts to a second position, in the second position a portion of the mattress extending a distance beyond the edge of the foot deck a length $L_2$, wherein $L_2$, is less than $L_1$.

2. The patient support of claim 1, wherein the mattress has a first end adjacent the head end of the deck.

3. The patient support of claim 1, wherein the mattress has a compressible mattress portion and a rigid mattress portion.

4. The patient support of claim 3, wherein the compressible mattress portion extends about a plurality of deck sections, and wherein the rigid mattress portion is positioned adjacent a foot deck section of the deck.

5. The patient support of claim 3, wherein the rigid mattress portion is fixed to the compressible mattress portion, and wherein the rigid mattress portion is retractable from the first position to a second position to shorten the mattress.

6. The patient support of claim 1, wherein the mattress is fixed to the deck.

7. The patient support of claim 1, wherein the third deck section is moveable from a generally horizontal position to a substantially vertical position.

8. A patient support for a bed, the patient support comprising:

a frame;

a deck supported on the frame, the deck having a first deck section, a second deck section and a third deck section, the first deck section located adjacent a head end of the deck, the third deck section located adjacent a foot end of the deck and having an edge that is an endmost edge of the deck at the extreme foot end of the deck, and the second deck section between the first deck section and the third deck section, the deck further having a first side and an opposing second side, wherein the first deck section is moveable from a generally horizontal position to a more vertical back-support position, and wherein the third deck section is moveable from a generally horizontal position to a substantially vertical position; and, a mattress supported on the deck, the mattress extending to a first position located a distance beyond a distal edge of the third deck a length, $L_1$, when the third deck is in the generally horizontal position, the mattress retracting to a second position such that the mattress overhangs the distal edge of the third deck a length, $L_2$, when the third deck is in the generally vertical position, length $L_1$ being greater than length $L_2$.

9. The patient support of claim 8, wherein a length of the third deck is static at all positions.

* * * * *